US008567896B2

(12) United States Patent
Ueshima

(10) Patent No.: US 8,567,896 B2
(45) Date of Patent: Oct. 29, 2013

(54) DEFECTIVE RECORDING ELEMENT CORRECTION PARAMETER SELECTION CHART, DEFECTIVE RECORDING ELEMENT CORRECTION PARAMETER DETERMINATION METHOD AND APPARATUS, AND IMAGE FORMING APPARATUS

(75) Inventor: Masashi Ueshima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 171 days.

(21) Appl. No.: 13/137,571

(22) Filed: Aug. 26, 2011

(65) Prior Publication Data

US 2012/0050377 A1 Mar. 1, 2012

(30) Foreign Application Priority Data

Aug. 27, 2010 (JP) ..... 2010-190739

(51) Int. Cl.
*B41J 29/393* (2006.01)

(52) U.S. Cl.
USPC ..... 347/19; 347/14

(58) Field of Classification Search
USPC ..... 347/5, 9, 14, 19
See application file for complete search history.

(56) References Cited

U.S. PATENT DOCUMENTS 5,276,459 A 1/1994 Danzuka et al.
7,289,248 B2 * 10/2007 Yamazaki ..... 347/19
7,347,525 B2 * 3/2008 Mizes ..... 347/19
7,537,305 B2 * 5/2009 Chiwata ..... 347/19
2008/0211850 A1 9/2008 Miyamoto et al.
2009/0237430 A1 9/2009 Tatsumi

FOREIGN PATENT DOCUMENTS

EP 1 308 279 A2 5/2003
JP 2008-168592 A 7/2008

OTHER PUBLICATIONS

Extended European Search Report dated Dec. 15, 2011, issued in corresponding European Patent Application No. 11178802.2.

* cited by examiner

*Primary Examiner* — Juanita D Jackson
(74) *Attorney, Agent, or Firm* — Birch, Stewart, Kolasch & Birch, LLP

(57) ABSTRACT

A defective recording element correction parameter selection chart which is output by an image forming apparatus that performs image formation on a recording medium by a plurality of recording elements included in a recording head while conveying at least one of the recording head and the recording medium so as to cause relative movement between the recording head and the recording medium, the chart being used, in a case where there is at least one defective recording element which is not able to perform recording among the plurality of recording elements, in order to determine a defective recording element correction parameter expressing an amount of correction for correcting image formation defects caused by the at least one defective recording element, with image formation by a recording element other than the at least one defective recording element.

36 Claims, 31 Drawing Sheets

VTF

MEASUREMENT PATCH -
REFERENCE PATCH

SUM OF SQUARES OF
COMPONENTS
(EVALUATION INDEX)
EVALUATION
INDEX

CORRECTION
PARAMETER

PROFILE IN CONVEYANCE DIRECTION

VTF

MEASUREMENT PATCH – REFERENCE PATCH

SQUARE ROOT OF SUM OF SQUARES OF COMPONENTS (EVALUATION INDEX)
EVALUATION INDEX

CORRECTION PARAMETER

IDEAL CORRECTION RESULT

ACTUAL CORRECTION RESULT

DEFECTIVE RECORDING ELEMENT CORRECTION PARAMETER SELECTION CHART, DEFECTIVE RECORDING ELEMENT CORRECTION PARAMETER DETERMINATION METHOD AND APPARATUS, AND IMAGE FORMING APPARATUS

BACKGROUND OF THE INVENTION

1. Field of the Invention

The present invention relates to correction technology for improving image formation defects caused by defective recording elements in a recording head having a plurality of recording elements, such as an inkjet head, and more particularly, to a parameter selection chart suitable for determining a parameter to be used in correction processing, and a parameter determination method, a parameter determination apparatus and an image forming apparatus using the parameter selection chart.

2. Description of the Related Art

In image formation by an inkjet method, when the inkjet head starts to be used, nozzles which are in a state of ejection failure due to blockages or breakdown occur. In particular, in the case of image formation by a single pass method, the ejection failure nozzle locations are perceived as white stripes and therefore the correction is required. There have been a large number of suggestions thus far in respect of ejection failure correction technology (e.g. Japanese patent application publication No. 2008-168592).

FIG. 29 shows a schematic diagram of the basic concept of ejection failure correction. When an ejection failure nozzle occurs in a print head 800, a white stripe occurs in the image formation region corresponding to this nozzle. Therefore, when correcting ejection failure, the visibility of the white stripe is reduced by increasing the density of image formation performed by nozzles which are adjacent to the ejection failure nozzle (referred to as "ejection failure correction nozzles"). There are various methods for increasing the density of image formation by ejection failure correction nozzles, for example: (1) correcting the output image, (2) strengthening the ejection signal to make the diameter of the ejected dots larger, and so on.

(1) Method of Correcting Output Image

If the image density for image formation of the surrounding area is taken as $D^{default}$, then it is possible to increase the image formation density of the ejection failure correction nozzles and reduce the visibility of a white stripe, by setting the image density for the ejection failure correction nozzles to $D^{No\ Print}$ ($>D^{default}$). The ratio between these image densities can be defined as the ejection failure correction nozzle image density increase $P^{density}$.

(2) Method of Strengthening Ejection Signal and Enlarging Ejection Dot Diameter

If the dot diameter for image formation of the surrounding area is taken as $R^{default}$, then it is possible to increase the dot diameter of the ejection failure correction nozzles and reduce the visibility of a white stripe, by setting the dot diameter for the ejection failure correction nozzles to $R^{No\ Print}$ ($>R^{default}$) The ratio between these dot diameters can be defined as the ejection failure correction nozzle dot diameter increase $P^{dot}$.

In the present specification, the amount of strengthening of image formation by the ejection failure correction nozzles, such as the ejection failure correction nozzle image density increase $P^{density}$ and the ejection failure correction nozzle dot diameter increase $P^{dot}$ in the two typical examples described above, and the amount of correction similar to this, are defined generally as an ejection failure correction parameter P.

If the ejection failure correction parameter P is too large, then a black stripe is formed due to over-correction, and if the ejection failure correction parameter P is too weak, then a white stripe is formed due to under-correction. Therefore, technology for finding the optimal value of P is required.

Overview of Method Disclosed in Japanese Patent Application Publication No. 2008-168592

In Japanese patent application publication No. 2008-168592, the ejection failure correction parameter is calculated on the basis of scan data produced by an optical reading device from an optimal value selection chart. FIG. 30 shows an overview of a measurement procedure disclosed in Japanese patent application publication No. 2008-168592. A correction amount R for density non-uniformity caused by ejection failure is calculated by the following procedure.

[1] A uniform image ("normal test pattern") is output in which an image is formed on a prescribed region of a sheet of paper at uniform densities based on respective measurement tones corresponding to a plurality of different densities, and this image is scanned to measure the average tone value Ra. [2] A plurality of nozzles are disabled for ejection, a uniform image similar to that described above ("omitted nozzle test pattern") is output, and this image is scanned to measure the average tone value Rb. [3] The ratio Ra/Rb is calculated, and this is set as the ejection failure correction parameter.

However, in the method described in Japanese patent application publication No. 2008-168592, the measurement accuracy of the ejection failure correction parameter is expected to decline due to the following factors.

<1> Human visual characteristics are not taken into account. There is a large disparity between the tones read by a scanner and human visual characteristics. Moreover, in the method described in Japanese patent application publication No. 2008-168592, measurement results vary with the reading resolution of the scanner. The measurement accuracy declines due to the combination of these.

<2> No evaluation is carried out after the ejection failure correction parameter has been applied. The image formation by ejection failure correction nozzles adjacent to an ejection failure nozzle is of a tone darker than the surrounding uniform image area. Therefore, the amount of change in the contrast, in other words, in the visibility of the ejection failure correction results, becomes greater with respect to the ejection failure correction parameter. Moreover, the visibility varies greatly due to various factors, such as the position error, dot diameter variation, landing interference, and the like, in the vicinity of the ejection failure nozzle.

Furthermore, with a single pass method, it is common to employ a composition of the print head 800 in which a plurality of head modules 802 having the same design are arranged in a direction perpendicular to the direction of conveyance of the paper 820, as shown in FIG. 29. If the same ejection failure correction parameter is applied to each of the head modules 802 as shown in FIG. 31A, then ideally the same correction result is obtained, but in actual practice, the visibility of the correction results varies between the head modules, as shown in FIG. 31B.

<3> If the test pattern (chart) is output by an inkjet printer, then image non-uniformities occur due to the effects of positional error, ejection non-uniformities, and other factors. This is a cause of error in the measurement of the ejection failure correction parameter on the basis of the output results of the test pattern. In a method which measures the average tone value as in the procedure described in Japanese patent application publication No. 2008-168592, it is not possible to eliminate the effects of image non-uniformities entirely.

SUMMARY OF THE INVENTION

The present invention has been contrived in view of these circumstances, an object thereof being to provide a defective recording element correction parameter selection chart which improves the drawbacks of conventional correction technology and which makes it possible accurately to measure a defective recording element correction parameter for correcting an image formation defect caused by a defective recording element, by means of image formation by other recording elements. A further object of the present invention is to provide a method and an apparatus for determining an optimal value of a defective recording element correction parameter from the output results of the defective recording element correction parameter selection chart, and to provide an image forming apparatus comprising a correction function which uses this defective recording element correction parameter.

The following modes of the invention are proposed in order to achieve an aforementioned object.

In order to attain an object described above, one aspect of the present invention is directed to a defective recording element correction parameter selection chart which is output by an image forming apparatus that performs image formation on a recording medium by a plurality of recording elements included in a recording head while conveying at least one of the recording head and the recording medium so as to cause relative movement between the recording head and the recording medium, the chart being used, in a case where there is at least one defective recording element which is not able to perform recording among the plurality of recording elements, in order to determine a defective recording element correction parameter expressing an amount of correction for correcting image formation defects caused by the at least one defective recording element, with image formation by a recording element other than the at least one defective recording element, the chart including: a reference patch constituted by a uniform image which is an image formed on a region of the recording medium with a uniform density based on a constant tone; and at least one measurement patch in which a state after correction using the amount of correction corresponding to a candidate value of the defective recording element correction parameter which expresses the amount of correction is reproduced in a state that one or more of the recording elements which have formed the reference patch are set to be in a non-recording state, the candidate value of the defective recording element correction parameter being applied to an image formation portion which is formed by a recording element that carries out recording in a vicinity of a non-recording position of the one or more of the recording elements which have formed the reference patch and have been set to be in the non-recording state.

One or a plurality of measurement patches are formed by varying the defective recording element correction parameter in a continuous or stepwise fashion, so as to be able to confirm the image formed under different conditions with regard to the amount of correction (correction results). By comparing the measurement patches with a reference patch on the chart, it is possible to select, as an optimal value, the value of the defective recording element correction parameter where the state after correction is closest to the image of the reference patch.

The "defective recording element correction parameter" is a term which encompasses the ejection failure correction parameter P described above. The defective recording element correction parameter is a term which refers generally to an amount of strengthening of image formation, such as an amount of increase in the image density or an amount of increase in the dot diameter, or the amount of a similar correction, relating to recording elements which are in the vicinity of a defective recording element (defective recording correction recording elements) and which are used to correct an image formation defect caused by the defective recording element.

In order to correct an image formation defect in any one defective recording element, the output of one or a plurality of recording elements which carry out recording of pixels in the vicinity of a defective recording element is corrected, but the range of recording elements which are the object of this output correction (the defective recording correction recording elements) desirably include at least two recording elements which carry out image formation at recording positions (pixels) that are adjacent on either side of the non-recording position of the defective recording element.

Desirably, an image of a plurality of the measurement patches is formed by altering the candidate value.

By forming a plurality of measurement patches in which the defective recording element correction parameter is varied in a stepwise fashion and comparing these measurement patches with the reference patch, it is possible to select an optimum parameter.

Desirably, the reference patch included in the chart is disposed in a central portion of a patch arrangement in which a plurality of the measurement patches for comparison with the reference patch are arranged.

According to this aspect of the invention, it is possible to achieve parameter measurement which is highly robust with respect to skew, such as relative skew (an in-plane angle of rotation) between the recording head and the recording medium during formation of the chart image, or relative skew between the recording medium and the optical reading device during reading of the chart.

Desirably, the candidate value of the defective recording element correction parameter which is applied to the at least one measurement patch changes continuously in the at least one measurement patch.

It is also possible to adopt a mode in which the defective recording element correction parameter value used changes continuously within one measurement patch.

Desirably, a plurality of combinations of the reference patch and the at least one measurement patch of a same tone are formed for each tone.

A desirable mode is one where a reference patch and a measurement patch(s) are formed respectively for each of a plurality of tones. According to this mode, it is possible to determine a suitable defective recording element correction parameter for each tone.

Desirably, the recording head includes a plurality of head modules; and the reference patch and the at least one measurement patch are formed by each head module.

According to this mode, it is possible to determine a suitable defective recording element correction parameter for each head module.

In order to attain an object described above, another aspect of the present invention is directed to a defective recording element correction parameter determination method comprising: a chart reading step of reading the defective recording element correction parameter selection chart as defined in any one of the above aspects, with an optical reading device; and an optimal value determination processing step of determining an optimal value of the defective recording element correction parameter according to data of a captured image which is acquired with the optical reading device in the chart reading step.

A desirable mode is one where an optimal value of the defective recording element correction parameter is specified automatically by analyzing the read image data obtained by reading the defective recording element correction parameter selection chart.

Desirably, the optimal value determination processing step includes an evaluation value calculation step of calculating an evaluation value which forms an evaluation index for evaluating a difference between the captured image of the reference patch and the captured image of the at least one measurement patch; and in the optimal value determination processing step, the optimal value of the defective recording element correction parameter is determined according to the evaluation value.

Desirably, differential information between the captured image of the reference patch and the captured image of the at least one measurement patch, or correlation information between the captured image of the reference patch and the captured image of the at least one measurement patch, is calculated in the evaluation value calculation step.

In calculating the evaluation index, there is, for example, a mode which uses the differential data between the captured image of the reference patch and the captured image of the measurement patch, or a mode which calculates a correction coefficient between both the captured images.

Desirably, the defective recording element correction parameter determination method comprises an integration profile generation step of calculating integration profiles respectively for the captured image of the reference patch and the captured image of the at least one measurement patch, wherein the evaluation value is determined by comparing the integration profiles of the captured image of the reference patch and the captured image of the at least one measurement patch.

By integrating the components of the captured images of the reference patch and the measurement patch (two-dimensional image data), and comparing the respective integration profiles (one-dimensional data) with each other, it is possible to reduce the calculation load.

Desirably, a smoothing processing is applied to the respective captured images of the reference patch and the at least one measurement patch.

According to this aspect, it is possible to reduce the calculation load.

Desirably, the defective recording element correction parameter determination method comprises a differential data generation step of generating differential data which expresses difference between the captured image of the reference patch and the captured image of the at least one measurement patch, from the captured image of the reference patch and the captured image of the at least one measurement patch, wherein a smoothing processing is applied to the differential data.

It is possible to apply a smoothing processing to the captured image of the reference patch and the captured image of the measurement patch, and then generate differential data between the captured images, and it is also possible to generate differential data between the captured images before a smoothing processing, and to then apply a smoothing processing to the differential data.

Desirably, a visual transfer function is used as the smoothing processing.

According to this mode, it is possible to select an optimal value which matches human visual characteristics.

Desirably, differential data which expresses difference between a captured image of the reference patch and a captured image of the at least one measurement patch, is generated from the captured image of the reference patch and the captured image of the at least one measurement patch; and the optimal value of the defective recording element correction parameter is determined by defining a sum of squares of components of the differential data or a square root of the sum of the squares, as the evaluation index.

It is possible to use the sum of the squares of the components of the differential data, or the square root of the sum of the squares, as the evaluation index.

Desirably, differential data which expresses difference between the captured image of the reference patch and the captured image of the at least one measurement patch, is generated from the captured image of the reference patch and the captured image of the at least one measurement patch; and the optimal value of the defective recording element correction parameter is determined by defining a variance value of components of the differential data or a maximum value of components of the differential data, as the evaluation index.

It is possible to use the variance value or the maximum value of the components of the differential data, as the evaluation index.

Desirably, determination of the optimal value is made by adopting a value of the defective recording element correction parameter at a point of intersection of two regression lines derived from plot points of the evaluation value on a graph based on a coordinates system where a first axis represents the defective recording element correction parameter which is used as the candidate value applied to the at least one measurement patch, or a value calculated from this defective recording element correction parameter, and a second axis represents the evaluation index.

According to this mode, it is possible to avoid the effects of noise and determine an optimal value of the defective recording element correction parameter with even greater accuracy.

Desirably, determination of the optimal value is made by adopting a value of the defective recording element correction parameter corresponding to a minimum value or a maximum value of the evaluation index on a graph based on a coordinates system where a first axis represents the defective recording element correction parameter which is used as the candidate value applied to the at least one measurement patch, or a value calculated from this defective recording element correction parameter, and a second axis represents the evaluation index.

By determining the minimum value or maximum value from a graph interpolated from the discrete measurement data, it is possible to determine an optimal value of the defective recording element correction parameter with even greater accuracy.

Desirably, determination of the optimal value is made by adopting a value of the defective recording element correction parameter at which a second order differential value is a minimum value or a maximum value on a graph based on a coordinates system where a first axis represents the defective recording element correction parameter which is used as the candidate value applied to the at least one measurement patch, or a value calculated from this defective recording element correction parameter, and a second axis represents the evaluation index.

According to this aspect of the invention, it is possible to determine an optimal value of the defective recording element correction parameter with high accuracy, similarly to the above aspect.

Desirably, the value calculated from the defective recording element correction parameter is a value proportional to a droplet ejection rate of the recording element which carries out the recording in the vicinity of the non-recording position of the one or more of the recording elements which have been set to be in a non-recording state.

According to this aspect of the invention, in particular, the optimal parameter selection accuracy can be improved in the shadows (high-density portions) and the highlights (low-density portions).

In order to attain an object described above, another aspect of the present invention is directed to a defective recording element correction parameter determination method comprising the step of re-creating the defective recording element correction parameter selection chart by further reducing a step size of the candidate value of the defective recording element correction parameter applied to the at least one measurement patch according to the optimal value determined by the defective recording element correction parameter determination method as defined in any one of the above aspects, and selecting a further optimal value by applying the defective recording element correction parameter determination method as defined in any one of the above aspects to the re-created chart.

By applying the defective recording element correction parameter selection method according to any one of the above aspects repeatedly, a plurality of times, it is possible to achieve a processing mode which gradually narrows down the optimal value.

According to this aspect of the invention, it is possible to determine an optimal value for the defective recording element correction parameter with even higher accuracy, in a relatively short time.

Desirably, a skew correction processing is applied to the captured image which is acquired in the chart reading step.

By carrying out rotation processing, or the like, for correcting skew in the captured image, it is possible to measure the parameter with even greater accuracy.

A device which analyzes the read image data of the chart in the defective recording element correction parameter determination method according to the above aspects can be achieved by a computer. The program for achieving this analytical function by means of a computer can be applied to an operational program of a central processing unit (CPU) which is incorporated in a printer, or the like, and can also be applied to a computer system, such as a personal computer. The analytical processing program of this kind can be recorded on a CD-ROM, a magnetic disk, or another information storage medium (external storage apparatus), and the program can be provided to a third party by means of this information recording medium, or a download service for the program can be provided via communications lines, such as the Internet, or the program can be provided as a service of an ASP (Application Service Provider).

Desirably, an in-line scanner mounted on the image forming apparatus is used as the optical reading device.

According to this aspect of the invention, it is possible to output a chart and read the output results in one image forming apparatus, and efficient analysis and acquisition of a defective recording element correction parameter based on this analysis are possible.

Desirably, the plurality of recording elements eject droplets from nozzles and deposit the ejected droplets onto the recording medium so as to perform the image formation on the recording medium; the defective recording element correction parameter determination method comprises a landing-interference-pattern-specific test chart forming step of performing an ejection disabling process of artificially disabling ejection in different recording elements corresponding to difference of a plurality of types of landing interference patterns on a basis of correspondence information indicating correspondence relationship between the plurality of types of landing interference patterns and the plurality of recording elements, the plurality of types of landing interference patterns being defined to correspond to landing interference inducing factors which include a deposition sequence of the droplets on the recording medium that is governed by an arrangement configuration of the plurality of recording elements of the recording head and the direction of the relative movement, and forming a plurality of types of test charts corresponding to the plurality of types of landing interference patterns respectively; and the defective recording element correction parameters for ejection failure correction are determined respectively for the plurality of types of landing interference patterns, according to output results of the plurality of types of test charts formed for the plurality of types of landing interference patterns respectively.

According to this aspect of the invention, it is possible to determine a defective recording element correction parameter which takes account of the effects of landing interference on the recording medium of the droplets which are ejected by other nozzles surrounding an ejection failure nozzle.

Furthermore, by using this parameter to carry out ejection failure correction, the correction performance is improved yet further.

The depositing position interval on the recording medium between droplets which are ejected from two nozzles (a pair of adjacent nozzles) that are adjacent on either side of a non-ejectable position of an ejection failure nozzle varies due to the effects of landing interference with droplets which are ejected from other nozzles. Consequently, a desirable mode is one where a "landing interference pattern" is specified in view of the amount of change in the depositing position interval caused by this landing interference. The presence or absence of landing interference and the circumstances of landing interference depend on the droplet ejection sequence of the other nozzles which are peripheral to the ejection failure nozzle.

Moreover, the landing interference inducing factors include, aside from the droplet ejection sequence, the dot diameter (a value which correlates to the volume of the ejection droplets) and the ejection position errors (depositing position errors) of the respective nozzles, and the like. A desirable mode is one where the correction parameter is specified by also taking account of these factors.

In order to attain an object described above, another aspect of the present invention is directed to a defective recording element correction parameter determination apparatus comprising: an optical reading device which reads the defective recording element correction parameter selection chart as defined in any one of the above aspects and generates captured image data; and an optimal value determination processing device which carries out a signal processing for determining an optimal value of the defective recording element correction parameter according to the captured image data acquired via the optical reading device.

In the defective recording element correction parameter determination apparatus, it is possible to combine the characteristics stated above. A defective recording element correction parameter determination apparatus comprising a processing device which executes processing of each step of the above-mentioned method inventions can be provided.

In order to attain an object described above, another aspect of the present invention is directed to an image forming apparatus comprising: a recording head having a plurality of recording elements; and a conveyance device which conveys at least one of the recording head and a recording medium so as to cause relative movement between the recording head and the recording medium, wherein the image forming apparatus forms an image on the recording medium by the plurality of recording elements while causing the relative movement between the recording head and the recording medium, the image forming apparatus further comprising: a chart output control device which controls image formation to output the defective recording element correction parameter selection chart as defined in any one of above aspects; a defective recording element correction parameter storage device which stores the defective recording element correction parameter determined according to output results of the defective recording element correction parameter selection chart; a defective recording element position information acquisition device which acquires defective recording element position information indicating a position of a defective recording element that cannot be used for the image formation, of the plurality of recording elements of the recording head; and a defective recording element correction device which applies the defective recording element correction parameter according to the defective recording element position information in such a manner that an image formation defect caused by the defective recording element is corrected by the image formation by a recording element other than the defective recording element.

It is also possible to adopt a mode where a defective recording element correction parameter determination apparatus according to the above aspect is mounted in the image forming apparatus.

Desirably, the image forming apparatus further comprises an in-line scanner as an optical reading device which reads the defective recording element correction parameter selection chart and generates captured image data.

Desirably, the plurality of recording elements eject droplets from nozzles and deposit the ejected droplets onto the recording medium so as to perform the image formation on the recording medium; the image forming apparatus comprises a landing-interference-pattern-specific test chart forming device which performs an ejection disabling process of artificially disabling ejection in different recording elements corresponding to difference of a plurality of types of landing interference patterns on a basis of correspondence information indicating correspondence relationship between the plurality of types of landing interference patterns and the plurality of recording elements, the plurality of types of landing interference patterns being defined to correspond to landing interference inducing factors which include a deposition sequence of the droplets on the recording medium that is governed by an arrangement configuration of the plurality of recording elements of the recording head and the direction of the relative movement, and forms a plurality of types of test charts corresponding to the plurality of types of landing interference patterns respectively; and the defective recording element correction parameters for ejection failure correction are determined respectively for the plurality of types of landing interference patterns, according to output results of the plurality of types of test charts formed for the plurality of types of landing interference patterns respectively, and the defective recording element correction parameters for ejection failure correction determined respectively for the plurality of types of landing interference patterns are stored in the defective recording element correction parameter storage device.

According to the present invention, it is possible to measure a defective recording element correction parameter with high accuracy, compared to a conventional method. By this means, the correction performance in respect of an image formation defect caused by a defective recording element is improved, and improvements in output image quality can be achieved.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

Figures 3A, 3B, 3C, 3D:
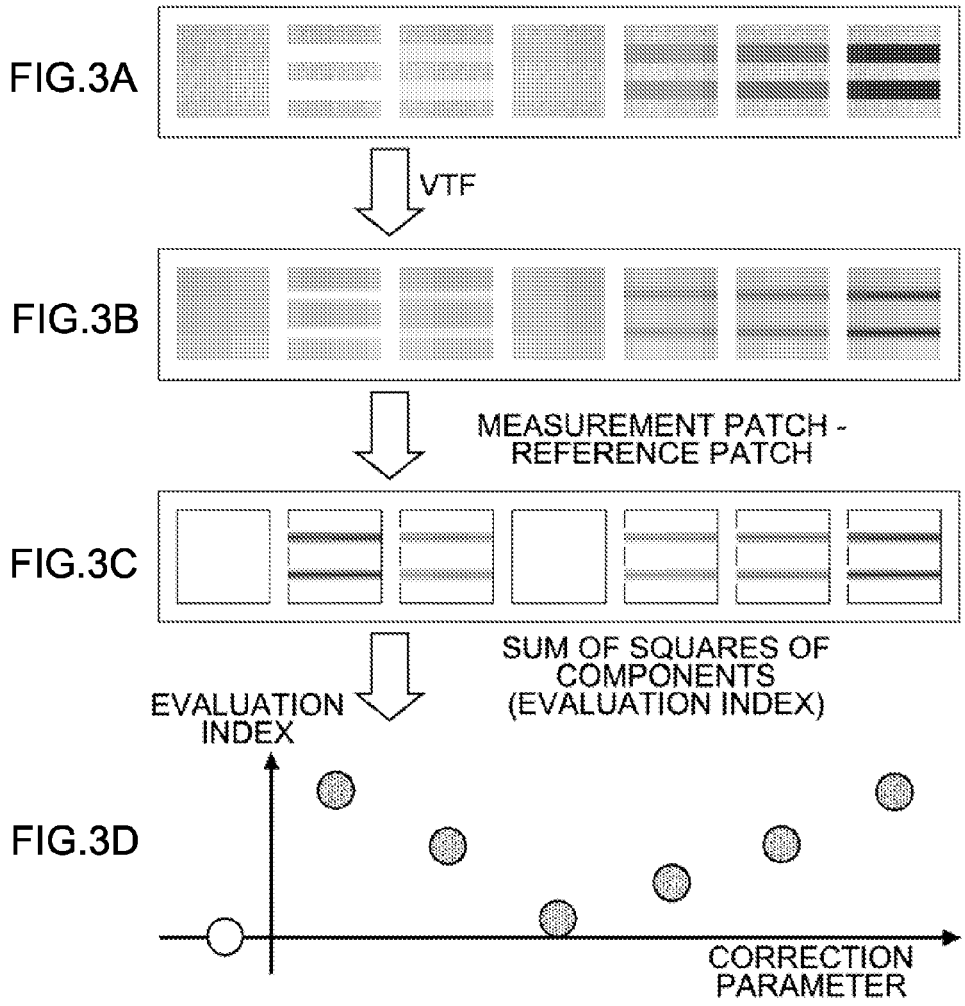
Figure 4:
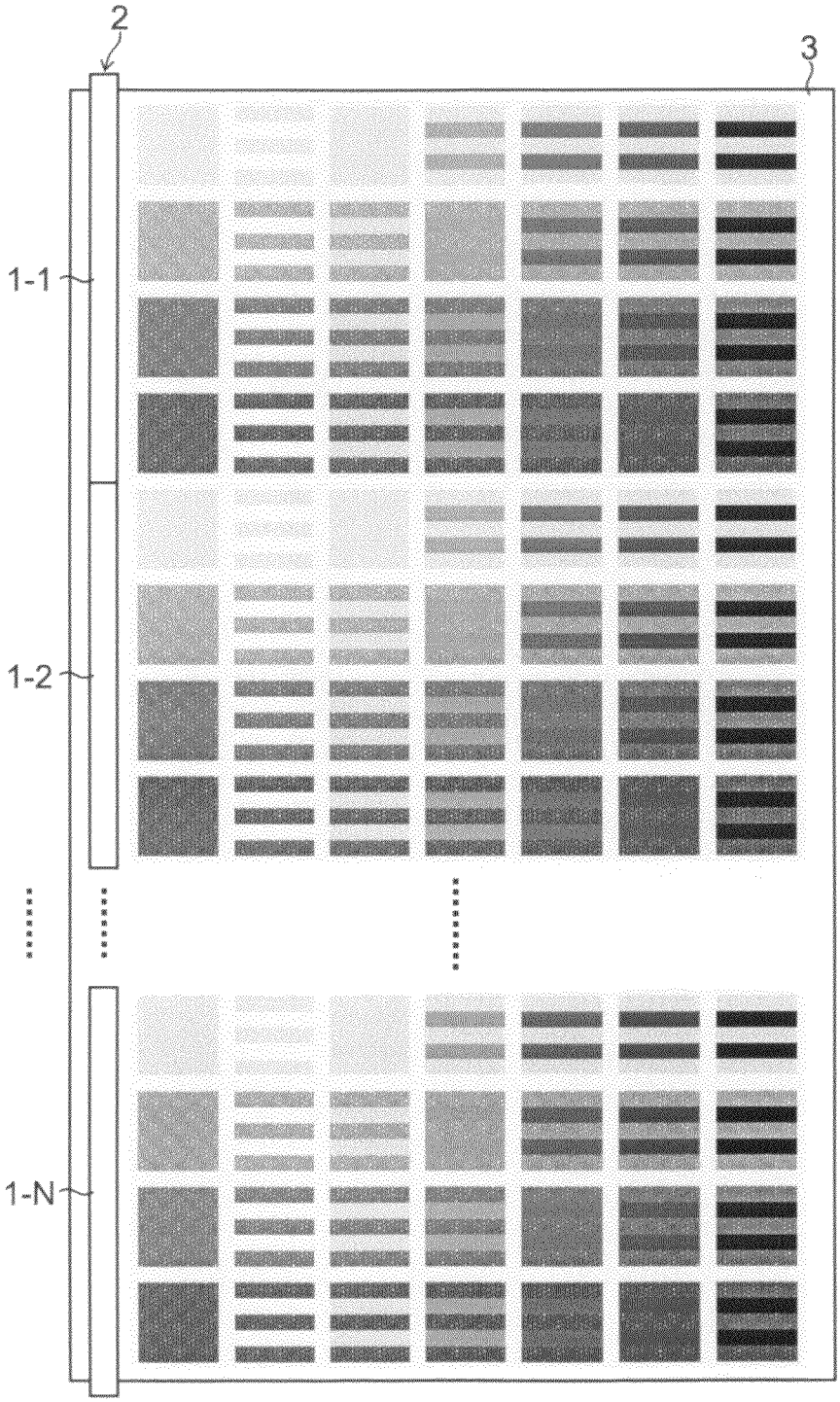
Figure 5:
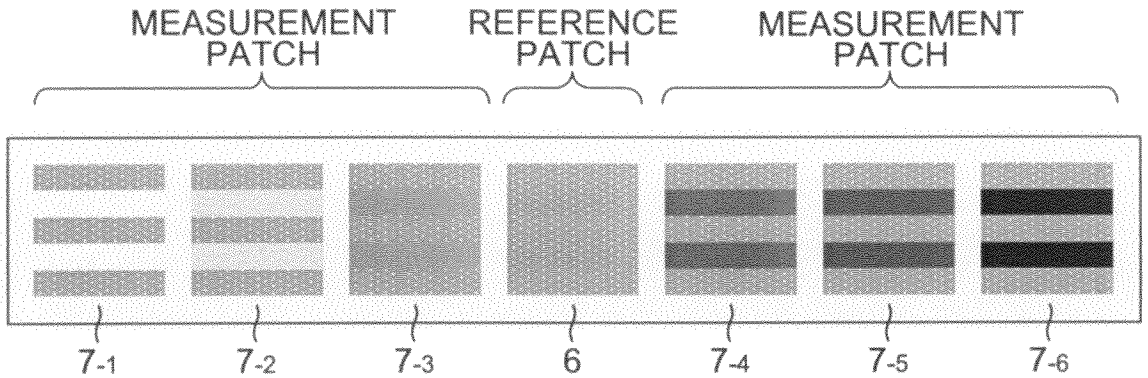
Figure 6A:
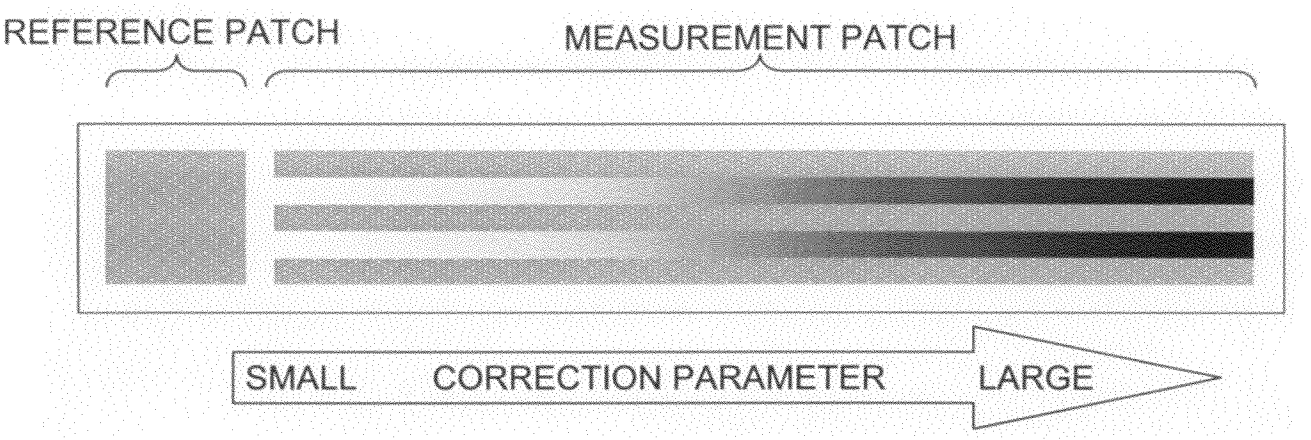
Figure 6B:
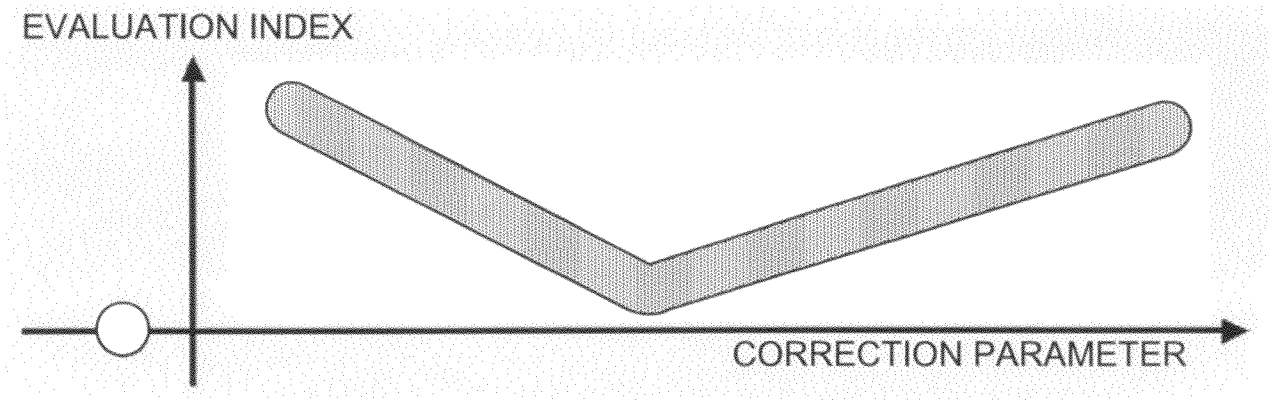
Figure 8:
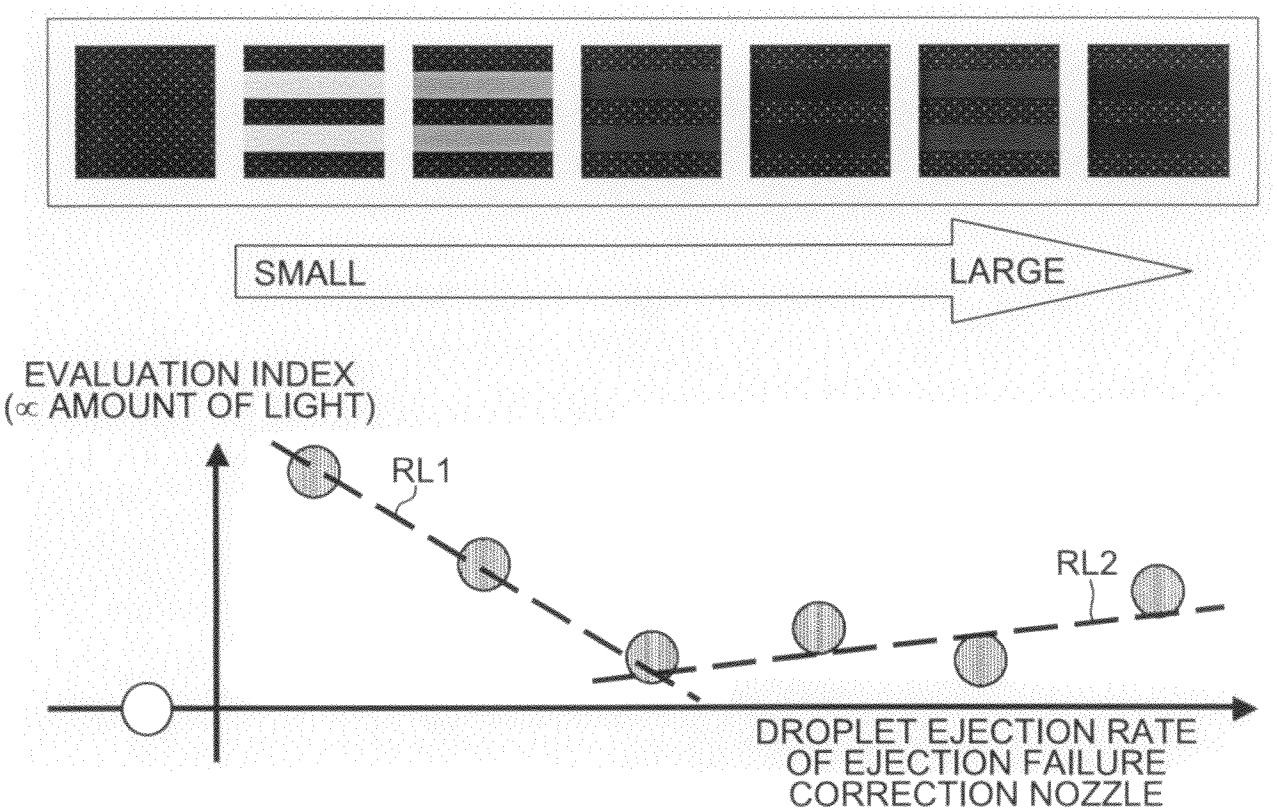
Figure 9:
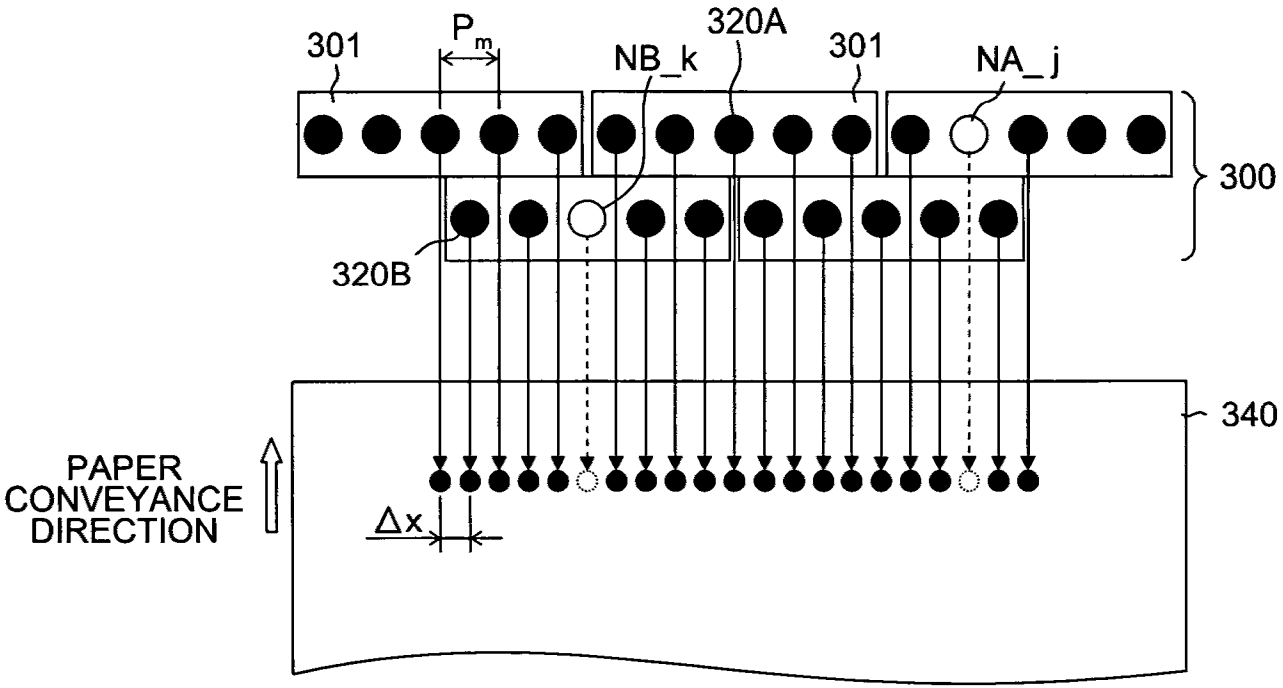
Figure 10:
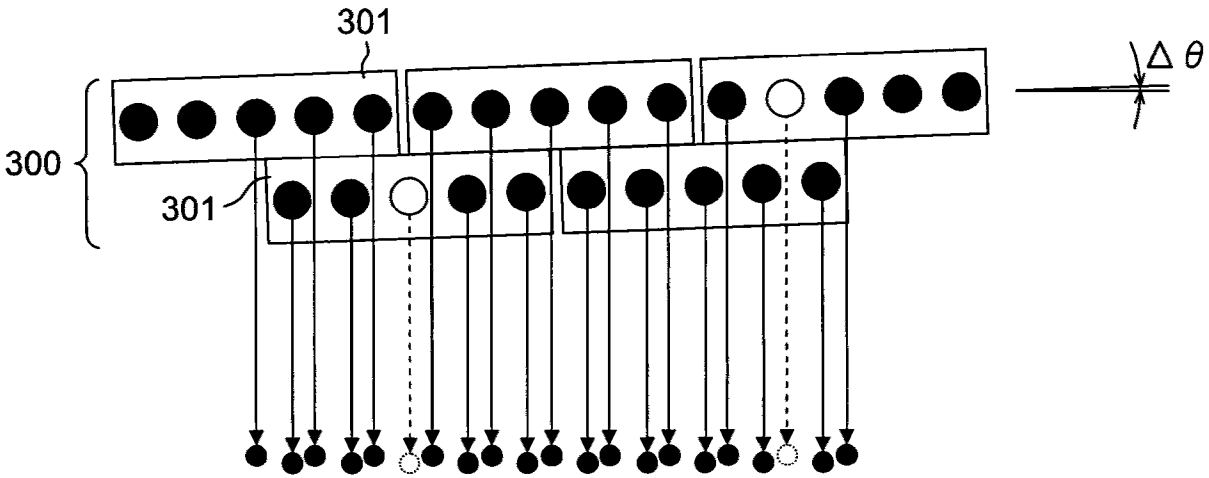
Figure 11:
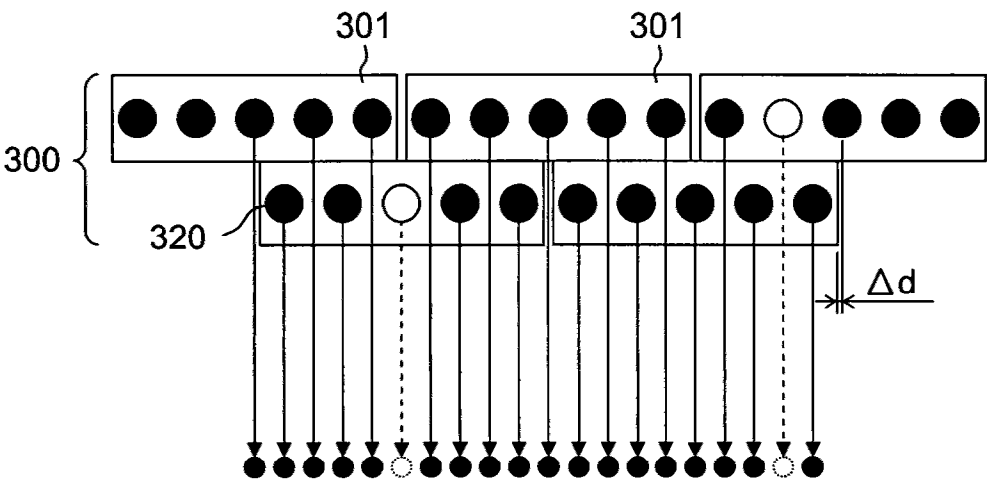
Figure 12A:
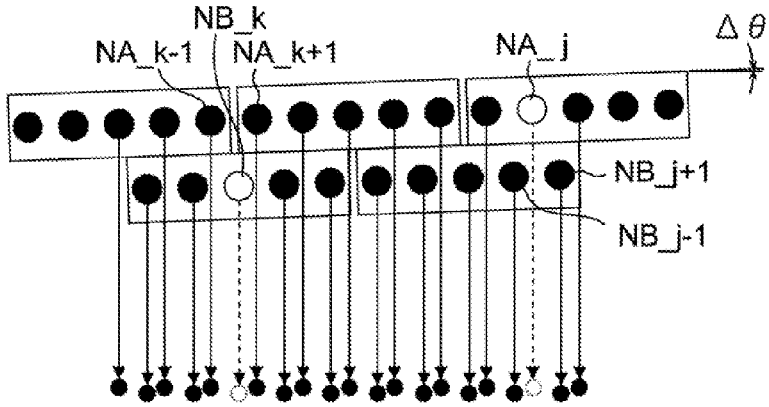
Figure 12B:
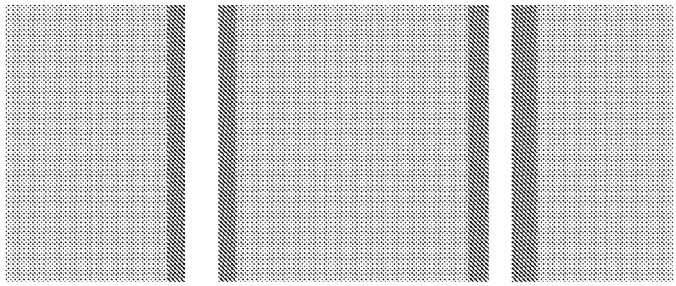
Figure 12C:
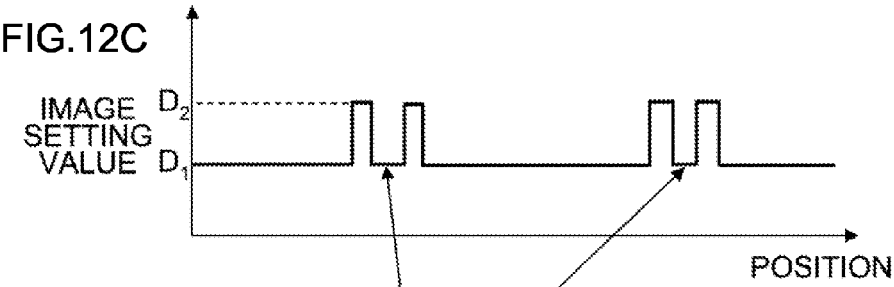
Figure 12D:
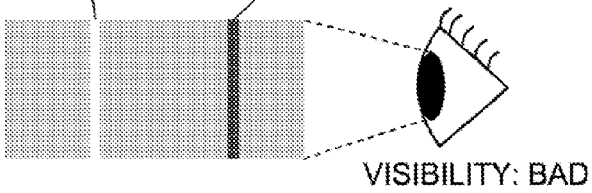
Figure 13A:
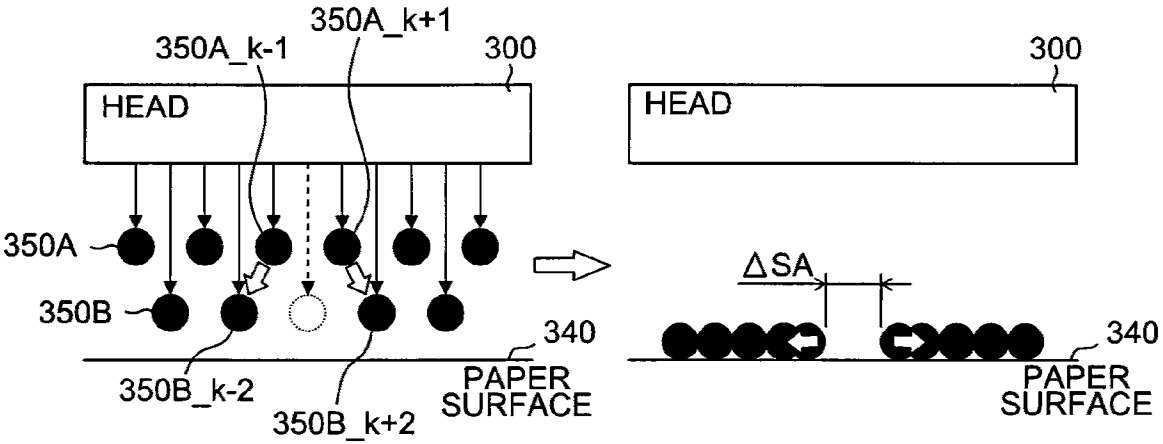
Figure 13B:
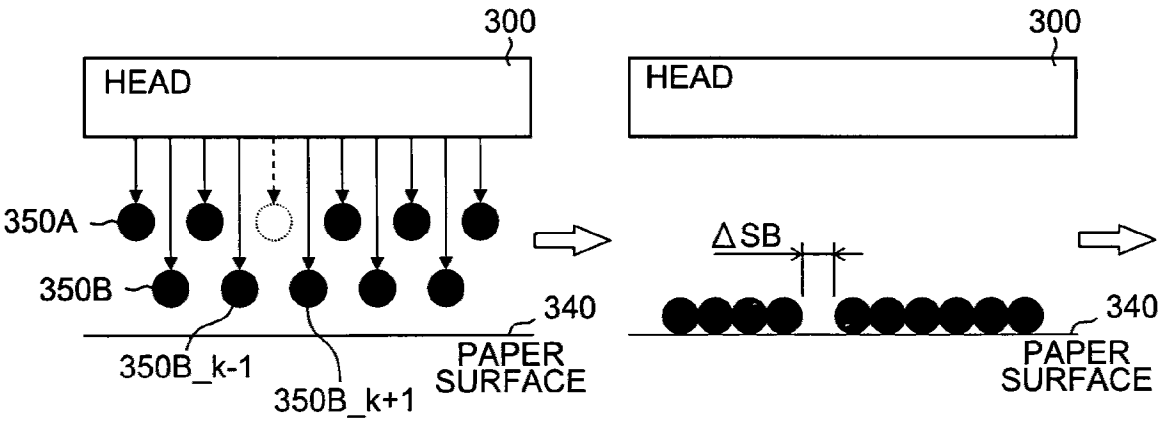
Figure 14:
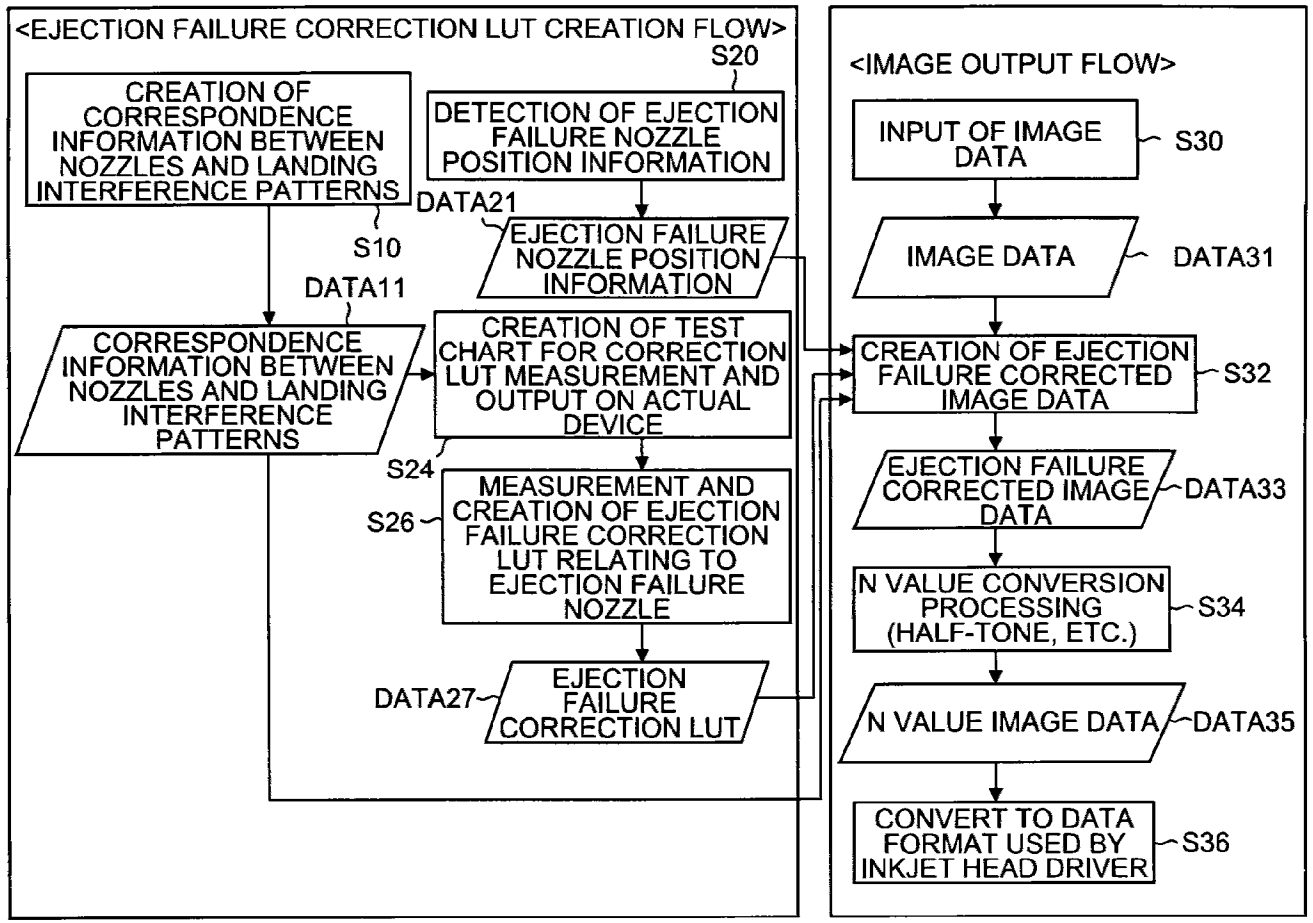
Figure 15:
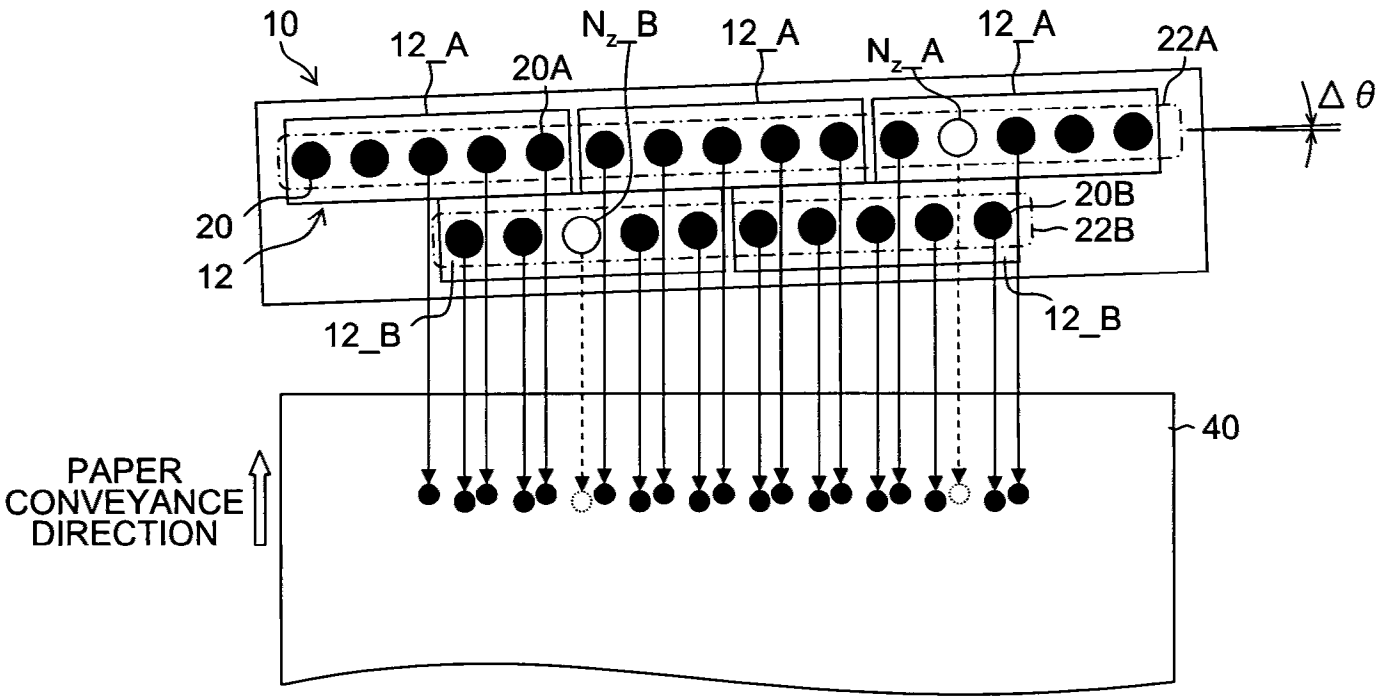
Figure 16:
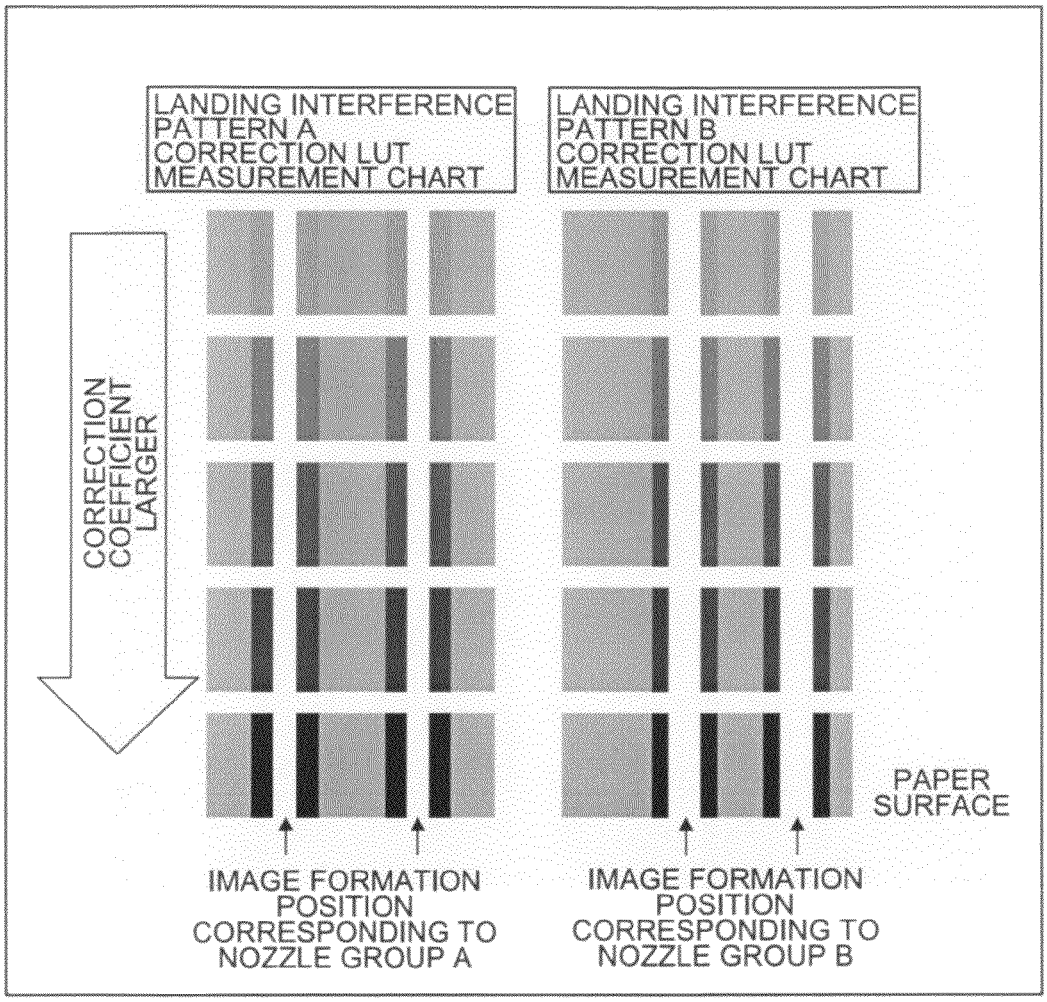
Figure 17A:
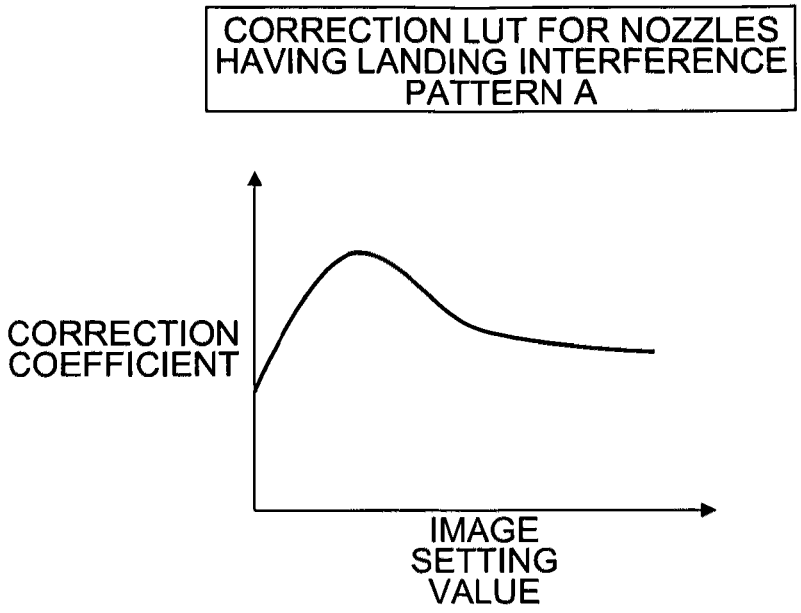
Figure 17B:
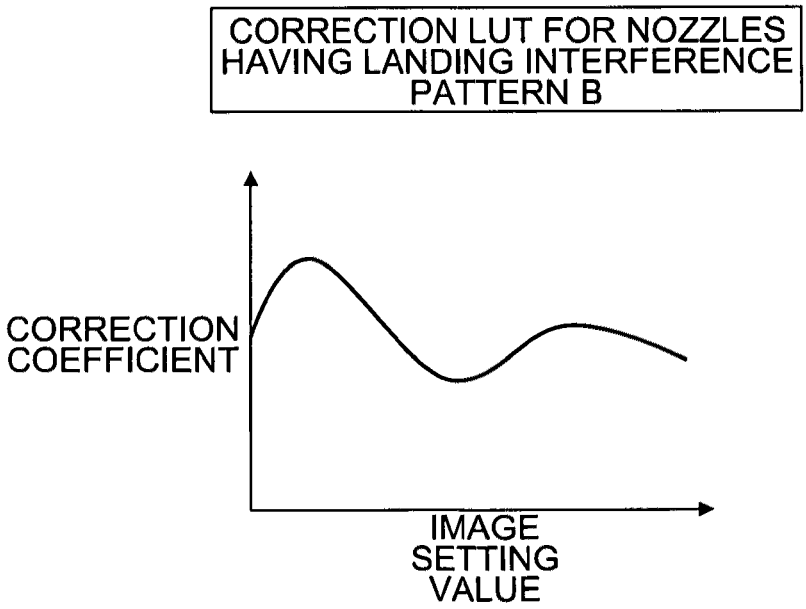
Figure 18A:
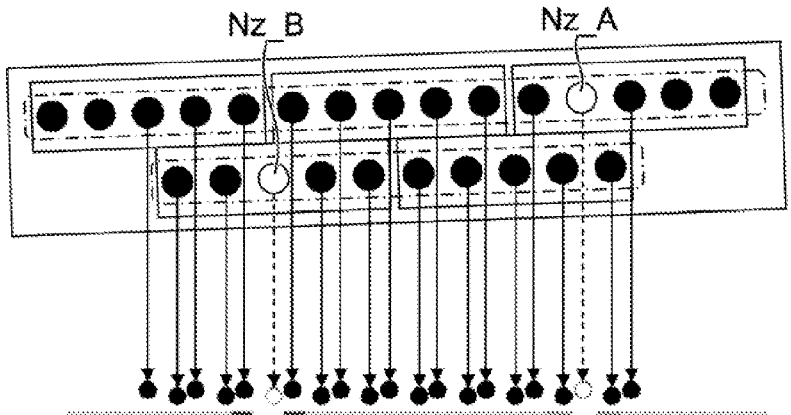
Figure 18B:
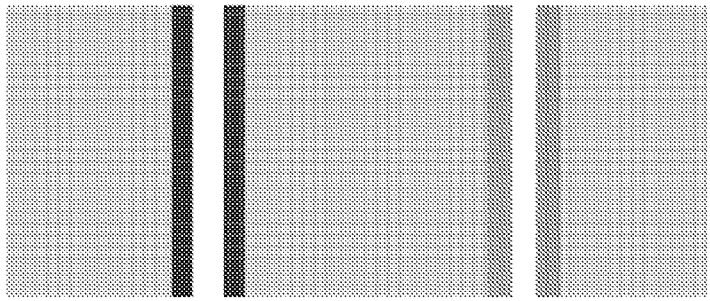
Figure 18C:
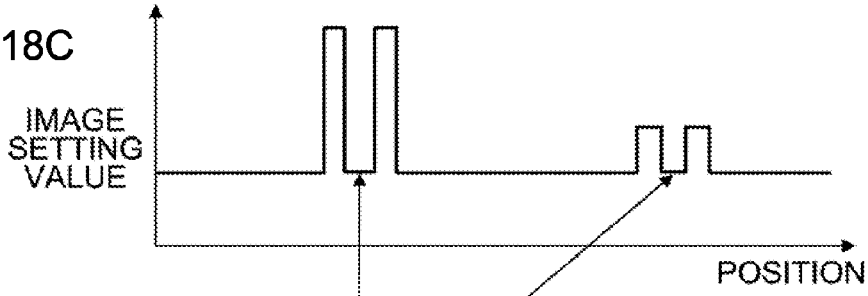
Figure 18D:
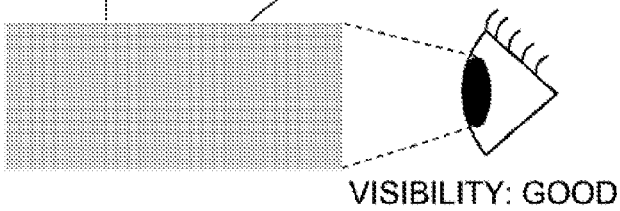
Figure 19:
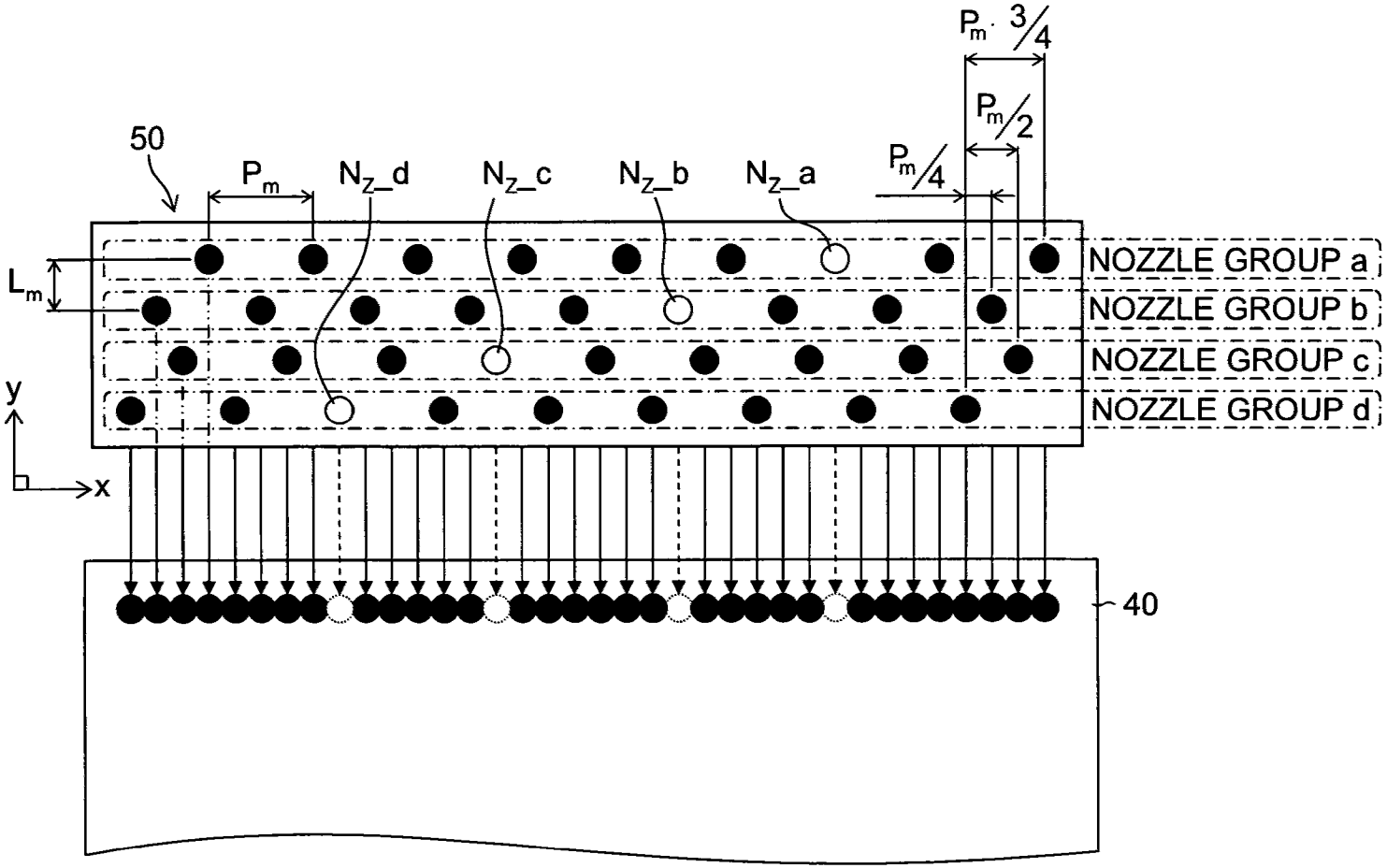
Figure 20A:
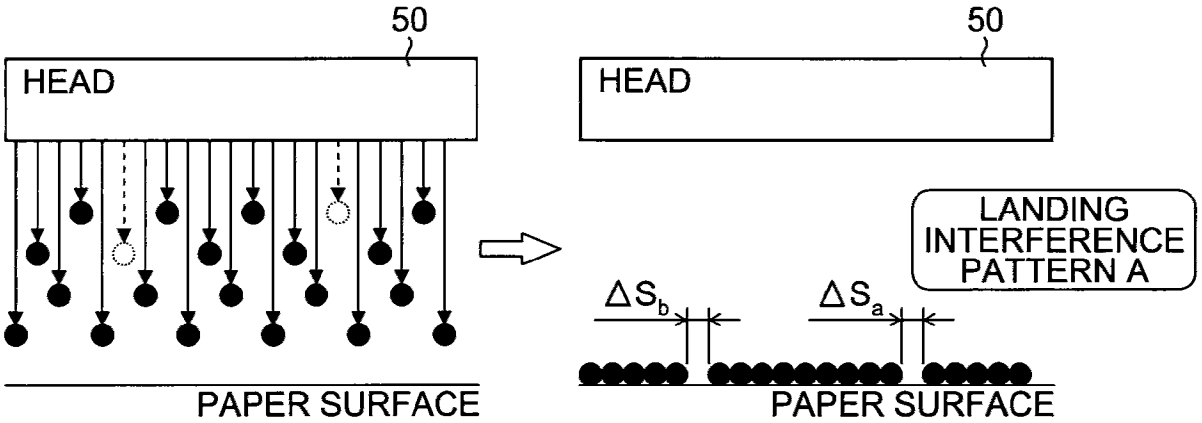
Figure 20B:
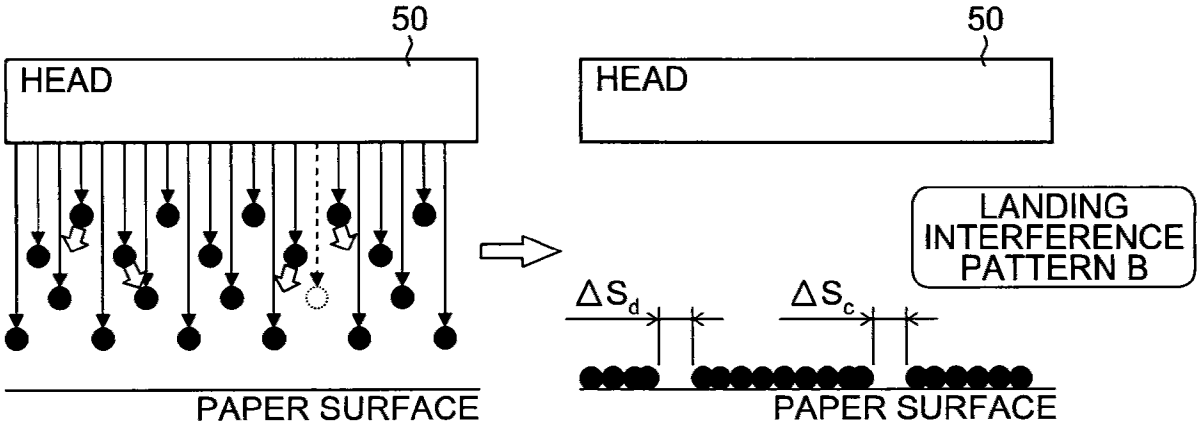
Figure 21:
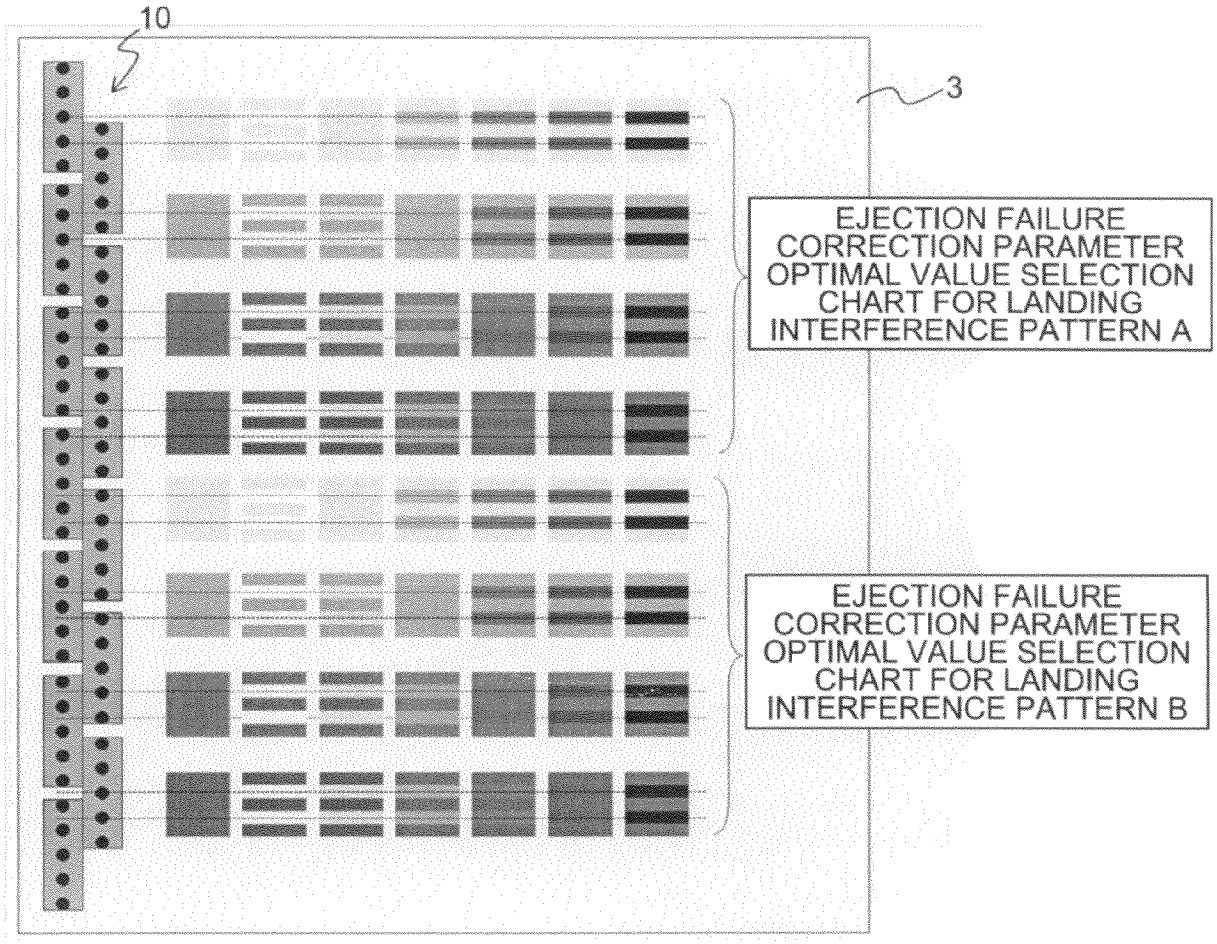
Figure 22:
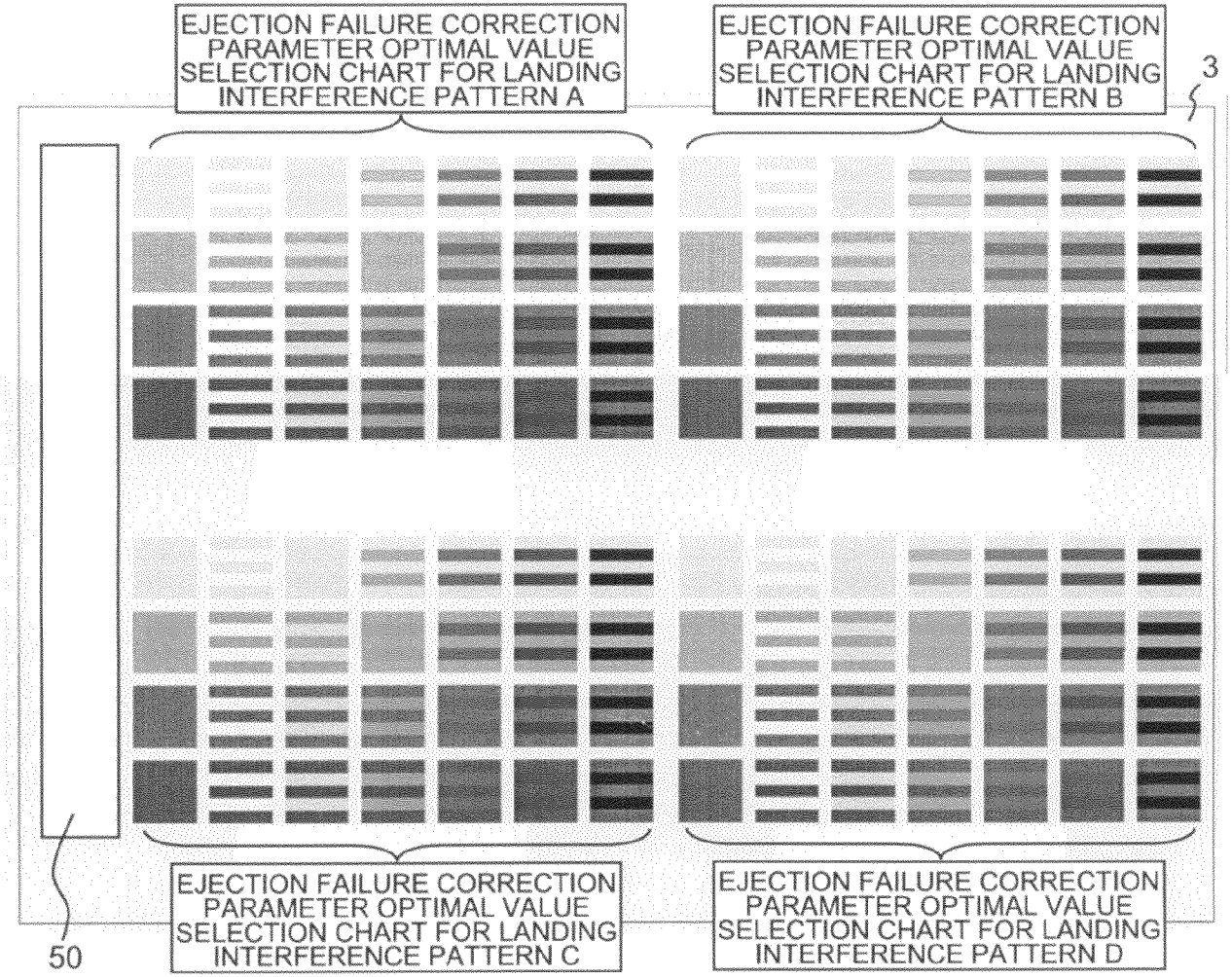
Figure 23:
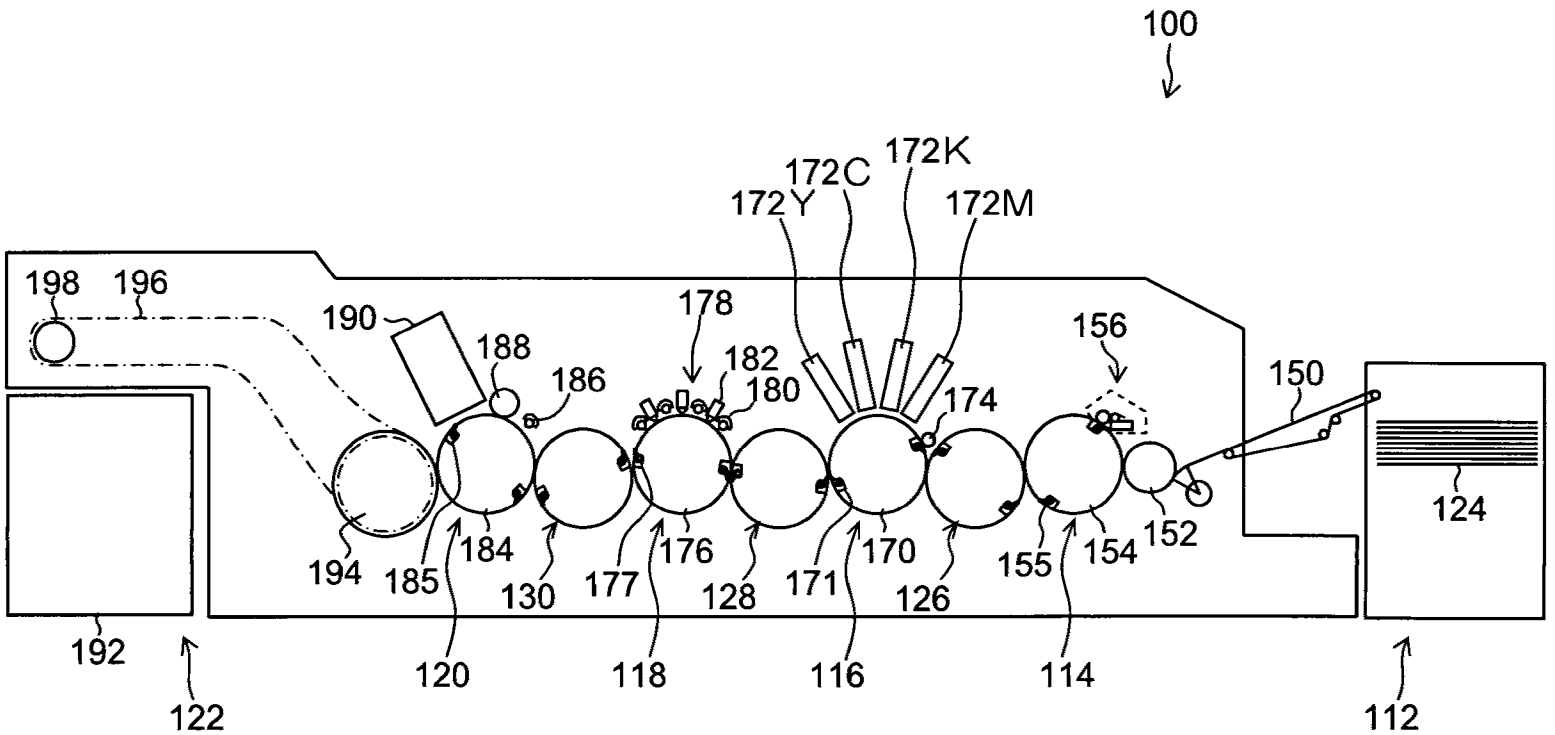
Figure 24A:
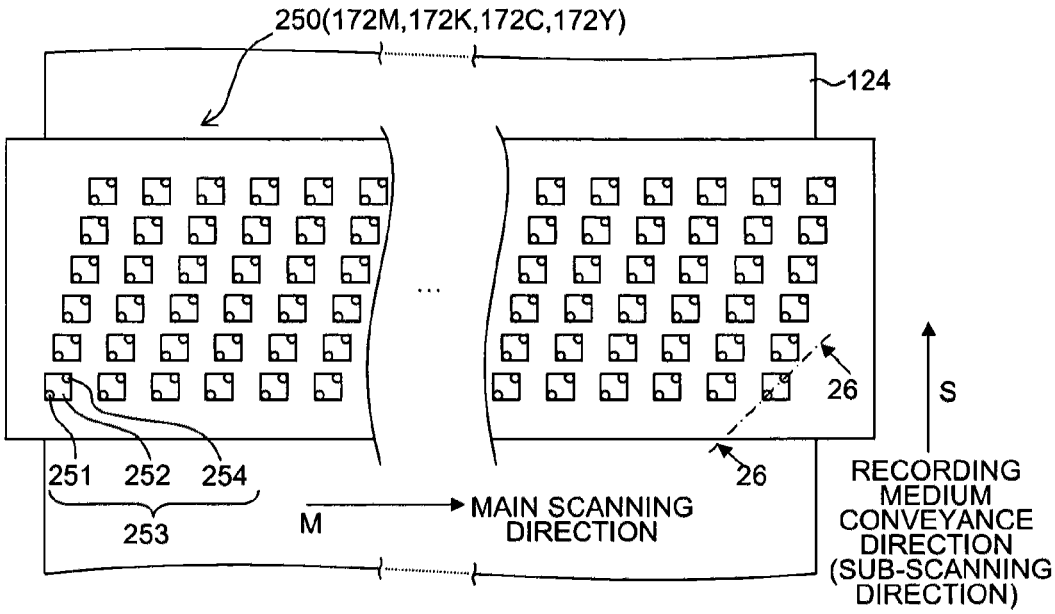
Figure 24B:
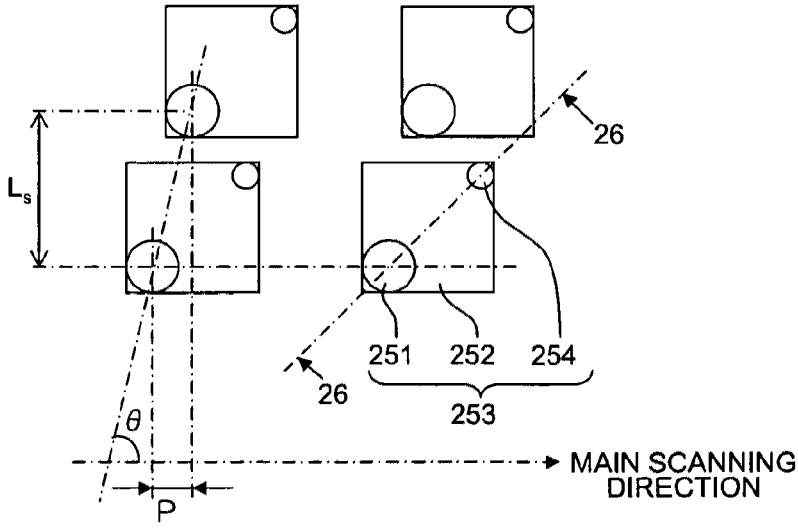
Figure 25A:
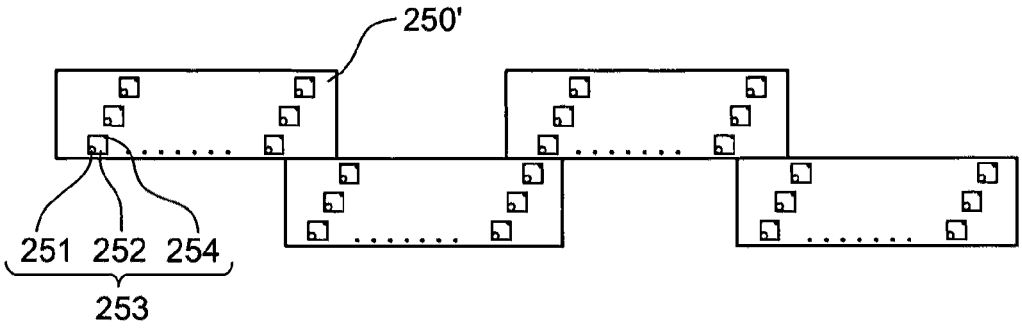
Figure 25B:
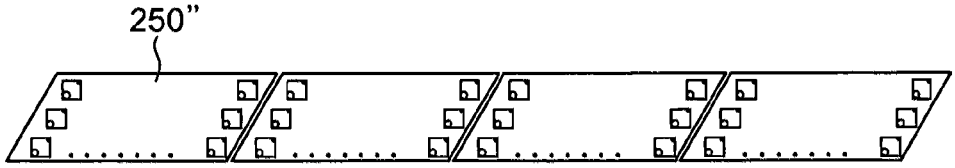
Figure 26:
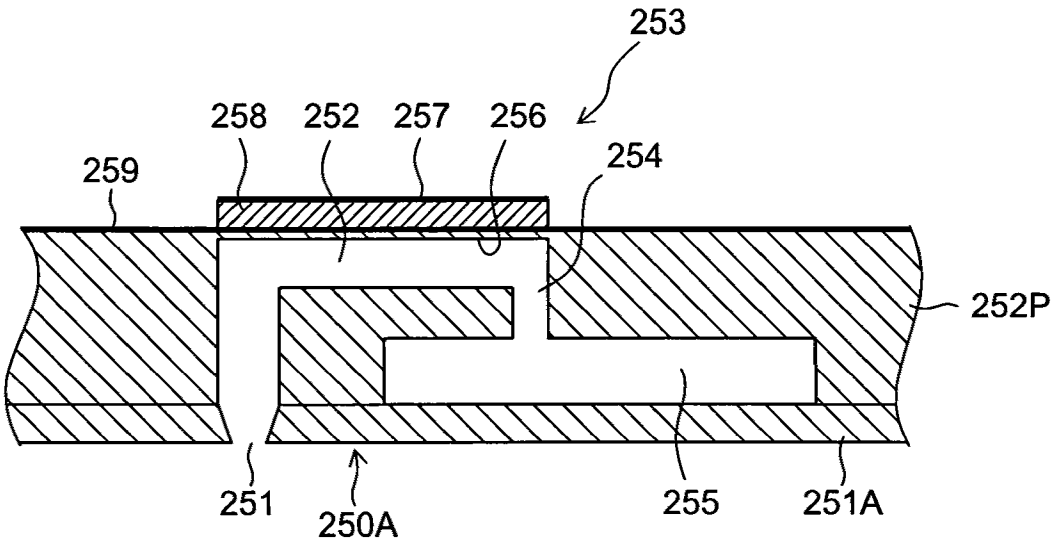
Figure 27:
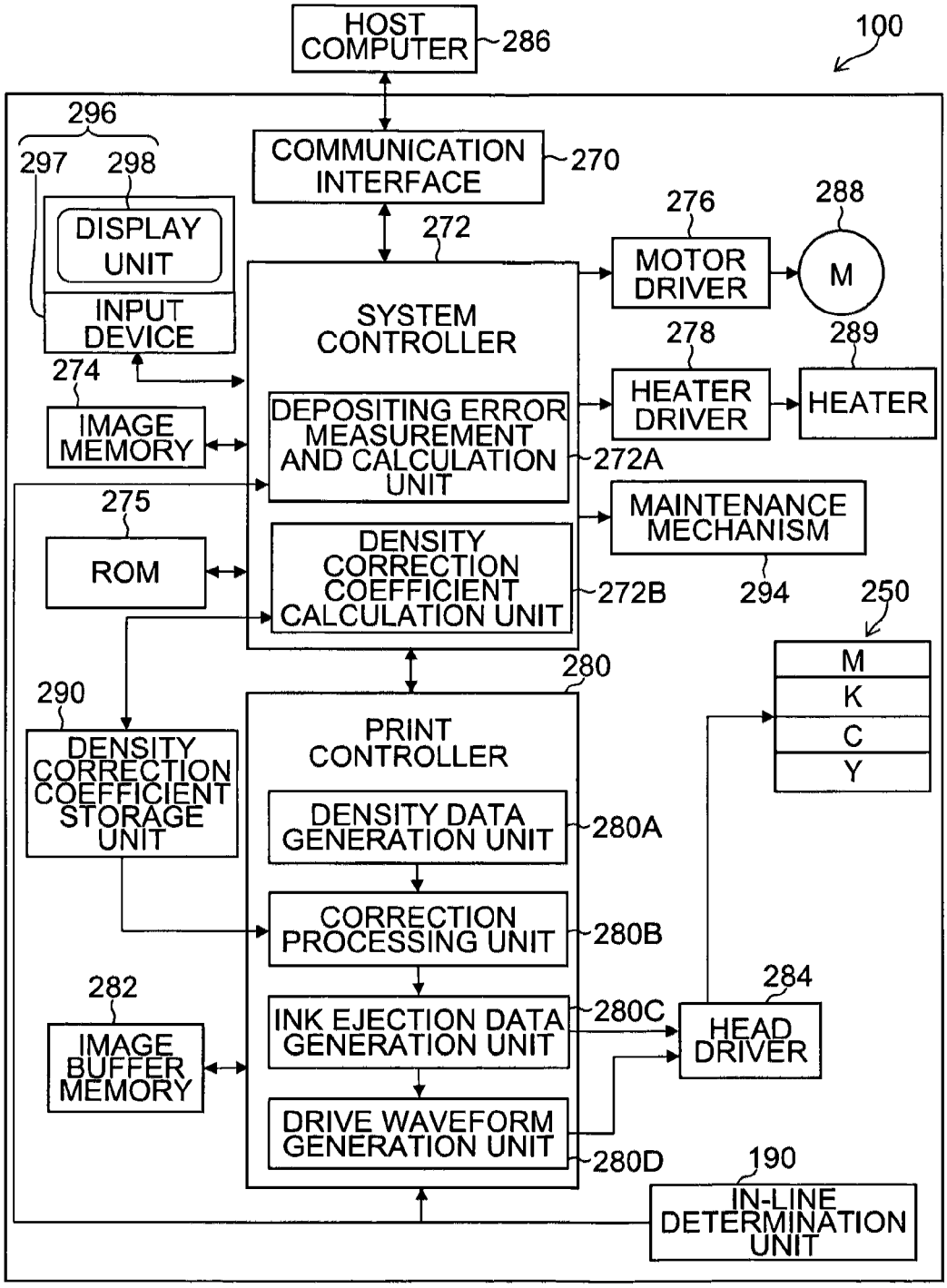
Figure 28:
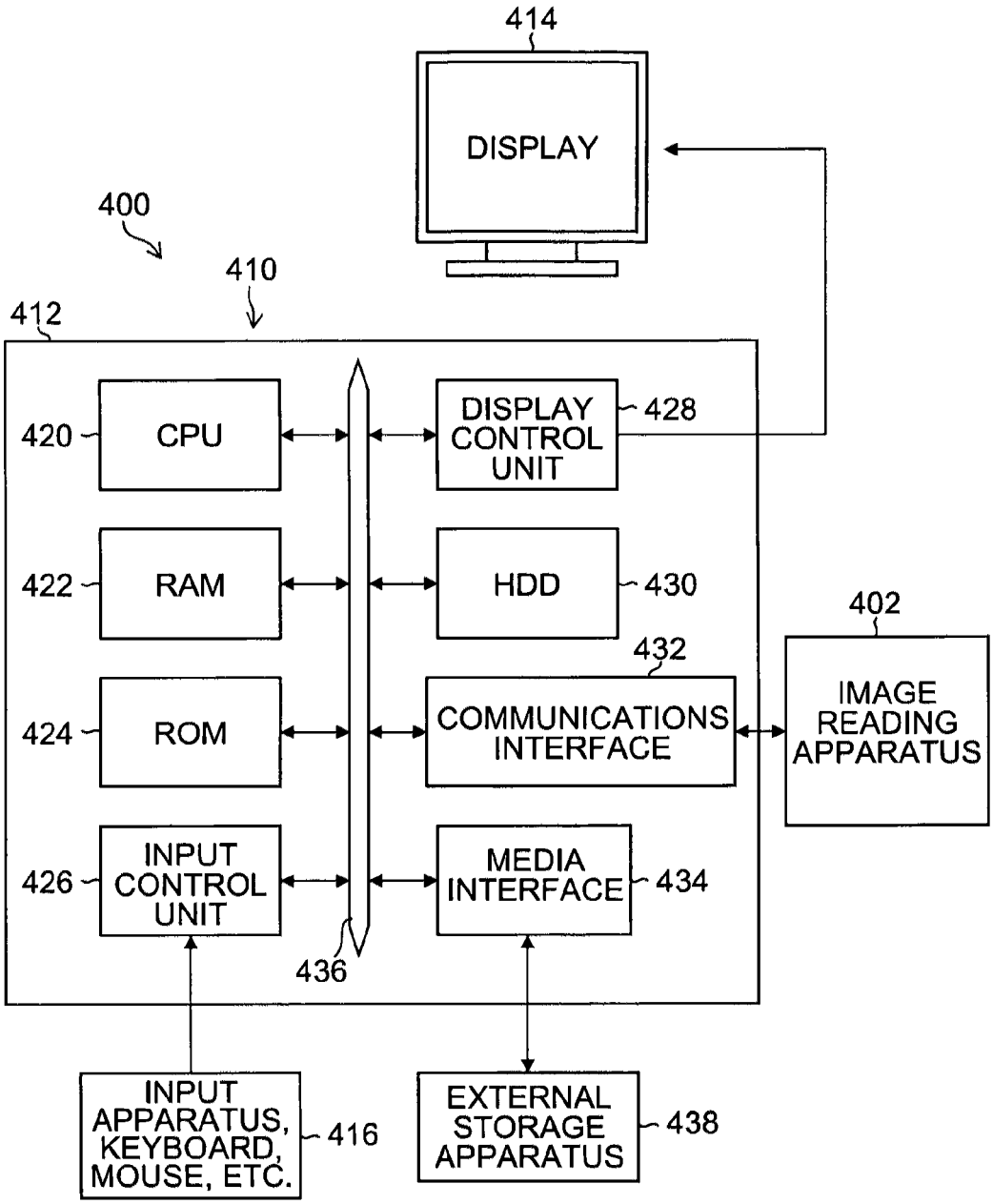
Figure 29:
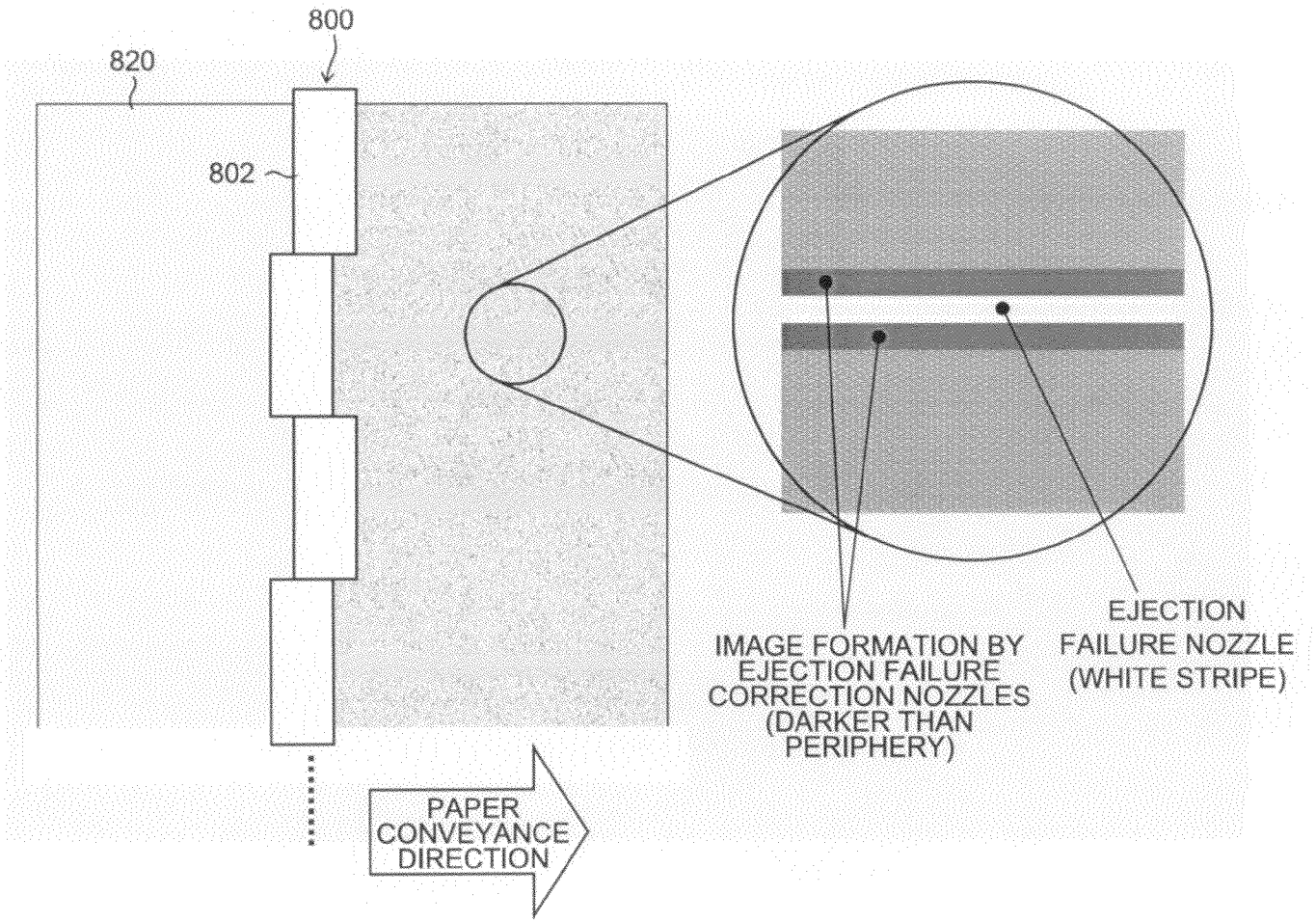
FIG.29 RELATED ART
Figure 30:
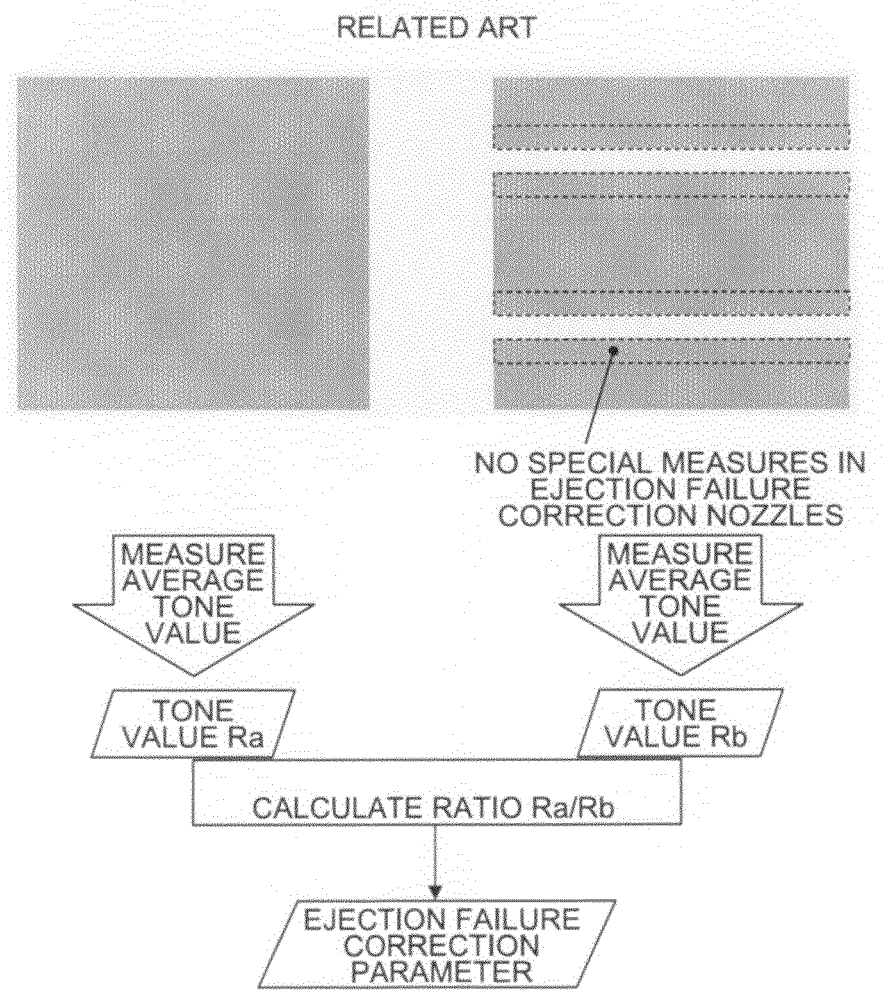
Figure 31A:
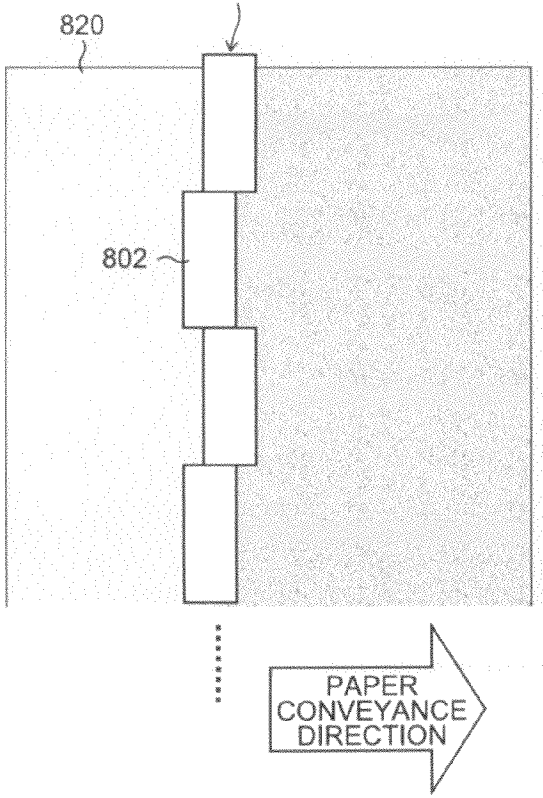
FIG.31A RELATED ART
Figure 31B:
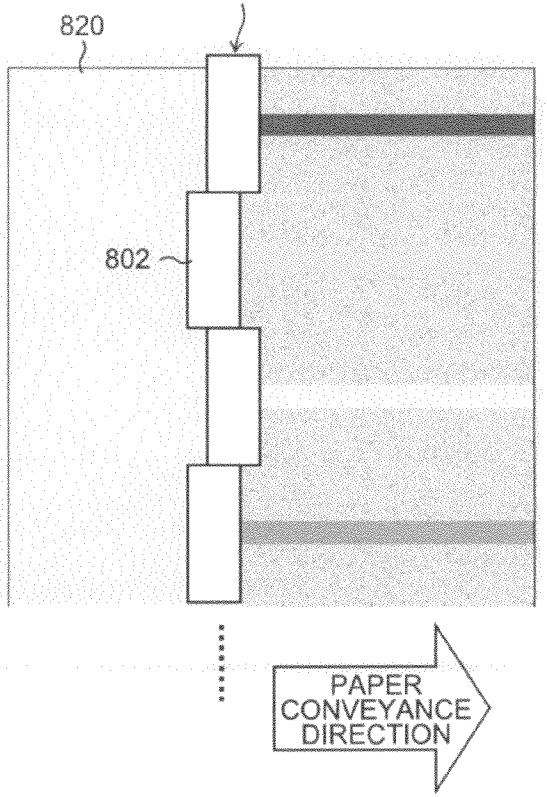
FIG.31B RELATED ART

(a) to (d) of FIG. 3 are schematic drawings of steps for analyzing scan data obtained by reading in an ejection failure correction parameter optimal value selection chart;

FIG. 4 is an illustrative diagram of an ejection failure correction parameter optimal value selection chart according to a second embodiment;

FIG. 5 is an illustrative diagram showing a principal part of an ejection failure correction parameter optimal value selection chart according to a third embodiment;

FIGS. 6A and 6B are illustrative diagrams of an ejection failure correction parameter optimal value selection chart according to a fourth embodiment;

(a) to (e) of FIG. 7 are illustrative diagrams of scan data analysis steps according to a sixth embodiment;

FIG. 8 is an illustrative diagram of an optimal parameter selection procedure according to a twelfth embodiment;

FIG. 9 is a plan diagram showing an example of a nozzle arrangement in an inkjet head;

FIG. 10 is a diagram showing a state where the head in FIG. 9 has been installed with a residual amount of rotation ($\Delta\theta$);

FIG. 11 is a diagram showing a state where the head in FIG. 9 is installed with residual arrangement divergence ($\Delta d$) in one of the head modules constituting the head;

(a) to (d) of FIG. 12 are conceptual diagrams used to explain problems associated with general ejection failure correction technology;

FIGS. 13A and 13B are illustrative diagrams used to explain the effects of landing interference caused by droplet ejection from nozzles peripheral to an ejection failure nozzle;

FIG. 14 is a flowchart of an image processing method relating to a fourteenth embodiment;

FIG. 15 is a plan diagram showing one example of a nozzle arrangement in a head;

FIG. 16 is an illustrative diagram showing an example of a test chart for correction LUT measurement;

FIG. 17A shows one example of a correction LUT for nozzles having the landing interference pattern A and FIG. 17B shows one example of a correction LUT for nozzles having the landing interference pattern B;

(a) to (d) of FIG. 18 are conceptual diagrams showing a state where the image output flow in FIG. 14 is implemented;

FIG. 19 is a plan diagram showing an example of a nozzle arrangement of a head module relating to a fifteenth embodiment;

FIGS. 20A and 20B are illustrative diagrams of a landing interference pattern produced by the head module in FIG. 19;

FIG. 21 is a diagram showing an example of an ejection failure correction parameter optimal value selection chart according to a fourteenth embodiment;

FIG. 22 is a diagram showing an example of an ejection failure correction parameter optimal value selection chart according to the fifteenth embodiment;

FIG. 23 is a general schematic drawing of an inkjet recording apparatus relating to an embodiment of the present invention;

FIGS. 24A and 24B are plan view perspective diagrams showing an example of the composition of an inkjet head;

FIGS. 25A and 25B are diagrams showing examples of an inkjet head composed by joining together a plurality of head modules;

FIG. 26 is a cross-sectional diagram along line 26-26 in FIGS. 24A and 24B;

FIG. 27 is a block diagram showing the composition of a control system of an inkjet recording apparatus;

FIG. 28 is a block diagram showing a further example of the composition of an ejection failure correction parameter determination apparatus which is used for the analysis of a chart;

FIG. 29 is a conceptual diagram of a basic approach to ejection failure correction;

FIG. 30 is an illustrative diagram showing an overview of an ejection failure correction parameter measurement procedure which is disclosed in Japanese patent application publication No. 2008-168592; and FIGS. 31A and 31B are illustrative diagrams showing differences in the ejection failure correction results according to difference in the head modules.

DETAILED DESCRIPTION OF THE PREFERRED EMBODIMENTS

First Embodiment

Figure 1:
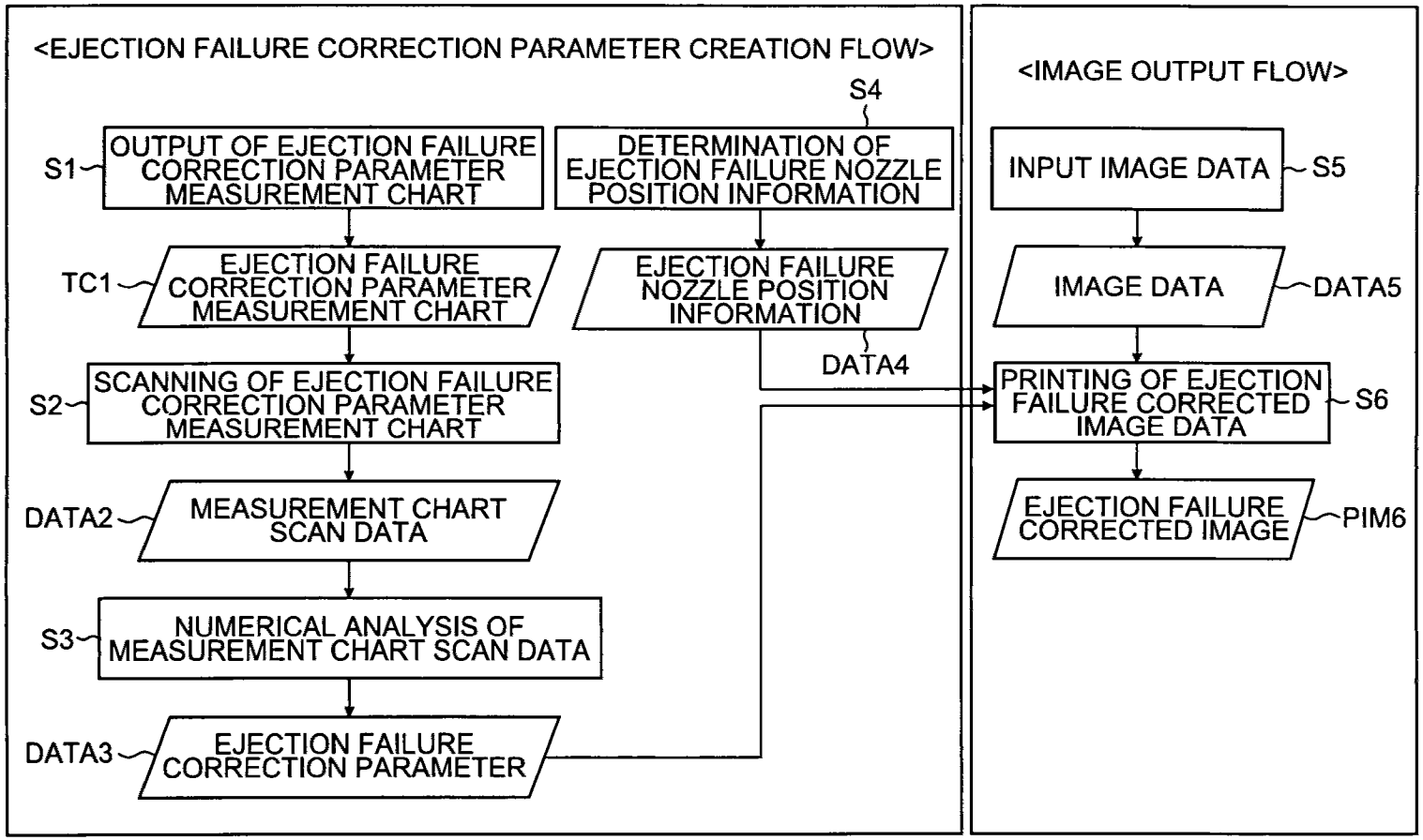
FIG. 1 is a flowchart of an ejection failure correction method relating to a first embodiment of the present invention.

FIG. 1 is a flowchart of an ejection failure correction method relating to a first embodiment of the present invention. The ejection failure correction processing according to the present embodiment is divided broadly into an "ejection failure correction parameter creating flow" for acquiring information about a correction parameter required to correct ejection failure, and an "image output flow" for implementing correction processing using this to correction parameter.

Description of Ejection Failure Correction Parameter Creation Flow

In the ejection failure correction processing according to the present embodiment, firstly, [1] a measurement chart for selecting an optimal value of the ejection failure correction parameter (hereinafter, this measurement chart may be called the "ejection failure correction parameter optimal value selection chart" or simply "optimal value selection chart") is output (step S1). The optimal value selection chart (TC1) which is output in this way is scanned by an image reading apparatus, such as a scanner, (step S2), to acquire scan data of the chart (DATA 2). This scan data (DATA2) is analyzed numerically (step S3), and an ejection failure correction parameter (DATA3) is calculated.

Furthermore, separately from the steps up to the determination of the ejection failure correction parameter (DATA3) described above (S1 to S3), either before these steps (S1 to S3) or after these steps (S1 to S3), ejection failure nozzle position information which is required for correcting ejection failure is determined (step S4).

The ejection failure nozzle position information is constituted, for example, by <1> information measured from the output results of a prescribed test pattern for ejection failure nozzle position determination (for instance, a so-called 1-on N-off test pattern including line patterns of all of the nozzles), and <2> the positions of nozzles which have been judged to be defective nozzles (known ejection failure nozzles, ejection deviations, droplet volume abnormalities, permanently open circuits, etc.) and which have been disabled for ejection so that they cannot be used, and the like.

The ejection failure nozzle position information (DATA4) is stored in a non-volatile memory in the apparatus, or on a hard disk or another storage device, and this information is updated appropriately when needed.

Description of Image Output Flow

There follows a description of an image output flow which includes ejection failure correction processing using the ejection failure nozzle position information (DATA4) and the ejection failure correction parameter (DATA3) described above.

Firstly, image data which is the object of image formation is input (step S5). The device for inputting the image data (input interface) may employ a media interface for acquiring information from an external storage medium (removable media), such as a memory card, optical disk, or the like, or a communications interface (either wired or wireless). Furthermore, it is also possible to interpret a signal input line on which input image data is transmitted as an "image data input device".

Here, it is supposed that multiple-value tone image data is supplied for each ink color in an inkjet image forming apparatus (for example, 256-tone image data for each color corresponding to the four colors of CMYK).

Commonly known color conversion processing and resolution conversion processing are carried out if 24-bit RGB full-color image data (8 bits per color) is input, or if there is a difference between the resolution of the input image and the output resolution of the inkjet image forming apparatus.

Next, in printing the image data (DATA5), ejection failure correction processing is carried out and the ejection failure corrected image data (which has been subject to the ejection failure correction processing) is printed (step S6). In implementing this ejection failure correction, a look-up table (LUT) of ejection failure correction parameters (DATA3) is referenced on the basis of the ejection failure nozzle position information (DATA4) and a density value of the image data (DATA5), and an ejection failure correction parameter for use in ejection failure correction is specified for each ejection failure nozzle.

As stated above, the ejection failure correction parameter referred to here is a general term which covers the amount of strengthening of image formation by ejection failure correction nozzles or a similar correction amount, such as the ejection failure correction nozzle image density increase $P^{density}$ or the ejection failure correction nozzle dot diameter increase $P^{dot}$. For example, the parameter may be a correction coefficient for correcting the image data (image density) before half-tone processing, or a correction coefficient for correcting the drive voltage signal of the actuators corresponding to the nozzles.

A print (PIM6) of an ejection failure corrected image is obtained by means of steps S5-S6 described above.

Figure 2:
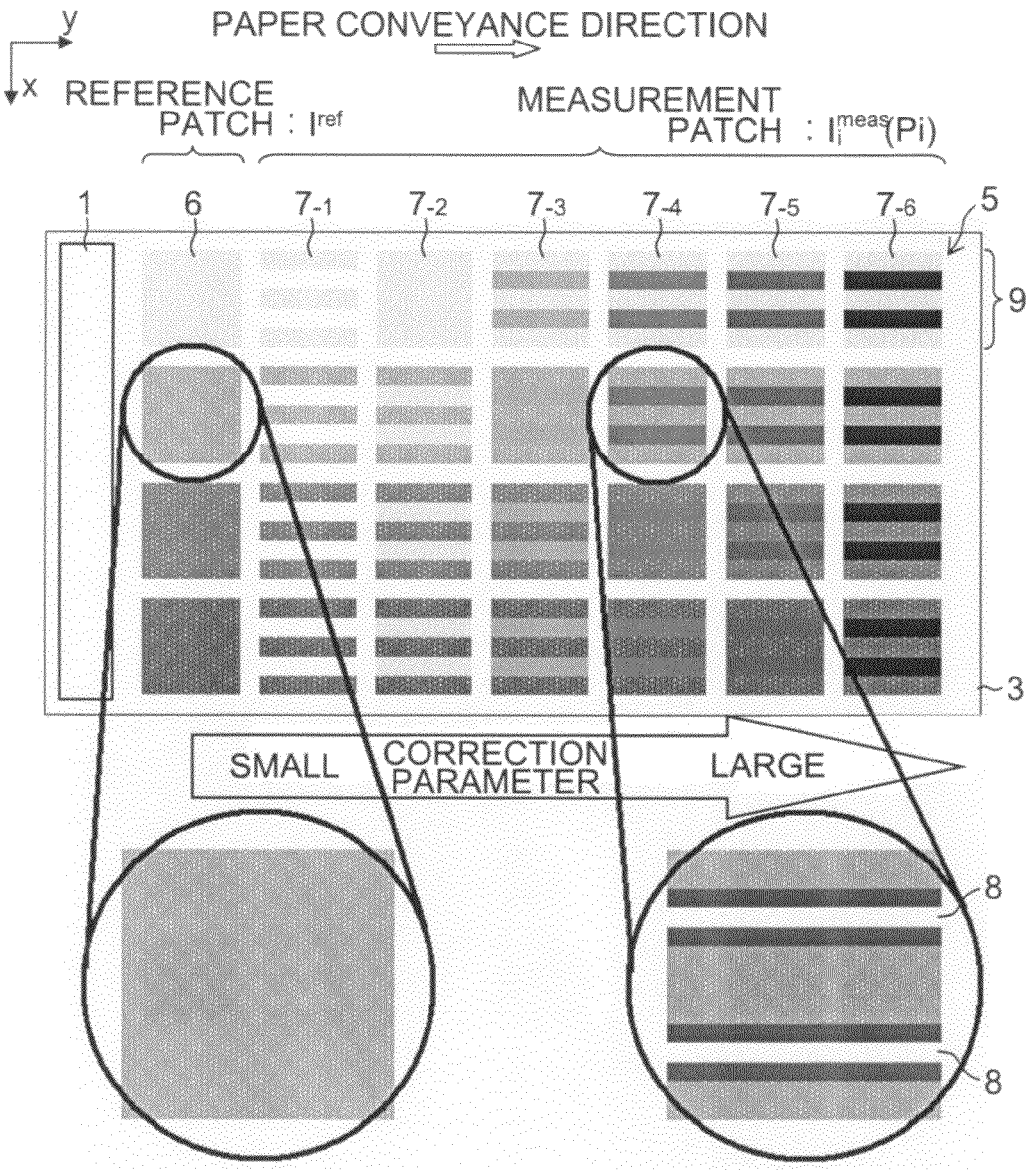
FIG. 2 is a schematic drawing showing one example of an ejection failure correction parameter optimal value selection chart.

Description of Ejection Failure Correction Parameter Optimal Value Selection Chart FIG. 2 is a schematic drawing showing one example of an ejection failure correction parameter optimal value selection chart according to the present embodiment. In FIG. 2, reference numeral 1 denotes a head module of an inkjet printer and reference numeral 3 is paper forming a recording medium.

The paper 3 is conveyed from left to right in FIG. 2. Here, a printer based on a single pass method is given as an example. A plurality of nozzles are formed in the head module 1 according to a nozzle arrangement capable of recording dots at a prescribed recording resolution (for example, 1200 dpi) in a direction (the x direction) which is perpendicular to the paper conveyance direction (the y direction). There are no particular restrictions on the nozzle arrangement.

The optimal value selection chart 5 (which corresponds to a "defective recording element correction parameter selection chart") has a composition in which a plurality of patches 6, 7_*i* (i=1, 2, . . . ) having the same tone L are arranged in the conveyance direction of the paper 3. Two types of patches are arranged in parallel: a reference patch $I^{ref}$ which is indicated by reference numeral 6 and measurement patches $I_i^{meas}(P_i)$ which are indicated by reference numeral 7_*i* (i=1, 2, . . . ). Here, "i" is a suffix corresponding to each measurement patch. The reference patch $I^{ref}$ is a uniform image which is applied uniformly with a tone L. In the measurement patches $I_i^{meas}(P_i)$, a white stripe 8 which simulates the presence of an ejection failure nozzle is provided in one or more than one position with respect to the reference patch $I^{ref}$ (in FIG. 2, a white stripe 8 is provided in two positions in each measurement patch), and an ejection failure correction parameter $P_i$ is applied in actual practice or artificially, on either side (both sides) of each white stripe 8 (on either side in the x direction).

In practice, it is also possible to form an image of measurement patches by applying an ejection failure signal to a nozzle being to be treated as an ejection failure nozzle (non-ejection nozzle), and applying an ejection failure correction parameter to image formation by nozzles which perform recording on either side of the ejection failure nozzle, and it is also possible to create measurement patches by reproducing the corrected image artificially in the image data so as to create image data for the measurement patches, and outputting this image data (forming an image thereof) on the paper 3.

Different values of the ejection failure correction parameter $P_i$ are applied to the respective measurement patches $I_i^{meas}(P_i)$. The ejection failure correction parameter $P_i$ applied to each measurement patch corresponds to a "candidate value of the defective recording element correction parameter".

In the example in FIG. 2, for each tone value L, a patch row 8 is formed in which a total of seven patches are arranged in the paper conveyance direction: one reference patch $I^{ref}$ and six measurement patches $I_i^{meas}(P_i)$ (i=1, 2, . . . , 6). The six measurement patches $I_i^{meas}(P_i)$ use ejection failure correction parameters $P_i$ having respectively different values (i=1, 2, . . . , 6). Furthermore, in FIG. 2, the tone value is changed in four steps, and patch rows based on the respective tone values are formed at respective positions in the x direction on the paper. If the tone value of the patch row shown in the uppermost position in FIG. 2 is represented by L1, the tone value of the patch row below this (the second position from the top) is represented by L2, the tone value of the patch row shown below this (the third position from the top) is represented by L3, and the tone value of the patch row in the lowermost position (the fourth position from the top) is represented by L4, then the relationship L1<L2<L3<L4 is established from the top, in order of increasing tone value.

In FIG. 2, a plurality of measurement patches $I_i^{meas}(P_i)$ arranged in the paper conveyance direction (where i=1, 2, . . . ) are placed in order of increasing value of the ejection failure correction parameter $P_i$ from left to right (a progressively greater amount of increase due to correction), but the relationship between the arrangement order of the measurement patches and the size of the ejection failure correction parameter $P_i$ is not limited to this example.

In FIG. 2, in order to simplify the drawing, a small number of patches are depicted, but there are no particular restrictions on the number of measurement patches based on the same tone value, or on the number of tone values. For example, if there are n different tone values, and if there are m measurement patches for each tone value (for the same tone), then a group of n×(1+m) patches are formed for each module (one module). Moreover, if k measurement patches (patterns) are formed by differentiating positions of nozzles being to be treated as ejection failure nozzles (non-ejection nozzles) in the same module, so as to take account of the positional dependence on the ejection failure nozzle position in the module, then the number of patches formed is k times the aforementioned number (where n, m and k are each integers not less than 1). If all of the patches cannot be recorded on one sheet of paper, then the patches are recorded over a plurality of sheets of paper.

Furthermore, in FIG. 2, only one head module is depicted, but if a plurality of print heads are used for respective colors of ink, then a similar chart is output for each color of ink.

Description of Scan Data Analysis Method (a) to (d) of FIG. 3 are schematic drawings illustrating a procedure for analyzing scan data (a read image) obtained by reading in an ejection failure correction parameter optimal value selection chart. The optimal value selection chart is output by a printer and this chart is scanned by an optical reading device, such as a flat head scanner, or the like. (a) of FIG. 3 represents scan data obtained by scanning a patch row of a certain tone value L. The scan data of each patch is represented by $S^{ref}(x,y)$, $S_i^{meas}(x,y,Pi)$.

In analyzing the scan data, the scan data is firstly subjected to an image filtering process using a visual transfer function VTF which takes account of human visual characteristics. (b) of FIG. 3 represents data after the VTF processing.

If the VTF function is represented by VTF(u,v) (where (u,v) is a two-dimensional coordinates system based on spatial frequency), and if data after the VTF processing of the scan data S(x,y) is represented by V(x,y), then the relationship between V and VTF can be expressed by (Formula 1) below.

$$V=\Im^{-1}(\mathrm{VTF}*\Im(S)) \qquad \text{Formula 1}$$

In Formula 1, "*" denotes multiplication of the components, "3" denotes Fourier transformation, and each capital letter denotes each distribution.

Next, differential data is created by subtracting reference patch data $V^{ref}(x,y)$ after the VTF processing, from measurement patch data $V_i^{meas}(x,y,Pi)$ after the same VTF processing. (c) of FIG. 3 represents this differential data.

Finally, the square root of the sum of the squares of the respective components of the differential data, $E_i(P_i)$, is calculated. This value is expressed by the following equation (Formula 2).

$$E_i(P_i) = \sqrt{\sum_x \sum_y (V_i^{meas}(x, y, P_i) - V^{ref}(x, y))^2} \qquad \text{Formula 2}$$

Instead of using $E_i(P_i)$ stated above (which corresponds to an "evaluation value") as an evaluation index, it is also possible to use the sum of squares directly before deriving the square root (the expression within the square root symbol in Formula 2) as an evaluation index.

(d) of FIG. 3 is a graph in which the evaluation index values thus calculated are ordered in relation to values of the ejection failure correction parameter $P_i$. The horizontal axis represents the value of the ejection failure correction parameter $P_i$ and the vertical axis represents the value of the evaluation index $E_i(P_i)$.

If ejection failure correction is complete (in an ideal state), the value of the evaluation index $E_i(P_i)$ becomes zero. Consequently, in the method according to the present embodiment, a measurement patch at which the evaluation index $E_i(P_i)$ becomes a minimum is selected as an optimal patch, and the ejection failure correction parameter P; applied to this patch is selected as an optimal parameter for the tone L in question.

By processing for calculating differential data between a measurement patch and a reference patch according to the present method, it is possible to greatly reduce the effects of image non-uniformity caused by the state of the head module, and the accuracy of parameter selection is improved. Furthermore, by carrying out VTF processing, it is possible to measure the parameter with similar accuracy to visual measurement.

Second Embodiment

As shown in FIG. 4, if the print head 2 is constituted by a plurality of head modules i_*j* (j=1, 2, . . . , N), then an ejection failure correction parameter optimal value selection chart as described in the first embodiment (see FIG. 4) is formed in the image formation regions corresponding to the respective head modules 1_*j* (j=1, 2, . . . , N), and similar analysis to that of the first embodiment is carried out in respect of each head module 1_*j* (j=1, 2, . . . , N). By this means, the ejection failure correction parameter is optimized for each head module, and variation in the visibility of the correction results, as described in relation to FIG. 31B, can be overcome.

Third Embodiment

Instead of the arrangement of patches in the ejection failure correction parameter optimal value selection chart according to the first embodiment which is described in relation to FIG. 2, it is also possible to employ a mode in which a reference patch 6 is disposed in the vicinity of the center of the alignment of measurement patches 7_*i* (i=1, 2, . . . , 6), as shown in FIG. 5.

In scanning the optimal value selection chart, skew is liable to occur depending on the positioning of the paper during scanning. Furthermore, during image formation, a small angular difference may occur between the print head and the paper, depending on the relative positional relationship between the head and the paper. Due to these factors, skew occurs in the scan data of the optimal value selection chart. The effects of the skew become less influential, the smaller the distance between the reference patch 6 and each measurement patch 7_*i* (i=1, 2, . . . , 6) of the same tone value L. Consequently, if the arrangement of the patches shown in FIG. 5 is adopted, then it is possible to achieve parameter measurement which is more robust in respect of skew, than the arrangement in FIG. 2.

Fourth Embodiment

FIGS. 6A and 6B show an example of an optimal value selection chart according to a fourth embodiment. In the optimal value selection chart according to the first embodiment which is shown in FIG. 2, an example is described in which a plurality of measurement patches are formed with the correction parameter being changed in a stepwise fashion, in respect of the same tone value L, but instead of a mode where a plurality of measurement patches of this kind are arranged in the paper conveyance direction, it is also possible to change the ejection failure correction parameter continuously, as shown in FIG. 6A. Even if one measurement patch is formed in a linked band shape in which the ejection failure correction parameter is changed continuously, it is possible to calculate the evaluation index $E_i(P_i)$ in a similar fashion to the first embodiment. In the first embodiment, evaluation index values which are calculated discretely in accordance with the suffixes i of the respective measurement patches are obtained, whereas in the fourth embodiment, as shown in FIG. 6B, the ejection failure correction parameter is changed continuously, and evaluation index values are calculated respectively for each value of the ejection failure correction parameter, in accordance with this change. Consequently, it is possible to raise the resolution of ejection failure correction parameter measurement.

Fifth Embodiment

By repeating the procedure for selecting an optimal value of the ejection failure correction parameter described in the first embodiment to the third embodiment, it is possible to improve the selection accuracy and resolution of the optimal value. This procedure can be summarized as described below.

(Step 1): A first optimal value selection chart is printed and analyzed, and an optimal value of an ejection failure correction parameter (first time) is calculated.

(Step 2): Next, the optimal value of the ejection failure correction parameter calculated from the preceding chart analysis is taken as a basis, and an optimal value selection chart is created again by varying the ejection failure correction parameter $P_i$ applied to the measurement patches to either side of this optimal value.

(Step 3): The optimal value selection chart re-created in Step 2 is printed and analyzed, and an optimal value of the ejection failure correction parameter is calculated.

(Step 4): Thereafter, it is possible to achieve further improvement of the selection accuracy, by repeating Steps 2 to 3 again.

In re-creating the optimal value selection chart in Step 2 described above, it is possible to improve the resolution of the selection of the optimal value for the ejection failure correction parameter by setting finer divisions of the value of the ejection failure correction parameter $P_i$ which is applied to the measurement patches.

Sixth Embodiment

In the scan data analysis procedures according respectively to the first embodiment to the fifth embodiment, in order to reduce the calculation load, it is possible to calculate an integration profile of each set of patch data in the paper conveyance direction (y direction), and to analyze the data by a calculation procedure similar to that in (a) to (d) of FIG. 3, after converting the data to one-dimensional data.

(a) to (e) of FIG. 7 show a schematic diagram of this analysis procedure. (a) of FIG. 7 represents scan data obtained by scanning a patch row of a certain tone value L (similar to (a) of FIG. 3). One-dimensional profile data is obtained by integrating the scan data, $S^{ref}(x,y)$, $S_i^{meas}(x,y,Pi)$, of each patch shown in (a) of FIG. 7, in the y direction. (b) of FIG. 7 shows integration profiles (one-dimensional data) calculated from each patch.

Thereupon, VTF processing is applied to the one-dimensional data of each of these patches. (c) of FIG. 7 represents data after VTF processing.

Thereupon, differential data is created by subtracting the reference patch data after VTF processing, from measurement patch data after VTF processing. (d) of FIG. 7 represents this differential data.

Finally, the square root of the sum of the squares (or the sum of the squares itself) of the components of each of the differential data is calculated, as an evaluation index. (e) of FIG. 7 is a graph in which the evaluation index values thus calculated are ordered in relation to the value of the ejection failure correction parameter $P_i$.

Consequently, a measurement patch in which the evaluation index calculated in this way becomes a minimum is selected as an optimal patch, and the ejection failure correction parameter $P_i$ applied to this patch is selected as an optimal parameter for the tone L in question.

Figures 7A, 7B, 7C, 7D, 7E:
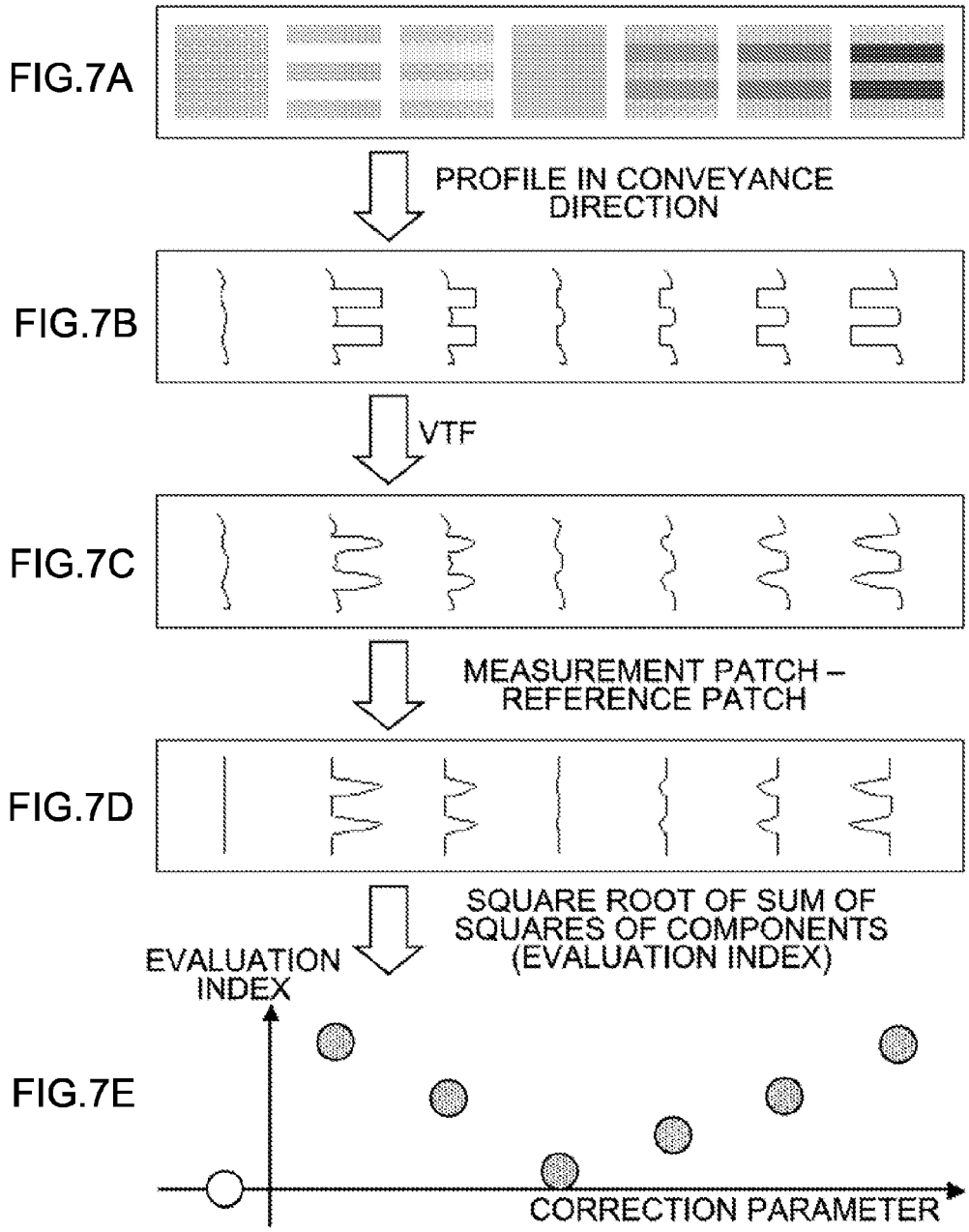

In the analytical calculation according to the first embodiment which is described in FIG. 2, a two-dimensional fast Fourier transform (FFT) is carried out, but the sixth embodiment which is described in FIGS. 7A and 7E involves carrying out a one-dimensional FFT and therefore the calculation load is reduced.

Seventh Embodiment

In the first embodiment to the sixth embodiment, it is also possible to carry out image rotation correction processing of the scan data. As described in the third embodiment, skew may occur in the scan data of the measurement chart as a result of the positioning of the paper during scanning (the relative angle between the paper and the scanner), or skewing of the paper with respect to the print head during printing of the chart, or the like.

By correcting the effects of this skew by image processing (for example, by image rotation processing), it is possible to achieve parameter measurement of even higher accuracy.

Eighth Embodiment

In the scan data analysis procedures according to the first embodiment to the seventh embodiment, it is effective to carry out processing for correcting the effects of MTF (Modulation Transfer Function) due to the paper, scanner, or the like. If there are remaining effects of MTF, this leads to decline in the contrast of the high-frequency component and thus causes decline in the accuracy of the ejection failure correction portion of the scan data. Consequently, by carrying out MTF correction processing, it is possible to achieve even more accurate parameter measurement.

Ninth Embodiment

In the first embodiment to the eighth embodiment, instead of a mode which applies VTF processing to the scan data, it is also possible to substitute a smoothing processing which is unrelated to visual characteristics, such as filtering using a low-pass filter (LPF), a band-pass filter (BPF), or moving average processing, or low-resolution scanning of the measurement chart, or the like.

VTF processing involves a large calculation load compared to LPF, BPF or moving average processing. Consequently, it is possible to reduce the calculation load by substituting another filtering procedure other than VTF for VTF.

Tenth Embodiment

In the first embodiment to the ninth embodiment, the order of the VTF processing (or substitute smoothing processing) and the creation of differential data may be reversed. More specifically, similar results are obtained even if differential data of the measurement patch data and the reference patch data is calculated, and then VTF processing (or a substitute smoothing processing) is applied to this differential data.

By creating the differential data first, it is possible to reduce the number of times the VTF processing (smoothing processing) is carried out, and therefore the calculation load can be reduced.

Eleventh Embodiment

In the first embodiment to the tenth embodiment, instead of a mode which uses the square root of the sum of squares of the components of differential data (or the sum of squares thereof directly), as an evaluation index, it is also possible to use another value as an evaluation index. For example, similar beneficial results are obtained even if an optimal parameter is determined on the basis of a correlation coefficient between a measurement patch and a reference patch, or a variance value of differential data components, or a maximum value of differential data components, or a suitable combination of these, or the like.

Twelfth Embodiment

In the first embodiment to the eleventh embodiment, an optimal parameter is specified from the smallest value of the evaluation index, but it is also possible to use the steps described below to select an optimal parameter from the evaluation index.

(Step 1) An evaluation index is calculated as a square root of the sum of the squares of the respective differential data components, and this evaluation index is taken to be directly proportional to the amount of light.

(Step 2) The ejection failure correction parameter $P_i$ is converted to a value which is directly proportional to the droplet ejection rate of the ejection failure correction nozzle.

(Step 3) As shown in FIG. 8, the evaluation indices for respective measurement patches are plotted on a graph in which the horizontal axis represents the droplet ejection rate and the vertical axis represents the evaluation index, and a regression line RL1 indicating under-correction and a regression line RL2 indicating over-correction are calculated from the to plotted points on the graph.

(Step 4) Next, the point of intersection of the two regression lines RL1 and RL2 is calculated, the droplet ejection rate at that point is calculated, and this value is recalculated as the ejection failure correction parameter value. The value found in this way is taken as the optimal parameter.

By means of steps 1 to 4 described above, improved accuracy is obtained in the selection of the optimal parameter in shadows (portions of dark image density) or highlights (portions of light image density). More specifically, in general, measurement sensitivity becomes worse in shadows and highlights. In respect of this point, it is possible to increase robustness with respect to noise by determining the point at which the evaluation index becomes a minimum, using interpolation processing, as in the regression lines RL1, RL2 in steps 1 to 4.

Further Analytical Examples

Instead of a method which determines an optical value from the point of intersection of the two regression lines RL1, RL2 shown in FIG. 8, it is also possible to determine an approximation curve by curve fitting from the plot points on a similar coordinates system (or a coordinates system where "ejection failure correction parameter" is substituted for the horizontal axis in FIG. 8), and to determine a minimum value from this approximation curve. Incidentally, depending on the definition of the evaluation index, there may also be cases where the point where the evaluation index becomes a maximum corresponds to the optimal value.

Furthermore, it is also possible to determine, as the "optimal value", the point where the second order differential on a graph based on a similar coordinates system to FIG. 8 (or a coordinates system in which "ejection failure correction parameter" is substituted for the horizontal axis in FIG. 8) becomes a minimum value or a maximum value.

Thirteenth Embodiment

In the first embodiment to twelfth embodiment, it is beneficial to use an in-line scanner incorporated in an inkjet printer as an optical reading device which is used for scanning a measurement chart. According to a mode of this kind, it is possible to read in a measurement chart in parallel with the printing of the measurement chart, and furthermore, it is possible to omit work such as cutting the chart, or the like, and efficient analysis is possible.

Fourteenth Embodiment

Next, further ejection failure correction technology which is desirably applied in combination with the first embodiment to the thirteenth embodiment will be described. To start with, problems of correction technology which the fourteenth embodiment is intended to resolve will be described.

Description of Problem

In the field of inkjet image formation, various measures are adopted in order to achieve image formation of high resolution by means of an inkjet head. For example, as shown in FIG. 9, a head 300 is constituted by a structure in which a plurality of nozzle head modules 301 are arranged in a staggered configuration, and the recording position pitch Δx on the paper 340 (image receiving medium) is made narrower than the pitch Pm of the nozzles 320 in the head module 301, thereby raising the recording resolution, and so on. In the example in FIG. 9, the head 300 is composed so as to have a nozzle arrangement (staggered arrangement) whereby the recording position pitch Δx on the paper 340 is approximately Pm/2.

By conveying at a uniform speed the paper 340 in a substantially parallel direction to the lengthwise direction of the head 300 and controlling the droplet ejection timing of the nozzles 320, it is possible to form a desired image on the paper 340. Here, it is supposed that the paper 340 is conveyed from the lower side toward the upper side in FIG. 9. If the conveyance direction of the paper 340 is the y direction and the width direction of the paper perpendicular to this is the x direction, then it is possible to form dots (recording points formed by depositing liquid droplets) at a pitch of Δx in the x direction on the paper 340. Here, Δx is a value which corresponds to the recording resolution (in the case of 1200 dpi, approximately 21.2 μm).

The alignment sequence of nozzles 320 capable of forming a dot row in the x direction on the paper 340 at a pitch (Δx) corresponding to the recording resolution (the alignment sequence of nozzles obtained by projecting the nozzle arrangement in the head 300 onto the x axis) gives the effective nozzle arrangement. In the present specification, nozzles which are in a mutually adjacent positional relationship in the nozzle alignment sequence of this effective nozzle row (the projected nozzle row on the x axis) are called "adjacent nozzles". In other words, even nozzles which are not necessarily in adjacent positions in the nozzle layout in the head 300 are called "adjacent nozzles" if they are aligned in adjacent positions when viewed as a projected nozzle row on the x axis on the paper 340.

When an inkjet head of this kind is installed in a printing apparatus, it is necessary to adjust the angle and position of installation of the head, but there are limits on the mechanical adjustment precision. Consequently, there are cases where, as shown in FIG. 10, the head 300 is slightly rotated from the specified position (the ideal installation position according to the design) and where the head 300 is installed on the printing apparatus in a state having a residual amount of rotation (Δθ). Furthermore, there are also cases where, as shown in FIG. 11, the arrangement positions of the head modules 301 are slightly divergent and the head 300 is installed on the printing apparatus in a state having this residual divergence in the arrangement position (Δd). When ink is ejected from the nozzles 320 of the head 300 in a state of this kind, error (also referred to as "depositing position error") occurs in the depositing positions on the paper 340.

When conventional ejection failure correction technology is used in a head having depositing position errors and ejected droplet volume errors, if the same correction coefficient is used for all of the ejection failure nozzles, then correction may be excessive or insufficient, depending on the state of arrangement of the nozzles, and black stripes or white stripes may become visible on the surface of the paper.

(a) to (d) of FIG. 12 are schematic views of this phenomenon. Here, by way of example, a case is described ((a) of FIG. 12) in which a head 300 is installed with a residual amount of rotation (Δθ), and an upper-stage nozzle NA_*j* and a lower-stage nozzle NB_k are ejection failure nozzles which are suffering an ejection failure, as described in relation to FIG. 10. In this case, normal ejection failure correction technology corrects the values (image setting values representing density tone graduations) of pixels corresponding to nozzles which are adjacent before and after an ejection failure nozzle (before and after an ejection failure nozzle in the alignment sequence of the effective nozzle row). In FIG. 12, the image setting values of the positions corresponding to the adjacent nozzles NB_*j*−1 and NB_*j*+1 before and after the ejection failure nozzle NA_*j* are corrected, and furthermore the image setting values of the positions corresponding to the adjacent nozzles NA_k−1 and NA_k+1 before and after the ejection failure nozzle NB_k are corrected.

(b) of FIG. 12 shows a schematic view of a state where a solid image (uniform density image) having a certain density (tone value) is formed by using normal ejection failure correction technology in the head 300 in (a) of FIG. 12. Since dots cannot be formed at the positions (in the direction of x) corresponding the ejection failure nozzles NA_*j*, NB_k on the paper, then the prescribed density cannot be achieved in the corresponding portions of the image. In order to compensate for this, correction is performed to increase the output density of the adjacent nozzles. (c) of FIG. 12 shows the image setting values of the pixels corresponding to respective nozzle positions. In the case of a tone value D1 indicating a density of a solid image, correction is performed to amend the image setting values to a higher value (D2) using a prescribed correction coefficient in positions which correspond to the adjacent nozzles of the ejection failure nozzles.

However, taking a macroscopic view of the output results after correction, the position corresponding to the ejection failure nozzle NA_*j* on the paper is over-corrected, the output density becomes high and a so-called "black stripe" appears visually, as shown in (d) of FIG. 12. Furthermore, the position corresponding to the ejection failure nozzle NB_k is under-corrected, the output density is low and a so-called "white stripe" appears visually.

Moreover, the physical conditions which are focused on by conventional ejection failure correction technology as dominant factors are principally two items: the ejection liquid depositing position and the dot diameter (a value which has a correlation to the volume of the ejected droplet), but an image forming process by an inkjet head cannot be explained completely by these two physical conditions alone, and it may not be possible to achieve satisfactory correction performance by means of correction technology which focuses of these two items alone.

One example of a dominant factor which is not considered in conventional ejection failure correction technology is "landing interference". Landing interference is a phenomenon whereby, when liquid droplets combine together, a droplet which has been deposited subsequently is drawn toward a droplet which has been deposited previously due to the effects of the surface energy of the liquid, a dot is caused to be moved, and hence a dot is formed at a position which diverges from the originally intended depositing position. Landing interference is a phenomenon which is closely linked to the depositing positions and the dot diameter. For example, in a state where the depositing position error is the same, the presence or absence of landing interference varies depending on the size of the dot diameter. Furthermore, the presence and absence of landing interference also varies in a similar fashion in cases where the dot diameter is the same and there is change in the size of the depositing position error.

Moreover, the presence or absence of landing interference also varies with the time difference of droplet ejection between a dot and peripheral dots, in other words, the deposition sequence. FIGS. 13A and 13B are schematic drawings for describing the presence or absence of landing interference depending on the deposition sequence. FIGS. 13A and 13B assume an ideal state where the depositing position error and the dot diameter of the nozzles 320 in the head 300 described in relation to FIG. 9 are the same in all of the nozzles, and shows a case where some of the nozzles in this head 300 have suffered ejection failure.

FIG. 13A shows a case where one nozzle NB_k has suffered ejection failure, of the nozzle row situated to the upstream side of the paper conveyance direction in the head 300 (in FIG. 9, the lower-stage nozzle row; hereinafter also called "upstream nozzle row"). In the head 300 in FIG. 9, ejection is performed firstly from the upstream nozzle row which is situated on the upstream side in terms of the conveyance direction of the paper 340, whereupon ejection is performed from the nozzle row on the downstream side (the upper-stage nozzle row in FIG. 9).

In other words, there is a time difference between droplet ejection from the upstream nozzle row and droplet ejection from the downstream nozzle row (in other words, a deposition time difference). The left-hand side diagram in FIG. 13A shows a state where a liquid droplet 350B ejected from a nozzle in the upstream nozzle row reaches the surface of the paper 340 before a liquid droplet 350A ejected from a nozzle in the downstream nozzle row. If the nozzle NB_k belonging to the upstream nozzle row is suffering an ejection failure, then no liquid droplet is present on the position on the surface of the paper corresponding to the ejection failure nozzle NB_k. In FIG. 13A, an ejection failure is indicated by a broken line.

In this case, the droplets 350A_k−1 and 350A_k+1 ejected from the nozzles adjacent to the ejection failure nozzle NB_k (hereinafter, a nozzle adjacent to an ejection failure nozzle is called an "adjacent to ejection failure nozzle") aggregate with the droplets 350B_k−2 and 350B_k+2 ejected previously by adjacent nozzles further to the outside. The depositing position error of an adjacent to ejection failure nozzle is enlarged due to this aggregating action (landing interference), and the droplet ejection interval (interval between dots) before and after the ejection failure nozzle NB_k is increased. More specifically, the pitch ΔSA between dots formed by droplets ejected by a pair of adjacent to ejection failure nozzles becomes greater (see the right-hand diagram in FIG. 13A).

On the other hand, FIG. 13B shows a case where one nozzle NA_*j* has suffered ejection failure, of the nozzle row situated to the downstream side in terms of the paper conveyance direction in the head 300 shown in FIG. 9 (in FIG. 9, the upper-stage nozzle row; hereinafter "downstream nozzle row").

In this case, the droplets 350B_k−1 and 350B_k+1 which are ejected by the adjacent nozzles (adjacent to ejection failure nozzles) before and after the ejection failure nozzle NA_*j* are deposited first on the paper surface, and therefore an aggregating action (landing interference) as described above does not occur. Therefore, the droplet ejection pitch (distance between dots) before and after the ejection failure nozzle NA_*j* is narrower than in the case of FIG. 13A. In other words, the pitch ΔSB between the dots formed by droplets ejected by the pair of adjacent to ejection failure nozzles becomes narrow, as shown on the right-hand diagram in FIG. 13B (ΔSB<ΔSA).

In FIGS. 13A and 13B, the droplets (dots) deposited on the paper surface are depicted as having a spherical shape, but this is for the sake of simplicity in order to clarify the relationship between the ejected droplets 350A and 350B, and in actual practice the deposited droplets (dots) have a shape which spreads over the paper surface at an angle of contact that is governed by the properties of the liquid and the surface properties of the paper surface.

As described above, even in an ideal case where the depositing position error and the dot diameter of the nozzles 320 in the head 300 shown in FIGS. 13A and 13B are the same in all of the nozzles, the positional error may increase depending on the deposition order, the droplet ejection pitch before and after the ejection failure nozzle becomes larger or smaller, and the visibility of the stripes varies greatly.

In this way, in image formation by an inkjet head, it is not possible to ignore the effects of landing interference. The ejection failure correction technology is also affected by these factors. In the first embodiment described in relation to FIG. 1 also, the depositing position error of each nozzle is calculated in advance (step S4 in FIG. 1), but in this measurement, it is necessary to create conditions where no image formation is performed in the vicinity of a nozzle for which the position error is to be measured so that landing interference does not occur.

However, when actually performing image formation, as shown in FIGS. 13A and 13B, landing interference occurs and therefore the measurement value of the position error measured under conditions where landing interference does not occur diverges greatly from the actual value. Consequently, correction technology using a conventional technique which considers only depositing position error and ejected droplet volume error may produce results in which a combination of blank stripes and white stripes are visible on the surface of the paper.

Therefore, it is desirable to carry out ejection failure correction processing which takes account of the nozzle position and deposition sequence (deposition pattern). Desirably, an ejection failure correction parameter which takes into account the nozzle position and the deposition sequence (deposition pattern) is determined in combination with the selection of an optimal value for the ejection failure correction parameter which is described in the first to thirteenth embodiments.

Details of Ejection Failure Correction Processing According to Fourteenth Embodiment FIG. 14 is a flowchart of an image processing method relating to a fourteenth embodiment. To give a general description of the overall flow of image correction processing according to the fourteenth embodiment, firstly, [1] a test chart for ejection failure correction LUT measurement is output, [2] an ejection failure correction LUT is created by analyzing this test chart, and [3] correction of the image data is carried out using the ejection failure correction LUT thus created. In FIG. 14, the steps until obtaining the ejection failure correction LUT (DATA 27 in FIG. 14) are called the "ejection failure correction LUT creation flow", and the steps of actually performing a correction process of the input image data by using this ejection failure correction LUT (S30 to S36 in FIG. 14) are called the "image output flow".

Description of Ejection Failure Correction LUT Creation Flow

Firstly, the ejection failure correction LUT creation flow will be described. In the present embodiment, correspondence information for the nozzle positions in the head and the landing interference patterns is required. Correspondence information of this kind is required to be created on the basis of the judgment of the manufacturer (a person who designs and manufactures the apparatus), in accordance with the head design information, the head installation state, and the like (step S10).

Here, in order to simplify the description, the inkjet head 10 shown in FIG. 15 (which corresponds to a "recording head"; hereinafter, referred to simply as "head") is envisaged. This head 10 has a similar composition to the head 300 described in FIG. 9, and is composed by arranging a plurality of head modules 12 in a staggered configuration. These head modules 12 have nozzle rows in which a plurality of nozzles 20 are arranged at uniform pitch Pm. For the sake of this description, the number of nozzles shown is reduced and nozzle rows are depicted in which five nozzles 20 are arranged in one row in each head module 12, but in an actual head, several tens to several hundreds of nozzles may be provided in each head module, and furthermore, a mode may be adopted in which several hundreds to several thousands of nozzles are arranged two-dimensionally.

A group of nozzles in a nozzle row 22A constituted by a head module arranged in the upper level in FIG. 15 (the head module labeled with reference numeral "12_A" below) is called "nozzle group A" and a group of nozzles in a nozzle row 22B constituted by a head module arranged in the lower level in FIG. 15 (the head module labeled with reference numeral "12_B" below) is called "nozzle group B".

Paper 40 which forms an image receiving medium is conveyed from the lower side to the upper side in FIG. 15, with respect to the head 10 having a nozzle arrangement of this kind. The paper conveyance direction is taken as the y direction and the width direction of the paper perpendicular to same is taken as the x direction. The head 10 and the paper 40 should be movable relative to each other, but the paper 40 may be stationary and the head 10 may be moved from the upper side toward the lower side in FIG. 15, or both the head 10 and the paper 40 may be movable.

FIG. 15 shows a state where the head 10 is installed in a printing apparatus in a state having a residual amount of rotation ($\Delta\theta$). If the head 10 is installed in a regulation position without any rotation ($\Delta\theta=0$), then as shown in FIG. 9, an ideal composition is achieved in which the nozzles 20 are arranged at uniform pitch (Pm/2) in the x direction.

When forming an image on the paper 40 (for example, when forming a line in the x direction) according to the direction of conveyance of the head 10 and the paper 40 shown in FIG. 15, the droplets ejected from the nozzles belonging to the nozzle group B (hereinafter, labeled as nozzles "20B") situated on the upstream side in terms of the paper conveyance direction land first on the paper 40, and droplets ejected from the nozzles belonging the nozzle group A on the downstream side (hereinafter, labeled as nozzles "20A") land on the paper 40 subsequently.

In other words, there is a time difference between the droplet ejection timings of the nozzle group B and the nozzle group A, whereby the droplets ejected from the nozzles 20B of the nozzle group B land first on the paper 40 and the droplets ejected from the nozzles 20A of the nozzle group A land subsequently between the dots formed by the previously deposited droplets, so as to cover between the previously deposited droplets (the dots formed by droplets ejected from the nozzles 20B of the nozzle group B). In this way, on the paper 40, a continuous dot row is formed in which the deposited droplets ejected by the nozzles 20B (previously deposited droplets) and the deposited droplets ejected by the nozzles 20A (subsequently deposited droplets) are arranged alternately in the x direction, and recording of a line is achieved by this dot row.

In the example in FIG. 15, one nozzle $N_Z$_A (indicated by a white circle in FIG. 15) belonging to the upper-level nozzle group A is suffering an ejection failure, and one nozzle $N_Z$_B (indicated by a white circle in FIG. 15) belonging to the lower-level nozzle group B is suffering an ejection failure. As described in relation to FIGS. 13A and 13B, the effects of landing interference in the periphery of the respective ejection failure nozzles differ between a case where a nozzle $N_Z$_B belonging to the nozzle group B in the upstream nozzle row is suffering an ejection failure and a case where a nozzle $N_Z$_A belonging to the nozzle group A in the downstream nozzle row is suffering an ejection failure.

In other words, if the nozzle $N_Z$_B belonging to the nozzle group B has suffered an ejection failure, then as shown in FIG. 13A, the dots which are adjacent on the left and right-hand sides of the ejection failure position (unrecordable dot position) corresponding to this ejection failure nozzle $N_Z$_B (namely, the dots formed by droplets ejected by nozzles 20A of the nozzle group A) are respectively drawn toward the previously deposited droplets which have been deposited previously on the paper 40 (see FIG. 13A). Due to this aggregating effect (landing interference), the depositing position error of nozzles adjacent to the ejection failure nozzle $N_Z$_B (the adjacent to ejection failure nozzles) increases, the pitch between the dots of this pair of adjacent to ejection failure nozzles increases, and hence the gap between the dots which are adjacent on either side of the missing dot position corresponding to the ejection failure nozzle $N_Z$_B becomes larger.

On the other hand, if a nozzle $N_Z$_A belonging to the nozzle group A has suffered an ejection failure, then as shown in FIG. 13B, the dots which are adjacent on the left and right-hand sides of the missing dot position corresponding to this ejection failure nozzle $N_Z$_A (namely, dots formed by droplets ejected by nozzles 20B of the nozzle group B) land previously on the paper 40, and therefore aggregation (landing interference) such as that described above does not occur. Therefore, the gap between the dots which are adjacent on either side of the missing dot position corresponding to the ejection failure nozzle $N_Z$_A becomes narrower than a case where a nozzle $N_Z$_B of the nozzle group B is suffering an ejection failure.

In this way, the effects of landing interference vary depending on the position of an ejection failure nozzle (depending on which group an ejection failure nozzle belongs to), and the appearance of the image defect caused by the ejection failure (white stripe or density non-uniformity) varies. If another nozzle 20A belonging to the same nozzle group A suffers an ejection failure, then this produces a similar effect to that when the nozzle $N_Z$_A suffers an ejection failure. Furthermore, if another nozzle 20B belonging to the same nozzle group B suffers an ejection failure, then this produces a similar effect to that when the nozzle $N_Z$_B suffers an ejection failure.

The pattern of occurrence of landing interference (attribute) arising when the nozzle 20A belonging to the nozzle group A has suffered an ejection failure is called "landing interference pattern A" and the pattern of occurrence of landing interference arising when the nozzle 20B belonging to the nozzle group B has suffered an ejection failure is called "landing interference pattern B". In other words, in the present embodiment, it is considered that all of the nozzles 20A belonging to the same nozzle group A have the same landing interference pattern A inducing factors as the nozzle $N_Z$_A belonging to the same group A and all of the nozzles 20B belonging to the nozzle group B have the same landing interference pattern B inducing factors as the nozzle $N_Z$_B belonging to the group B. The landing interference patterns A and B show differences due to the landing interference inducing factors (here, the deposition sequence) of the nozzle groups A and B.

As stated previously, the nozzles 20A belonging to the nozzle group A correspond to the "landing interference pattern A" and the nozzles 20B belonging to the nozzle group B correspond to the "landing interference pattern B". In step S10 in FIG. 14, information (correspondence information) defining this correspondence relationship is created.

In the head structure of the present embodiment which is shown in FIG. 15, landing interference patterns A and B of two types corresponding to nozzle groups A and B are described, but depending on the design of the head, the landing interference patterns may be divided into more than two types. Furthermore, the occurrence or non-occurrence of landing interference depending on the nozzle group A or B in the head structure in FIG. 15 is stated here, but it is also possible to take account of other factors, such as the ejected droplet volume (dot diameter), the depositing position, and the like, and to handle the extent of the effect of landing interference (change in the amount of variation of the position error due to landing interference), as an attribute (pattern) of the landing interference.

A test chart for correction LUT measurement is created on the basis of the correspondence information (DATA 11) created in this way (step S24).

FIG. 16 shows an example of a test chart for correction LUT measurement. The chart shown on the left-hand side of FIG. 16 is a test chart for correction LUT measurement corresponding to the landing interference pattern A, and the chart shown on the right-hand side of FIG. 16 is a chart for correction LUT measurement corresponding to the landing interference pattern B.

Test charts for correction LUT measurement are created separately for the respective landing interference patterns in this way. In order to create a chart for correction LUT measurement for the landing interference pattern A, the image setting value at image formation positions of the nozzle group A is taken to be 0 or alternatively an ejection disabling command is given to the head driver (drive circuit) so as not to eject ink, for a particular nozzle (at least one nozzle and desirably a plurality of nozzles spaced at suitable intervals apart) belonging to the nozzle group A corresponding to the landing interference pattern A (so as not to perform image formation from the particular nozzle(s)). A nozzle set artificially to an ejection failure status in this way is called an "artificial ejection failure nozzle". At the same time as an ejection disabling process of this kind, the image setting values of the image formation positions of the adjacent nozzles before and after the artificial ejection failure nozzle are set to values obtained by multiplying a correction coefficient by the basic image setting value corresponding to a solid image of a prescribed density (tone value). A plurality of patches are formed while varying, in stepwise fashion, the correction coefficient applied to the basic image setting value corresponding to a particular density.

In FIG. 16, in order to simplify the drawings, the correction coefficient is changed in five steps, and five patches corresponding to five different correction coefficients are formed, but there are no particular restrictions on the number of steps in which the correction coefficient is changed. Furthermore, here, only a chart (group of patches) relating to one basic image setting value corresponding to a particular density is depicted, but similar groups of patches are formed for a plurality of basic image setting values of different densities (tone values).

For example, the range of tones from 0 to 255 is divided equally into 32 steps, and 20 patch groups are formed by changing the correction coefficient in 20 steps, for the basic image setting value of each tone (density). In other words, 32×20 patches are created in respect of one artificial ejection failure nozzle. From the viewpoint of raising measurement accuracy (improving measurement reliability), it is desirable to have a plurality of ejection failure nozzles, and similar patch groups are formed in respect of each of a plurality of artificial ejection failure nozzles.

If a chart for correction LUT measurement is created for the landing interference pattern B as shown on the right-hand side in FIG. 16, an ejection disabling process similar to that described above is carried out in respect of particular nozzles (at least one nozzle and desirably a plurality of nozzles spaced at suitable intervals apart) belonging to the nozzle group B corresponding to the landing interference pattern B, the image setting values for the image formation positions of the adjacent nozzles before and after the artificial ejection failure nozzle are set to a value obtained by multiplying the basic image setting value by a correction coefficient, similarly to the foregoing description, and a plurality of patches are formed by varying the correction coefficient in a stepwise fashion.

Furthermore, if a plurality of heads are provided for respective ink colors corresponding to inks of a plurality of colors (for example, four colors of C, M, Y and K), then separate charts for the respective colors (head-specific charts) are also created.

Although it is desirable to form all of the correction LUT charts for the landing interference pattern A and the correction LUT charts for the landing interference pattern B on one sheet of paper 40, it is also possible to output the charts on separate sheets of paper 40 for each of the landing interference patterns A and B, or to output the charts on separate sheets of paper for the respective ink colors (for the respective heads).

The charts for correction LUT measurement relating to the landing interference patterns A and B are formed and output in this way by an actual device (inkjet recording apparatus)

(step S24 in FIG. 14), and an ejection failure correction LUT is created by measuring the output results (charts) (step S26).

More specifically, in the measurement in step S26, the patch using a correction coefficient which produces the best visual impression (the best output image quality without conspicuous stripes) is selected from the plurality of patches which have been formed using different correction coefficients in the correction LUT charts. In this way, the best correction coefficient is determined for each basic image setting value and for each landing interference pattern A and B, and an ejection failure correction LUT (DATA 27) for each landing interference pattern is obtained (see FIGS. 17A and 17B). FIG. 17A shows one example of a correction LUT for nozzles having the landing interference pattern A and FIG. 17B shows one example of a correction LUT for nozzles having the landing interference pattern B.

The horizontal axis in FIGS. 17A and 17B represents an image setting value indicating the instructed solid density (base tone value) when forming the test chart, and the vertical axis represents the value specified as the correction coefficient producing the best correction effect. FIGS. 17A and 17B show a smooth continuous graph, but if test charts are created for base tone values in 32 steps in the range from a value of 0 to 255, then discrete data corresponding to these respective values is obtained. Intermediate data is estimated from these discrete data values by means of a common interpolation method.

Furthermore, separately from the step for obtaining an ejection failure correction LUT for each landing interference pattern as described above (FIGS. 17A and 17B) (S24 to S26), before these steps (S24 to S26) are carried out, or after these steps (S24 to S26), ejection failure nozzle position information which is required for correcting ejection failure is determined (step S20). The method of acquiring ejection failure nozzle position information is similar to the example described in relation to FIG. 1.

Description of Image Output Flow

There follows a description of the image output flow which includes ejection failure correction processing using the ejection failure nozzle position information and the ejection failure correction LUT described above.

Firstly, image data which is the object of image formation is input (step S30 in FIG. 14). Next, ejection failure correction processing is carried out on the input image data (DATA 31) (step S32). In performing this ejection failure correction, a correction LUT to be used for the ejection failure correction of each ejection failure nozzle is selected by referring to the ejection failure correction LUT (DATA 27) on the basis of the correspondence information (DATA 11) between the nozzle positions and landing interference patterns, and the ejection failure nozzle position information (DATA 21). The correction coefficient obtained from the selected correction LUT is multiplied by the image setting values before and after the ejection failure nozzle to create ejection failure corrected image data.

Following the examples in FIGS. 15 to 17B, if the ejection failure nozzle indicated in the ejection failure nozzle position information is a nozzle belonging to the nozzle group A, then the correction LUT for nozzles having landing interference pattern A (FIG. 17A) is referenced, and the value of the correction coefficient associated with the image value (image setting value) of the corresponding pixel position is acquired. The image data peripheral to the ejection failure nozzle is corrected by using the correction coefficient thus obtained.

Furthermore, if the ejection failure nozzle indicated in the ejection failure nozzle position information is a nozzle belonging to the nozzle group B, then the correction LUT for nozzles having landing interference pattern B (FIG. 17B) is referenced, and the value of the correction coefficient associated with the image value (image setting value) of the corresponding pixel position is acquired. The image data peripheral to the ejection failure nozzle is corrected by using the correction coefficient thus obtained.

The ejection failure corrected image data (DATA 33) obtained in this way is converted to N values (step S34) to obtain N value image data (DATA 35). The device which performs the N value conversion processing in step S34 may employ a commonly known half-toning device using error diffusion, dithering, a threshold value matrix, a density pattern, or the like. The half-toning process generally converts tonal image data having M values ($M \geq 3$) into tonal image data having N values ($N<M$). In the simplest example, the image data is converted into dot image data having 2 values (dot on/dot off), but in a half-toning process, it is also possible to perform quantization based on multiple values which correspond to different types of dot size (for example, three types of dot: a large dot, a medium dot and a small dot).

The N-value image data (DATA 35) obtained by the N value conversion in step S34 is sent to the format conversion processing unit for the inkjet head driver, and is converted to a data format for the inkjet head driver (step S36). In this way, the data is converted into image data of a printable data format, and image data for output is obtained.

The ejection failure corrected image is formed by controlling droplet ejection from the nozzles of the inkjet head on the basis of this image data for output and outputting an image (performing image formation onto the paper 40).

(a) to (d) of FIG. 18 show schematic views of the results of image correction according to the present embodiment. As a comparison with the method described in relation to (a) to (d) of FIG. 12 reveal, in the present embodiment which is shown in (a) to (d) of FIG. 18, the correction coefficient peripheral to the ejection failure nozzle $N_Z_A$ belonging to the nozzle group A and the correction coefficient peripheral to the ejection failure nozzle $N_Z_B$ belonging to the nozzle group B are proper values corresponding to the respective landing interference patterns A and B, and the image setting value peripheral to the ejection failure nozzle $N_Z_A$ and the image setting value peripheral to the ejection failure nozzle $N_Z_B$ are both corrected to optimal values (see (c) of FIG. 18).

Consequently, it is possible to resolve over-correction or under-correction of the causes of landing interference, which are a problem in the method described in relation to (d) of FIG. 12 (see (d) of FIG. 18), and a good image in which stripes caused by ejection failure nozzles are not conspicuous can be formed.

When this fourteenth embodiment is combined with the first to thirteenth embodiments described above, for example, a measurement chart constituted by an arrangement of patches of the same density (tone L) which have different deposition patterns is output onto the paper, and an optimal ejection failure correction parameter (correction coefficient) is selected by reading in this measurement chart and analyzing the image thus read in.

In other words, as described in the fourteenth embodiment, since the optimal parameter for ejection failure correction varies depending on the position of the ejection failure nozzle, it is desirable to determine the optimal value of the ejection failure correction parameter in accordance with the nozzle position. Therefore, it is desirable to form a group of measurement patches at the same density (tone L) while changing the nozzle position at which ejection is disabled (artificial ejection failure nozzle).

Fifteenth Embodiment

In the fourteenth embodiment, an example is given in which the nozzles in a head module 12 are arranged in a line shape. In implementing the present invention, the mode of arrangement of the nozzles is not limited to this. The fifteenth embodiment describes an example where nozzles are arranged in a matrix fashion. FIG. 19 shows an example of a nozzle arrangement of a head module 50 relating to the fifteenth embodiment. If the conveyance direction of the paper 40 is taken to be the y direction and the paper width direction perpendicular to this is taken to be the x direction, then the nozzle arrangement of the head module 50 has four nozzle rows which have different positions in the y direction. The lowest level in FIG. 19 is called a first nozzle row, the level above this is called a second nozzle row, the level above this is called a third nozzle row, and the uppermost level is called a fourth nozzle row.

Looking in particular at each of the nozzle rows, the nozzle pitch Pm in the x direction within each row is uniform. Taking the nozzle positions of the first nozzle row as a reference, the nozzle positions of the second nozzle row are shifted by Pm/2 in the x direction. The nozzle positions of the third nozzle row are shifted by Pm/4 in the x direction with respect to the nozzle positions of the first nozzle row, and the nozzle positions of the fourth nozzle row are shifted by Pm x ¾ in the x direction with respect to the nozzle positions of the first nozzle row. If the group of nozzles arranged in a staggered configuration including four rows in this way are projected onto the x axis, then the nozzles 20 are aligned at a uniform pitch (Pm/4) in the x direction. In other words, this head module 50 has a minimum recording pitch (dot pitch) of Pm/4 in the x direction on the paper 40.

As the paper 40 is conveyed, the first nozzle row which is situated on the furthest upstream side in terms of the paper conveyance direction (y direction) performs ejection first, after which droplet ejection is performed from the respective nozzle rows in the sequence of second row, third row, and fourth row (i.e. in order of second row, third row, and fourth row), at droplet ejection timings having a time difference (Lm/v) specified by the paper conveyance speed v and the nozzle row pitch (distance between nozzle rows in the y direction) Lm; by this means it is possible to form a line of dots aligned in the x direction. In FIG. 19, the pitch between the nozzle rows (distance in the y direction) Lm is uniform, but it is also possible to adopt a mode in which the row pitch varies.

Looking at correspondence between the alignment sequence of the dots aligned in mutually adjacent positions in the x direction on the paper 40, and the nozzles which record respective dots, in respect of a line (dot row) in the x direction recorded by the head module 50 in FIG. 19, there are dots formed by droplets ejected by nozzles of the third row in the right-hand adjacent positions to dots formed by nozzles of the first row, dots formed by droplets ejected by nozzles of the second row are formed adjacently to the right of these, and dots formed by droplets ejected by nozzles of the fourth row are formed further adjacently to the right of these. Dots formed by droplets ejected by nozzles of the first row are situated adjacently to the right of the dots formed by droplets ejected by nozzles of the fourth row, whereupon a similar sequence is repeated successively. In other words, if the nozzle row numbers which form the dot rows aligned in the x direction are expressed in the dot alignment sequence, then there is a periodicity based on a repeated unit of four nozzles: "1→3→2→4→1→3→2→4→ . . ." (i.e. in order of 1, 3, 2, 4, 1, 3, 2, 4 . . . ).

In this way, when the matrix-shaped nozzle arrangement shown in FIG. 19 is replaced by a nozzle row aligned effectively in one row at different nozzle positions in the x direction (a nozzle row projected onto the x axis) and the resulting nozzle alignment sequence is observed, a periodic arrangement based on a sequence "1→3→2→4" of the nozzle row numbers is obtained.

Here, the repetition unit is "1→3→2→4", but the repetition unit may also be considered as "3→2→4→1", "2→4→1→3" or "4→1→3→2".

In the case of an inkjet image forming apparatus which is equipped with a head module 50 having this nozzle arrangement, firstly, the respective nozzles are classified depending on which landing interference pattern they belong to. As stated previously, the nozzle arrangement of the head module 50 in FIG. 19 has a periodicity based on a repetition unit of four nozzles. Therefore, firstly, the nozzle groups are classified into nozzle groups a to d on the basis of the periodicity.

Thereupon, the type of landing interference that actually occurs when nozzles belonging to the respective groups (in FIG. 19, the nozzles $N_Z$_a, $N_Z$_b, Nz_c, Nz_d) suffer ejection failure is investigated. FIG. 20A shows a state where nozzle $N_Z$_a and nozzle $N_Z$_b have suffered ejection failure, and FIG. 20B shows a state where nozzle $N_Z$_c and nozzle $N_Z$_d have suffered ejection failure. Due to similar reasons to the effects shown in FIGS. 13A and 13B, the nozzle $N_Z$_a and the nozzle $N_Z$_b have the same landing interference pattern, as shown in FIG. 20A, and the nozzle Nz_c and the nozzle $N_Z$_d have the same landing interference pattern, as shown in FIG. 20B.

In other words, the nozzles which are adjacent before and after the ejection failure nozzles $N_Z$_a and $N_Z$_b (namely, the adjacent to ejection failure nozzles) belong to the nozzle groups c and d (see FIG. 19), and the droplets ejected from the adjacent to ejection failure nozzles belonging to these nozzle groups c and d are deposited before the droplets ejected by the nozzle groups a and b. Therefore, landing interference does not occur in the droplets relating to the previous deposition, even if the nozzle $N_Z$_a and the nozzle Nz_b of the nozzle groups a and b which eject droplets subsequently are suffering ejection failure. This state is similar to that shown in FIG. 13B. Consequently, as shown in the right-hand diagram in FIG. 20A, the gap ΔSa between dots formed by droplets ejected by the pair of adjacent to ejection failure nozzles which are adjacent to the ejection failure nozzle $N_Z$_a and the gap ΔSb between dots formed by droplets ejected by the pair of adjacent to ejection failure nozzles which are adjacent to the ejection failure nozzle $N_Z$_b are not affected by increase in error due to landing interference, and these gaps are narrow (ΔSa=ΔSb).

On the other hand, the nozzles which are adjacent before and after the ejection failure nozzles $N_Z$_c and $N_Z$_d (namely, the adjacent to ejection failure nozzles) belong to the nozzle groups a and b, and the droplets ejected from the adjacent to ejection failure nozzles belonging to these nozzle groups a and b are deposited after the droplets ejected by the nozzle groups c and d. Therefore, if the nozzle $N_Z$_c and the nozzle $N_Z$_d of the nozzle groups c and d which eject droplets previously are suffering ejection failure, then landing interference occurs in respect of the subsequently ejected droplets. This state is similar to that shown in FIG. 13A. Consequently, as shown in the right-hand diagram in FIG. 20B, the gap ΔSc between dots formed by droplets ejected by the pair of adjacent to ejection failure nozzles which are adjacent to the ejection failure nozzle $N_Z$_c and the gap ΔSd between dots formed by droplets ejected by the pair of adjacent to ejection failure nozzles which are adjacent to the ejection failure nozzle $N_Z$_d are both affected by increase in error due to landing interference, and therefore these gaps are wide ($\Delta Sc=\Delta Sd>\Delta Sa$).

Therefore, it is possible to divide the landing interference patterns into two types: the landing interference pattern A such as that shown in FIG. 20A and the landing interference pattern B such as that shown in FIG. 20B. By means of the foregoing, the classification of the landing interference patterns is completed.

The nozzles belonging to the nozzle groups a and b are associated with the landing interference pattern A and the nozzles belonging to the nozzle groups c and d are associated with the landing interference pattern B. In this way, correspondence information between the landing interference pattern and the nozzles is obtained.

Subsequently, similarly to the fourteenth embodiment, a correction LUT for each landing interference pattern is measured from test charts corresponding to the respective landing interference patterns, and ejection failure is corrected in respect of the actual input image data (see FIG. 14).

FIG. 21 is an example of an ejection failure correction parameter selection chart according to the fourteenth embodiment, and FIG. 22 is an example of an ejection failure correction parameter selection chart according to the fifteenth embodiment. In the charts depicted in these diagrams, the selection charts in each landing pattern are formed simultaneously by the head 10 or the head module 50. However, it is not especially necessary to form images of the selection charts corresponding to a plurality of landing patterns, simultaneously on one sheet of paper 3, and therefore the charts can be divided over a plurality of sheets of paper. The ejection failure position in the selection patch (measurement patch) of the selection chart for each landing pattern is set to coincide with the position of that landing pattern in the head 10 or the head module 50.

By analyzing a chart of this kind, using the analyzing device according to the first to thirteenth embodiments, it is possible to select an optimal value of the ejection failure correction parameter for each tone of each landing pattern in each module.

FURTHER EMBODIMENTS

Modification Example 1

In the fourteenth embodiment and the fifteenth embodiment, ejection failure correction is carried out by raising the image setting values before and after an ejection failure nozzle. Instead of, or in combination with, the correction of image setting values of this kind, it is also possible to perform ejection failure correction by increasing the dot diameter or raising the droplet ejection density before and after an ejection failure nozzle. Furthermore, in FIG. 14, correction is applied to the image data before the N value conversion processing, but it is also possible to adopt a mode in which correction is applied to image data after the N value conversion processing (applied to image data which has been converted to N values).

Modification Example 2

In the fifteenth embodiment, in an example in which nozzles 20 are arranged in a matrix configuration on the head module 50, the landing interference patterns are classified on the basis of the periodicity of the nozzle arrangement. If the nozzle arrangement has another regular pattern (for example, symmetry), then the classification of landing interference patterns can be limited by taking these characteristics into account.

Explanation of Inkjet Recording Apparatus

FIG. 23 is an example of the composition of an inkjet recording apparatus relating to an embodiment of the present invention. This inkjet recording apparatus 100 (corresponding to the image forming apparatus) is an inkjet recording apparatus using a pressure drum direct image formation method which forms a desired color image by ejecting droplets of inks of a plurality of colors from inkjet heads 172M, 172K, 172C and 172Y onto a recording medium 124 (corresponding to a "recording medium", also called "paper" below for the sake of convenience) held on a pressure drum (image formation drum 170) of an image formation unit 116. The inkjet recording apparatus 100 is an image forming apparatus of an on-demand type employing a two-liquid reaction (aggregation) method in which an image is formed on a recording medium 124 by depositing a treatment liquid (here, an aggregating treatment liquid) on the recording medium 124 before ejecting droplets of ink, and causing the treatment liquid and ink liquid to react together.

As shown in FIG. 23, the inkjet recording apparatus 100 principally includes a paper feed unit 112, a treatment liquid deposition unit 114, an image formation unit 116, a drying unit 118, a fixing unit 120 and a paper output unit 122.

Paper Supply Unit

The paper supply unit 112 is a mechanism for supplying a recording medium 124 to the treatment liquid deposition unit 114, and a recording medium 124 which is cut sheet paper is stacked in the paper supply unit 112. From a paper supply tray 150 in the paper supply unit 112, the recording medium 124 is supplied one sheet at a time to the treatment liquid deposition unit 114.

In the inkjet recording apparatus 100 according to the present example, cut sheet paper (cut paper) is used as the recording medium 124, but it is also possible to adopt a composition in which paper is supplied from a continuous roll (rolled paper) and is cut to the required size.

Treatment Liquid Deposition Unit

The treatment liquid deposition unit 114 is a mechanism which deposits treatment liquid onto a recording surface of the recording medium 124. The treatment liquid includes a coloring material aggregating agent which aggregates the coloring material (in the present embodiment, the pigment) in the ink deposited by the image formation unit 116, and the separation of the ink into the coloring material and the solvent is promoted due to the treatment liquid and the ink making contact with each other.

The treatment liquid deposition unit 114 includes a paper supply drum 152, a treatment liquid drum 154 and a treatment liquid application apparatus 156. The treatment liquid drum 154 includes a hook-shaped gripping device (gripper) 155 provided on the outer circumferential surface thereof, and is devised in such a manner that the leading end of the recording medium 124 can be held by gripping the recording medium 124 between the hook of the holding device 155 and the circumferential surface of the treatment liquid drum 154. The treatment liquid drum 154 may include suction holes provided in the outer circumferential surface thereof, and be connected to a suctioning device which performs suctioning via the suction holes. By this means, it is possible to hold the recording medium 124 tightly against the circumferential surface of the treatment liquid drum 154.

A treatment liquid application apparatus 156 is provided opposing the circumferential surface of the treatment liquid drum 154, to the outside of the drum. The treatment liquid application apparatus 156 includes a treatment liquid vessel in which treatment liquid is stored, an anilox roller which is partially immersed in the treatment liquid in the treatment liquid vessel, and a rubber roller which transfers a dosed amount of the treatment liquid to the recording medium 124, by being pressed against the anilox roller and the recording medium 124 on the treatment liquid drum 154. According to this treatment liquid application apparatus 156, it is possible to apply treatment liquid to the recording medium 124 while dosing the amount of the treatment liquid.

In the present embodiment, a composition is described which uses a roller-based application method, but the method is not limited to this, and it is also possible to employ various other methods, such as a spray method, an inkjet method, or the like.

The recording medium 124 onto which treatment liquid has been deposited by the treatment liquid deposition unit 114 is transferred from the treatment liquid drum 154 to the image formation drum 170 of the image formation unit 116 via the intermediate conveyance unit 126.

Image Formation Unit

The image formation unit 116 includes an image formation drum 170, a paper pressing roller 174, and inkjet heads 172M, 172K, 172C and 172Y. Similarly to the treatment liquid drum 154, the image formation drum 170 includes a hook-shaped holding device (gripper) 171 on the outer circumferential surface of the drum.

The inkjet heads 172M, 172K, 172C and 172Y are each full-line type inkjet recording heads having a length corresponding to the maximum width of the image forming region on the recording medium 124, and a nozzle row of nozzles for ejecting ink arranged throughout the whole width of the image forming region is formed in the ink ejection surface of each head. The inkjet heads 172M, 172K, 172Y and 172Y are disposed so as to extend in a direction perpendicular to the conveyance direction of the recording medium 124 (the direction of rotation of the image formation drum 170).

When droplets of the corresponding colored ink are ejected from the inkjet heads 172M, 172K, 172C and 172Y toward the recording surface of the recording medium 124 which is held tightly on the image formation drum 170, the ink makes contact with the treatment liquid which has previously been deposited onto the recording surface by the treatment liquid deposition unit 114, the coloring material (pigment) dispersed in the ink is aggregated, and a coloring material aggregate is thereby formed. By this means, flowing of coloring material, and the like, on the recording medium 124 is prevented and an image is formed on the recording surface of the recording medium 124.

In other words, the recording medium 124 is conveyed at a uniform speed by the image formation drum 170, and it is possible to record an image on an image forming region of the recording medium 124 by performing just one operation of moving the recording medium 124 and the respective inkjet heads 172M, 172K, 172C and 172Y relatively in the conveyance direction (in other words, by a single sub-scanning operation). This single-pass type image formation with such a full line type (page-wide) head can achieve a higher printing speed compared with a case of a multi-pass type image formation with a serial (shuttle) type of head which moves back and forth reciprocally in the direction (the main scanning direction) perpendicular to the conveyance direction of the recording medium (sub-scanning direction), and hence it is possible to improve the print productivity.

Although the configuration with the CMYK standard four colors is described in the present embodiment as an example, combinations of the ink colors and the number of colors are not limited to those. As required, light inks, dark inks and/or special color inks can be added. For example, a configuration in which inkjet heads for ejecting light-colored inks such as light cyan and light magenta are added is possible. Moreover, there are no particular restrictions of the sequence in which the heads of respective colors are arranged.

The recording medium 124 onto which an image has been formed in the image formation unit 116 is transferred from the image formation drum 170 to the drying drum 176 of the drying unit 118 via the intermediate conveyance unit 128.

Drying Unit

The drying unit 118 is a mechanism which dries the water content contained in the solvent which has been separated by the action of aggregating the coloring material, and includes a drying drum 176 and a solvent drying device 178. Similarly to the treatment liquid drum 154, the drying drum 176 includes a hook-shaped holding device (gripper) 177 provided on the outer circumferential surface of the drum, in such a manner that the leading end of the recording medium 124 can be held by the holding device 177.

The solvent drying device 178 is disposed in a position opposing the outer circumferential surface of the drying drum 176, and is constituted by a plurality of halogen heaters 180 and hot air spraying nozzles 182 disposed respectively between the halogen heaters 180. It is possible to achieve various drying conditions, by suitably adjusting the temperature and air flow volume of the hot air flow which is blown from the hot air flow spraying nozzles 182 toward the recording medium 124, and the temperatures of the respective halogen heaters 180.

The recording medium 124 on which a drying process has been carried out in the drying unit 118 is transferred from the drying drum 176 to the fixing drum 184 of the fixing unit 120 via the intermediate conveyance unit 130.

Fixing Unit

The fixing unit 120 is constituted by a fixing drum 184, a halogen heater 186, a fixing roller 188 and an in-line sensor 190 (corresponding to the in-line scanner). Similarly to the treatment liquid drum 154, the fixing drum 184 includes a hook-shaped holding device (gripper) 185 provided on the outer circumferential surface of the drum, in such a manner that the leading end of the recording medium 124 can be held by the holding device 185.

By means of the rotation of the fixing drum 184, the recording medium 124 is conveyed with the recording surface facing to the outer side, and preliminary heating by the halogen heater 186, a fixing process by the fixing roller 188 and inspection by the in-line sensor 190 are carried out in respect of the recording surface.

The fixing roller 188 is a roller member for melting self-dispersing polymer micro-particles contained in the ink and thereby causing the ink to form a film, by applying heat and pressure to the dried ink, and is composed so as to heat and pressurize the recording medium 124. More specifically, the fixing roller 188 is disposed so as to press against the fixing drum 184, in such a manner that a nip is created between the fixing roller 188 and the fixing drum 184. By this means, the recording medium 124 is sandwiched between the fixing roller 188 and the fixing drum 184 and is nipped with a prescribed nip pressure (for example, 0.15 MPa), whereby a fixing process is carried out.

Furthermore, the fixing roller 188 is constituted by a heated roller formed by a metal pipe of aluminum, or the like, having good thermal conductivity, which internally incorporates a halogen lamp, and is controlled to a prescribed temperature (for example, 60° C. to 80° C.). By heating the recording medium 124 by means of this heating roller, thermal energy equal to or greater than the Tg temperature (glass transition temperature) of the latex contained in the ink is applied and the latex particles are thereby caused to melt. By this means, fixing is performed by pressing the latex particles into the undulations in the recording medium 124, as well as leveling the undulations in the image surface and obtaining a glossy finish.

On the other hand, the in-line sensor 190 is a measurement device for measuring an ejection defect checking pattern, the image density, and image defects, and the like, with respect to an image which has been formed on the recording medium 124 (including an ejection failure correction parameter optimal value selection chart as shown in FIG. 2, a test pattern as explained in FIG. 16, and a test pattern for ejection failure nozzle determination, and the like); a CCD line sensor, or the like, is employed as the in-line sensor 190.

According to the fixing unit 120 having the composition described above, the latex particles in the thin image layer formed by the drying unit 118 are heated, pressurized and melted by the fixing roller 188, and hence the image layer can be fixed to the recording medium 124. Furthermore, the surface temperature of the fixing drum 184 is set to not less than 50° C. Drying is promoted by heating the recording medium 124 held on the outer circumferential surface of the fixing drum 184 from the rear surface, and therefore breaking of the image during fixing can be prevented, and furthermore, the strength of the image can be increased by the effects of the increased temperature of the image.

Instead of an ink which includes a high-boiling-point solvent and polymer micro-particles (thermoplastic resin particles), it is also possible to include a monomer which can be polymerized and cured by exposure to UV light. In this case, the inkjet recording apparatus 100 includes a UV exposure unit for exposing the ink on the recording medium 124 to UV light, instead of a heat and pressure fixing unit (fixing roller 188) based on a heat roller. In this way, if using an ink containing an active light-curable resin, such as an ultraviolet-curable resin, a device which irradiates the active light, such as a UV lamp or an ultraviolet LD (laser diode) array, is provided instead of the fixing roller 188 for heat fixing.

Paper Output Unit

A paper output unit 122 is provided subsequently to the fixing unit 120. The paper output unit 122 includes an output tray 192, and a transfer drum 194, a conveyance belt 196 and a tensioning roller 198 are provided between the output tray 192 and the fixing drum 184 of the fixing unit 120 so as to oppose same. The recording medium 124 is sent to the conveyance belt 196 by the transfer drum 194 and output to the output tray 192. The details of the paper conveyance mechanism created by the conveyance belt 196 are not shown, but the leading end portion of a recording medium 124 after printing is held by a gripper on a bar (not illustrated) which spans across the endless conveyance belt 196, and the recording medium is conveyed to above the output tray 192 due to the rotation of the conveyance belts 196.

Furthermore, although not shown in FIG. 23, the inkjet recording apparatus 100 according to the present embodiment includes, in addition to the composition described above, an ink storing and loading unit which supplies inks to the inkjet heads 172M, 172K, 172C and 172Y, and a device which supplies treatment liquid to the treatment liquid deposition unit 114, as well as including a head maintenance unit (maintenance station) which carries out cleaning (nozzle surface wiping, purging, nozzle suctioning, and the like) of the inkjet heads 172M, 172K, 172C and 172Y, a position determination sensor which determines the position of the recording medium 124 in the paper conveyance path, a temperature sensor which determines the temperature of the respective units of the apparatus, and the like.

Structure of Head

Next, the structure of heads is described. The respective heads 172M, 172K, 172C and 172Y have the same structure, and a reference numeral 250 is hereinafter designated to any of the heads.

FIG. 24A is a plan perspective diagram illustrating an embodiment of the structure of a head 250, and FIG. 24B is a partial enlarged diagram of same. Moreover, FIGS. 25A and 25B are planar perspective views illustrating other structural embodiments of heads 250, and FIG. 26 is a cross-sectional diagram illustrating a liquid droplet ejection element for one channel being a recording element unit (an ink chamber unit corresponding to one nozzle 251) (a cross-sectional diagram along line 26-26 in FIGS. 24A and 24B).

As illustrated in FIGS. 24A and 24B, the head 250 according to the present embodiment has a structure in which a plurality of ink chamber units (liquid droplet ejection elements) 253, each having a nozzle 251 forming an ink droplet ejection aperture, a pressure chamber 252 corresponding to the nozzle 251, and the like, are disposed two-dimensionally in the form of a staggered matrix, and hence the effective nozzle interval (the projected nozzle pitch) as projected (orthographically-projected) in the lengthwise direction of the head (the direction perpendicular to the paper conveyance direction) is reduced and high nozzle density is achieved.

The mode of forming nozzle rows which have a length equal to or more than the entire width Wm of the recording area of the recording medium 124 in a direction (direction indicated by arrow M: main scanning direction) substantially perpendicular to the paper conveyance direction (direction indicated by arrow S: sub-scanning direction) of the recording medium 124 is not limited to the embodiment described above. For example, instead of the configuration in FIG. 24A, as illustrated in FIG. 25A, a line head having nozzle rows of a length corresponding to the entire width of the recording area of the recording medium 124 can be formed by arranging and combining, in a staggered matrix, short head modules 250' having a plurality of nozzles 251 arrayed in a two-dimensional fashion. It is also possible to arrange and combine short head modules 250" in a line as shown in FIG. 25B.

The pressure chamber 252 provided to each nozzle 251 has substantially a square planar shape (see FIGS. 24A and 24B), and has an outlet port for the nozzle 251 at one of diagonally opposite corners and an inlet port (supply port) 254 for receiving the supply of the ink at the other of the corners. The planar shape of the pressure chamber 252 is not limited to this embodiment and can be various shapes including quadrangle (rhombus, rectangle, etc.), pentagon, hexagon, other polygons, circle, and ellipse.

As illustrated in FIG. 26, the head 250 is configured by stacking and joining together a nozzle plate 251A in which the nozzles 251 are formed, and a flow channel plate 252P in which the pressure chambers 252 and the flow channels including the common flow channel 255 are formed, and the like. The nozzle plate 251A constitutes a nozzle surface (ink ejection surface) 250A of the head 250 and has formed therein the two-dimensionally arranged nozzles 251 communicating respectively to the pressure chambers 252.

The flow channel plate 252P constitutes lateral side wall parts of the pressure chambers 252 and serves as a flow channel formation member which forms a supply port 254 as a limiting part (the narrowest part) of an individual supply channel leading the ink from the common flow channel 255 to a pressure chamber 252. FIG. 26 is simplified for the convenience of explanation, and the flow channel plate 252P may be structured by stacking one or more substrates.

The nozzle plate 251A and the flow channel plate 252P can be made of silicon and formed in the required shapes by means of the semiconductor manufacturing process.

The common flow channel 255 is connected to an ink tank (not shown) which is a base tank for supplying ink, and the ink supplied from the ink tank is delivered through the common flow channel 255 to the pressure chambers 252.

A piezoelectric actuator 258 having an individual electrode 257 is connected on a diaphragm 256 constituting a part of faces (the ceiling face in FIG. 26) of a pressure chamber 252. The diaphragm 256 in the present embodiment is made of silicon (Si) having a nickel (Ni) conductive layer serving as a common electrode 259 corresponding to lower electrodes of a plurality of piezoelectric actuators 258, and serves as the common electrode of the piezoelectric actuators 258 which are disposed correspondingly to the respective pressure chambers 252. The diaphragm 256 may be formed by a non-conductive material such as resin; and in this case, a common electrode layer made of a conductive material such as metal is formed on the surface of the diaphragm member. It is also possible that the diaphragm which also serves as the common electrode is made of metal (an electrically-conductive material) such as stainless steel (SUS).

When a drive voltage is applied to the individual electrode 257, the piezoelectric actuator 258 is deformed, the volume of the pressure chamber 252 is changed, and the pressure in the pressure chamber 252 is changed, so that the ink inside the pressure chamber 252 is ejected through the nozzle 251. When the displacement of the piezoelectric actuator 258 is returned to its original state after the ink is ejected, new ink is refilled in the pressure chamber 252 from the common flow channel 255 through the supply port 254.

As illustrated in FIG. 24B, the plurality of ink chamber units 253 having the above-described structure are arranged in a prescribed matrix arrangement pattern in a line direction along the main scanning direction and a column direction oblique at a predetermined angle of θ with respect to the main scanning direction, and thereby the high density nozzle head is formed in the present embodiment. In this matrix arrangement, the nozzles 251 can be regarded to be equivalent to those substantially arranged linearly at a fixed pitch P=Ls/tan θ in the main scanning direction, where Ls is a distance between the nozzles adjacent in the sub-scanning direction.

In implementing the present invention, the mode of arrangement of the nozzles 251 in the head 250 is not limited to the embodiments in the drawings, and various nozzle arrangement structures can be employed. For example, instead of the matrix arrangement as described in FIGS. 24A and 24B, it is also possible to use a single linear arrangement, a V-shaped nozzle arrangement, or an undulating nozzle arrangement, such as zigzag configuration (such as W-shape arrangement) which repeats units of V-shaped nozzle arrangements.

The devices which generate pressure (ejection energy) applied to eject droplets from the nozzles in the inkjet head is not limited to the piezoelectric actuator (piezoelectric elements), and can employ various pressure generation devices (energy generation devices), such as heaters (heating elements) in a thermal system (which uses the pressure resulting from film boiling by the heat of the heaters to eject ink) and various actuators in other systems. According to the ejection system employed in the head, the corresponding energy generation devices are arranged in the flow channel structure body.

Description of Control System

FIG. 27 is a block diagram showing a system configuration of the inkjet recording apparatus 100. As shown in FIG. 27, the inkjet recording apparatus 100 includes a communication interface 270, a system controller 272, an image memory 274, a ROM 275, a motor driver 276, a heater driver 278, a print controller 280, an image buffer memory 282, a head driver 284 and the like.

The communication interface 270 is an interface unit (image input device) for receiving image data sent from a host computer 286. A serial interface such as USB (Universal Serial Bus), IEEE1394, Ethernet (registered trademark), and wireless network, or a parallel interface such as a Centronics interface may be used as the communication interface 270. A buffer memory (not shown) may be mounted in this portion in order to increase the communication speed.

The image data sent from the host computer 286 is received by the inkjet recording apparatus 100 through the communication interface 270, and is temporarily stored in the image memory 274. The image memory 274 is a storage device for storing images inputted through the communication interface 270, and data is written and read to and from the image memory 274 through the system controller 272. The image memory 274 is not limited to a memory composed of semiconductor elements, and a hard disk drive or another magnetic medium may be used.

The system controller 272 includes a central processing unit (CPU) and peripheral circuits thereof, and the like, and it functions as a control device for controlling the whole of the inkjet recording apparatus 100 in accordance with a prescribed program, as well as a calculation device for performing various calculations. More specifically, the system controller 272 controls the various sections, such as the communication interface 270, image memory 274, motor driver 276, heater driver 278, and the like, as well as controlling communications with the host computer 286 and writing and reading to and from the image memory 274 and the ROM 275, and it also generates control signals for controlling the motor 288 of the conveyance system and the heater 289.

Furthermore, the system controller 272 includes: a depositing error measurement and calculation unit 272A which performs calculation processing for generating data indicating the positions of defective nozzles, depositing position error data, data indicating the density distribution (density data) and other data, from the data read in from the test chart by the in-line sensor (in-line determination unit) 190; and a density correction coefficient calculation unit 272B which calculates density correction coefficients from the information relating to the measured depositing position error and the density information. The processing functions of the depositing error measurement and calculation unit 272A and the density correction coefficient calculation unit 272B can be achieved by means of an ASIC (application specific integrated circuit), software, or a suitable combination of same. Moreover, the system controller 272 functions as a scan data analysis processing device described in step S3 in FIG. 1, and functions as a calculation device which specifies an optimal value of the ejection failure correction parameter.

The density correction coefficient data obtained by the density correction coefficient calculation unit 272B is stored in a density correction coefficient storage unit 290.

Programs executed by the CPU of the system controller 272 and various types of data (including a chart for measuring ejection failure correction parameters, ejection failure nozzle information, data for deposition to form a test chart for detecting ejection failure nozzles, and the like) which are required for control procedures, are stored in the ROM 275. The ROM 275 may be a non-writeable storage device, or it may be a rewriteable storage device, such as an EEPROM. By utilizing the storage region of this ROM 275, the ROM 275 can be configured to be able to serve also as the density correction coefficient storage unit 290.

The image memory 274 is used as a temporary storage region for the image data, and it is also used as a program development region and a calculation work region for the CPU.

The motor driver (drive circuit) 276 drives the motor 288 of the conveyance system in accordance with commands from the system controller 272. The heater driver (drive circuit) 278 drives the heater 289 of the drying unit 118, and the like, in accordance with commands from the system controller 272.

The print controller 280 is a control unit which functions as a signal processing device for performing various treatment processes, corrections, and the like, in accordance with the control implemented by the system controller 272, in order to generate a signal for controlling droplet ejection from the image data (multiple-value input image data) in the image memory 274, as well as functioning as a drive control device which controls the ejection driving of the head 250 by supplying the ink ejection data thus generated to the head driver 284.

In other words, the print controller 280 includes a density data generation unit 280A, a correction processing unit 280B, an ink ejection data generation unit 280C and a drive waveform generation unit 280D. These functional units (280A to 280D) can be realized by means of an ASIC, software or a suitable combination of same.

The density data generation unit 280A is a signal processing device which generates initial density data for each of the ink colors, from the input image data, and it carries out density conversion processing (including UCR processing and color conversion) and, where necessary, it also performs pixel number conversion processing.

The correction processing unit 280B is a processing device which performs density correction calculations using the density correction coefficients stored in the density correction coefficient storage unit 290, and it carries out the non-uniformity correction processing. This correction processing unit 280B executes processing of ejection failure correction as explained in FIG. 1 and FIG. 14.

The ink ejection data generation unit 280C is a signal processing device including a halftoning device which converts the corrected image data (density data) generated by the correction processing unit 280B into binary or multiple-value dot data (corresponding to "N value image data" as explained in FIG. 14), and the ink ejection data generation unit 280C carries out binarization (multiple-value conversion) processing.

The ink ejection data generated by the ink ejection data generation unit 280C is supplied to the head driver 284, which controls the ink ejection operation of the head 250 accordingly.

The drive waveform generation unit 280D is a device for generating drive signal waveforms in order to drive the piezoelectric actuators 258 (see FIG. 26) corresponding to the respective nozzles 251 of the head 250. The signals (drive waveform) generated by the drive waveform generation unit 280D is supplied to the head driver 284. The signals outputted from the drive waveform generation unit 280D may be digital waveform data, or it may be an analog voltage signal.

The drive waveform generation unit 280D generates selectively the drive signal having the recording waveform and the drive signal having the abnormal nozzle detection waveform. The various waveform data is beforehand stored in the ROM 275, and the waveform data to be used is selectively output according to requirements. The inkjet recording apparatus 100 shown in the present embodiment employs a drive method in which a common drive power waveform signal is applied to the piezoelectric actuators 258 of the head 250, and ink is ejected from the nozzles 251 corresponding to the respective piezoelectric actuators 258 by turning switching elements (not illustrated) connected to the individual electrodes of the piezoelectric actuators 258 on and off, in accordance with the ejection timing of the respective piezoelectric actuators 258.

The image buffer memory 282 is provided with the print controller 280, and image data, parameters, and other data are temporarily stored in the image buffer memory 282 when image data is processed in the print controller 280. FIG. 27 shows a mode in which the image buffer memory 282 is attached to the print controller 280; however, the image memory 274 may also serve as the image buffer memory 282. Also possible is a mode in which the print controller 280 and the system controller 272 are integrated to form a single processor.

To give a general description of the sequence of processing from image input to print output, image data to be printed (original image data) is inputted from an external source through the communication interface 270, and is accumulated in the image memory 274. At this stage, multiple-value RGB image data is stored in the image memory 274, for example.

In this inkjet recording apparatus 100, an image which appears to have a continuous tonal graduation to the human eye is formed by changing the deposition density and the dot size of fine dots created by ink (coloring material), and therefore, it is necessary to convert the input digital image into a dot pattern which reproduces the tonal graduations of the input digital image (namely, the light and shade toning of the image) as faithfully as possible. Therefore, original image data (RGB data) stored in the image memory 274 is sent to the print controller 280, through the system controller 272, and is converted to the dot data for each ink color by passing through the density data generation unit 280A, the correction processing unit 280B, and the ink ejection data generation unit 280C of the print controller 280.

In general, the dot data is generated by subjecting the image data to color conversion processing and half-tone processing. The color conversion processing is processing for converting image data represented by a sRGB system, for instance (for example, 8-bit RGB image data) into image data of the respective colors of ink used by the inkjet printer (KCMY color data, in the present embodiment).

Half-tone processing is processing for converting the color data of the respective colors generated by the color conversion processing into dot data of respective colors (in the present embodiment, KCMY dot data) by error diffusion or a threshold matrix method, or the like.

In other words, the print controller 280 performs processing for converting the input RGB image data into dot data for the four colors of K, C, M and Y. When the processing of conversion to dot data is carried out, processing for correcting ejection failure is performed as shown in FIG. 1 and FIG. 14.

The dot data thus generated by the print controller 280 is stored in the image buffer memory 282. This dot data of the respective colors is converted into CMYK droplet ejection data for ejecting ink from the nozzles of the head 250, thereby establishing the ink ejection data to be printed.

The head driver 284 includes an amplifier circuit and outputs drive signals for driving the piezoelectric actuators 258 corresponding to the respective nozzles 251 of the head 250 in accordance with the print contents, on the basis of the ink ejection data and the drive waveform signals supplied by the print controller 280. A feedback control system for maintaining constant drive conditions in the head may be included in the head driver 284.

By supplying the drive signals outputted by the head driver 284 to the head 250 in this way, ink is ejected from the corresponding nozzles 251. By controlling ink ejection from the print head 250 in synchronization with the conveyance speed of the recording medium 124, an image is formed on the recording medium 124.

As described above, the ejection volume and the ejection timing of the ink droplets from the respective nozzles are controlled through the head driver 284, on the basis of the ink ejection data and the drive signal waveform generated by implementing required signal processing in the print controller 280. By this means, desired dot size and dot positions can be achieved.

As described with reference to FIG. 23, the in-line sensor (determination unit) 190 is a block including an image sensor. The in-line sensor 190 reads in the image printed on the recording medium 124, performs required various signal processing operations, and the like, to determine the print situation (presence/absence of ejection, variation in droplet ejection, optical density, and the like), and supplies these determination results to the print controller 280 and the system controller 272.

The print controller 280 implements various corrections with respect to the head 250, on the basis of the information obtained from the in-line sensor (determination unit) 190, according to requirements, and it implements control for carrying out cleaning operations (nozzle restoring operations), such as preliminary ejection, suctioning, or wiping, as and when necessary.

The maintenance mechanism 294 includes members used for head maintenance operation, such as an ink receptacle, a suction cap, a suction pump, a wiper blade, and the like.

The operating unit 296 which forms a user interface includes an input device 297 through which an operator (user) can make various inputs, and a display unit 298. The input device 297 may employ various formats, such as a keyboard, mouse, touch panel, buttons, or the like. The operator is able to input print conditions, select image quality modes, input and edit additional information, search for information, and the like, by operating the input device 297, and is able to check various information, such as the input contents, search results, and the like, through a display on the display unit 298. The display unit 298 also functions as a warning notification device which displays a warning (error) message, or the like.

Furthermore, a combination of the system controller 272 and the print controller 280 corresponds to an "optimal value determination processing device", a "chart output control device" and a "defective recording element correction device". The density correction coefficient storage unit 29 corresponds to a "defective recording element correction parameter storage device", and the in-line sensor 190 and the depositing error measurement and calculation unit 272A which processes the signal from the sensor correspond to a "defective recording element position information acquiring device".

It is also possible to adopt a mode in which the host computer 286 is equipped with all or a portion of the processing functions carried out by the depositing error measurement and calculation unit 272A, the density correction coefficient calculation unit 272B, the density data generation unit 280A and the correction processing unit 280B as shown in FIG. 27.

Example of Composition of Ejection Failure Correction Parameter Determination Apparatus Using Off-Line Scanner In FIG. 23 to FIG. 27, an example is described in which a chart is read in by using an in-line sensor 190 which is incorporated into the inkjet recording apparatus 100 and the analysis processing apparatus for this read image is also mounted on the inkjet recording apparatus 100, but in implementing embodiments of the present invention, it is also possible to adopt a composition in which a chart is read in by using an off-line scanner, or the like, which is separate from the inkjet printer, and the data of the read image is analyzed by an apparatus such as a personal computer.

FIG. 28 is a block diagram showing an example of a composition of an ejection failure correction parameter determination apparatus which is used to analyze an ejection failure correction parameter measurement chart according to an embodiment of the present invention.

By creating a program which causes a computer to implement the scan data analysis processing algorithm described in step S3 of FIG. 1 and step S26 of FIG. 14, and by making the computer operate by means of this program, it is possible to cause the computer to function as a calculation apparatus of an ejection failure correction parameter determination apparatus (which corresponds to an "optimal value determination processing device").

The ejection failure correction parameter determination apparatus 400 shown in FIG. 28 includes a flat-bed scanner forming an image reading apparatus 402, and a computer 410 which carries out image analysis calculations, and the like.

The image reading apparatus 402 includes an RGB line sensor which captures an image of an ejection failure correction parameter optimal value selection chart, and other charts, and also includes a scanning mechanism and a line sensor drive circuit for moving the line sensor in the reading scanning direction (the sub-scanning direction of the scanner), and a signal processing circuit which converts an output signal (imaging signal) of the sensor from analog to digital so as to obtain digital image data of a prescribed format, and the like.

The computer 410 includes a main body 412, a display (display device) 414 and an input apparatus 416 such as a keyboard, mouse, or the like (input device for inputting various instructions). In the main body 412, a central processing unit (CPU) 420, a RAM 422, a ROM 424, an input control unit 426 which controls signal input from the input apparatus 416, a display control unit 428 which outputs display signals to the display monitor 414, a hard disk apparatus 430, a communications interface 432, a media interface 434, and the like, are provided, and respective circuits of these are mutually interconnected via a bus 436.

The CPU 420 functions as an overall control apparatus and calculation apparatus (calculation means). The RAM 422 is used as a temporary storage area for data and as a work area when executing the program by the CPU 420. The ROM 424 is a rewriteable non-volatile storage device which stores a boot program for operating the CPU 420 and various setting values, network connection information, and the like. An operating system (OS), various application software (programs), data, and the like, are stored in the hard disk apparatus 430.

The communications interface 432 is a device such as USB (Universal Serial Bus), LAN, or Bluetooth (registered tradename), for connecting to an external device and a communications network in accordance with a prescribed communications method. The media interface 434 is a device which controls reading and writing from and to the external storage apparatus 438, which is, typically, a memory card or magnetic disk, a magneto-optical disk, or an optical disk.

In the present embodiment, the image reading apparatus 402 and the computer 410 are connected via a communications interface 432, and captured image data read by the image reading apparatus 402 is input to the computer 410. A composition is also possible in which the captured image data acquired by the image reading apparatus 402 is stored temporarily in an external storage apparatus 438, and the captured image data is input to the computer 410 via the external storage apparatus 438.

The processing program for analyzing the read image of a chart according to the ejection failure correction parameter determination method relating to an embodiment of the present invention is stored in the hard disk apparatus 430 or the external storage apparatus 438, and the program is read out according to requirements, and expanded in the RAM 422 and executed. Alternatively, it is also possible to adopt a mode in which a program is provided by a server which is located on a network (not illustrated) connected via a communications interface 432, or to adopt a mode in which a calculation processing service based on the program is provided as a service of an ASP (Application Service Provider), via an Internet server.

An operator is able to input various initial value settings by operating the input apparatus 416 while looking at an application window (not illustrated) which is displayed on the display monitor 414, as well as being able to confirm the calculation results on the display monitor 414.

Furthermore, the calculation result data (measurement results) can be stored in the external storage apparatus 438, or can be output externally via the communications interface 432. The measurement results information is input to the inkjet recording apparatus (a printer which carries out a correction process using a defective recording element correction parameter), via the communications interface 432 or the external storage apparatus 438.

Recording Medium

"Recording medium" is a general term for a medium on which dots are recorded by recording elements, and this includes things called various terms, such as print medium, recording medium, image forming medium, image receiving medium, ejection receiving medium, and the like. In implementing the present invention, there are no particular restrictions on the material or shape, or other features, of the recording medium, and it is possible to employ various different media, irrespective of their material or shape, such as continuous paper, cut paper, seal paper, OHP sheets and other resin sheets, film, cloth, a printed substrate on which a wiring pattern, or the like, is formed, and a rubber sheet.

Device for Causing Relative Movement of Head and Paper

In the embodiments described above, an example is given in which a recording medium is conveyed with respect to a stationary head, but in implementing embodiments of the present invention, it is also possible to move a head with respect to a stationary recording medium. A full line type recording head based on a single pass method is normally arranged in a direction perpendicular to the feed direction of the recording medium (conveyance direction), but a mode is also possible in which a head is arranged in an oblique direction forming a certain prescribed angle with respect to the direction perpendicular to the conveyance direction.

Modification Example of Head Composition

Furthermore, in the embodiments described above, an inkjet recording apparatus using a page-wide full-line type head having a nozzle row of a length corresponding to the full width of the recording medium is described, but the application of embodiments of the present invention is not limited to this and the present invention can also be applied to an inkjet recording apparatus which performs image recording by means of a plurality of head scanning actions while moving a short recording head, such as a serial head (shuttle scanning head), or the like.

Example of Application of the Present Invention

In the embodiments described above, application to an inkjet recording apparatus for graphic printing is described, but the scope of application of the present invention is not limited to this example. For example, the present invention can also be applied widely to inkjet systems which performs image formation of various shapes or patterns using liquid function material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

Mode of Use of Recording Head Other than Inkjet Type Recording Head

In the description given above, an inkjet recording apparatus is given as one example of an image forming apparatus using a recording head, but the range of application of the present invention is not limited to this. The present invention can also be applied to image forming apparatuses which carry out dot recording based on other methods apart from an inkjet method, such as a thermal transfer recording apparatus which comprises a recording head having thermal elements as recording elements, an LED electrophotographic printer which comprises a recording head having LED elements as recording elements, a silver halide photographic printer having an LED line exposure head, and the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A defective recording element correction parameter selection chart which is output by an image forming apparatus that performs image formation on a recording medium by a plurality of recording elements included in a recording head while conveying at least one of the recording head and the recording medium so as to cause relative movement between the recording head and the recording medium, the chart being used, in a case where there is at least one defective recording element which is not able to perform recording among the plurality of recording elements, in order to determine a defective recording element correction parameter expressing an amount of correction for correcting image formation defects caused by the at least one defective recording element, with image formation by a recording element other than the at least one defective recording element, the chart including:

a reference patch constituted by a uniform image which is an image formed on a region of the recording medium with a uniform density based on a constant tone; and at least one measurement patch in which a state after correction using the amount of correction corresponding to a candidate value of the defective recording element correction parameter which expresses the amount of correction is reproduced in a state that one or more of the recording elements which have formed the reference patch are set to be in a non-recording state, the candidate value of the defective recording element correction parameter being applied to an image formation portion which is formed by a recording element that carries out recording in a vicinity of a non-recording position of the one or more of the recording elements which have formed the reference patch and have been set to be in the non-recording state.

2. The defective recording element correction parameter selection chart as defined in claim 1, wherein an image of a plurality of the measurement patches is formed by altering the candidate value.

3. The defective recording element correction parameter selection chart as defined in claim 2, wherein the reference patch included in the chart is disposed in a central portion of a patch arrangement in which a plurality of the measurement patches for comparison with the reference patch are arranged.

4. The defective recording element correction parameter selection chart as defined in claim 1, wherein the candidate value of the defective recording element correction parameter which is applied to the at least one measurement patch changes continuously in the at least one measurement patch.

5. The defective recording element correction parameter selection chart as defined in claim 1, wherein a plurality of combinations of the reference patch and the at least one measurement patch of a same tone are formed for each tone.

6. The defective recording element correction parameter selection chart as defined in claim 1, wherein:

the recording head includes a plurality of head modules; and the reference patch and the at least one measurement patch are formed by each head module.

7. A defective recording element correction parameter determination method comprising:

a chart reading step of reading the defective recording element correction parameter selection chart as defined in claim 1, with an optical reading device; and an optimal value determination processing step of determining an optimal value of the defective recording element correction parameter according to data of a captured image which is acquired with the optical reading device in the chart reading step.

8. The defective recording element correction parameter determination method as defined in claim 7, wherein:

the optimal value determination processing step includes an evaluation value calculation step of calculating an evaluation value which forms an evaluation index for evaluating a difference between the captured image of the reference patch and the captured image of the at least one measurement patch; and in the optimal value determination processing step, the optimal value of the defective recording element correction parameter is determined according to the evaluation value.

9. The defective recording element correction parameter determination method as defined in claim 8, wherein differential information between the captured image of the reference patch and the captured image of the at least one measurement patch, or correlation information between the captured image of the reference patch and the captured image of the at least one measurement patch, is calculated in the evaluation value calculation step.

10. The defective recording element correction parameter determination method as defined in claim 8, comprising an integration profile generation step of calculating integration profiles respectively for the captured image of the reference patch and the captured image of the at least one measurement patch, wherein the evaluation value is determined by comparing the integration profiles of the captured image of the reference patch and the captured image of the at least one measurement patch.

11. The defective recording element correction parameter determination method as defined in claim 8, wherein a smoothing processing is applied to the respective captured images of the reference patch and the at least one measurement patch.

12. The defective recording element correction parameter determination method as defined in claim 11, wherein a visual transfer function is used as the smoothing processing.

13. The defective recording element correction parameter determination method as defined in claim 8, comprising a differential data generation step of generating differential data which expresses difference between the captured image of the reference patch and the captured image of the at least one measurement patch, from the captured image of the reference patch and the captured image of the at least one measurement patch, wherein a smoothing processing is applied to the differential data.

14. The defective recording element correction parameter determination method as defined in claim 13, wherein a visual transfer function is used as the smoothing processing.

15. The defective recording element correction parameter determination method as defined in claim 8, wherein:

differential data which expresses difference between a captured image of the reference patch and a captured image of the at least one measurement patch, is generated from the captured image of the reference patch and the captured image of the at least one measurement patch; and the optimal value of the defective recording element correction parameter is determined by defining a sum of squares of components of the differential data or a square root of the sum of the squares, as the evaluation index.

16. The defective recording element correction parameter determination method as defined in claim 15, wherein determination of the optimal value is made by adopting a value of the defective recording element correction parameter at a point of intersection of two regression lines derived from plot points of the evaluation value on a graph based on a coordinates system where a first axis represents the defective recording element correction parameter which is used as the candidate value applied to the at least one measurement patch, or a value calculated from this defective recording element correction parameter, and a second axis represents the evaluation index.

17. The defective recording element correction parameter determination method as defined in claim 16, wherein the value calculated from the defective recording element correction parameter is a value proportional to a droplet ejection rate of the recording element which carries out the recording in the vicinity of the non-recording position of the one or more of the recording elements which have been set to be in a non-recording state.

18. The defective recording element correction parameter determination method as defined in claim 15, wherein determination of the optimal value is made by adopting a value of the defective recording element correction parameter corresponding to a minimum value or a maximum value of the evaluation index on a graph based on a coordinates system where a first axis represents the defective recording element correction parameter which is used as the candidate value applied to the at least one measurement patch, or a value calculated from this defective recording element correction parameter, and a second axis represents the evaluation index.

19. The defective recording element correction parameter determination method as defined in claim 18, wherein the value calculated from the defective recording element correction parameter is a value proportional to a droplet ejection rate of the recording element which carries out the recording in the vicinity of the non-recording position of the one or more of the recording elements which have been set to be in a non-recording state.

20. The defective recording element correction parameter determination method as defined in claim 15, wherein determination of the optimal value is made by adopting a value of the defective recording element correction parameter at which a second order differential value is a minimum value or a maximum value on a graph based on a coordinates system where a first axis represents the defective recording element correction parameter which is used as the candidate value applied to the at least one measurement patch, or a value calculated from this defective recording element correction parameter, and a second axis represents the evaluation index.

21. The defective recording element correction parameter determination method as defined in claim 20, wherein the value calculated from the defective recording element correction parameter is a value proportional to a droplet ejection rate of the recording element which carries out the recording in the vicinity of the non-recording position of the one or more of the recording elements which have been set to be in a non-recording state.

22. The defective recording element correction parameter determination method as defined in claim 8, wherein:

differential data which expresses difference between the captured image of the reference patch and the captured image of the at least one measurement patch, is generated from the captured image of the reference patch and the captured image of the at least one measurement patch; and the optimal value of the defective recording element correction parameter is determined by defining a variance value of components of the differential data or a maximum value of components of the differential data, as the evaluation index.

23. The defective recording element correction parameter determination method as defined in claim 22, wherein determination of the optimal value is made by adopting a value of the defective recording element correction parameter at a point of intersection of two regression lines derived from plot points of the evaluation value on a graph based on a coordinates system where a first axis represents the defective recording element correction parameter which is used as the candidate value applied to the at least one measurement patch, or a value calculated from this defective recording element correction parameter, and a second axis represents the evaluation index.

24. The defective recording element correction parameter determination method as defined in claim 23, wherein the value calculated from the defective recording element correction parameter is a value proportional to a droplet ejection rate of the recording element which carries out the recording in the vicinity of the non-recording position of the one or more of the recording elements which have been set to be in a non-recording state.

25. The defective recording element correction parameter determination method as defined in claim 22, wherein determination of the optimal value is made by adopting a value of the defective recording element correction parameter corresponding to a minimum value or a maximum value of the evaluation index on a graph based on a coordinates system where a first axis represents the defective recording element correction parameter which is used as the candidate value applied to the at least one measurement patch, or a value calculated from this defective recording element correction parameter, and a second axis represents the evaluation index.

26. The defective recording element correction parameter determination method as defined in claim 25, wherein the value calculated from the defective recording element correction parameter is a value proportional to a droplet ejection rate of the recording element which carries out the recording in the vicinity of the non-recording position of the one or more of the recording elements which have been set to be in a non-recording state.

27. The defective recording element correction parameter determination method as defined in claim 22, wherein determination of the optimal value is made by adopting a value of the defective recording element correction parameter at which a second order differential value is a minimum value or a maximum value on a graph based on a coordinates system where a first axis represents the defective recording element correction parameter which is used as the candidate value applied to the at least one measurement patch, or a value calculated from this defective recording element correction parameter, and a second axis represents the evaluation index.

28. The defective recording element correction parameter determination method as defined in claim 27, wherein the value calculated from the defective recording element correction parameter is a value proportional to a droplet ejection rate of the recording element which carries out the recording in the vicinity of the non-recording position of the one or more of the recording elements which have been set to be in a non-recording state.

29. The defective recording element correction parameter determination method comprising the step of re-creating the defective recording element correction parameter selection chart by further reducing a step size of the candidate value of the defective recording element correction parameter applied to the at least one measurement patch according to the optimal value determined by the defective recording element correction parameter determination method as defined in claim 7, and selecting a further optimal value by applying the defective recording element correction parameter determination method as defined in claim 7 to the re-created chart.

30. The defective recording element correction parameter determination method as defined in claim 7, wherein a skew correction processing is applied to the captured image which is acquired in the chart reading step.

31. The defective recording element correction parameter determination method as defined in claim 7, wherein an in-line scanner mounted on the image forming apparatus is used as the optical reading device.

32. The defective recording element correction parameter determination method as defined in claim 7, wherein:

the plurality of recording elements eject droplets from nozzles and deposit the ejected droplets onto the recording medium so as to perform the image formation on the recording medium;

the defective recording element correction parameter determination method comprises a landing-interference-pattern-specific test chart forming step of performing an ejection disabling process of artificially disabling ejection in different recording elements corresponding to difference of a plurality of types of landing interference patterns on a basis of correspondence information indicating correspondence relationship between the plurality of types of landing interference patterns and the plurality of recording elements, the plurality of types of landing interference patterns being defined to correspond to landing interference inducing factors which include a deposition sequence of the droplets on the recording medium that is governed by an arrangement configuration of the plurality of recording elements of the recording head and the direction of the relative movement, and forming a plurality of types of test charts corresponding to the plurality of types of landing interference patterns respectively; and the defective recording element correction parameters for ejection failure correction are determined respectively for the plurality of types of landing interference patterns, according to output results of the plurality of types of test charts formed for the plurality of types of landing interference patterns respectively.

33. A defective recording element correction parameter determination apparatus comprising:

an optical reading device which reads the defective recording element correction parameter selection chart as defined in claim 1 and generates captured image data; and an optimal value determination processing device which carries out a signal processing for determining an optimal value of the defective recording element correction parameter according to the captured image data acquired via the optical reading device.

34. An image forming apparatus comprising:

the recording head having a plurality of recording elements; and a conveyance device which conveys at least one of the recording head and the recording medium so as to cause relative movement between the recording head and the recording medium, wherein the image forming apparatus forms an image on the recording medium by the plurality of recording elements while causing the relative movement between the recording head and the recording medium, the image forming apparatus further comprising:

a chart output control device which controls image formation to output the defective recording element correction parameter selection chart as defined in claim 1;

a defective recording element correction parameter storage device which stores the defective recording element correction parameter determined according to output results of the defective recording element correction parameter selection chart;

a defective recording element position information acquisition device which acquires defective recording element position information indicating a position of a defective recording element that cannot be used for the image formation, of the plurality of recording elements of the recording head; and a defective recording element correction device which applies the defective recording element correction parameter according to the defective recording element position information in such a manner that an image formation defect caused by the defective recording element is corrected by the image formation by a recording element other than the defective recording element.

35. The image forming apparatus as defined in claim 34, further comprising an in-line scanner as an optical reading device which reads the defective recording element correction parameter selection chart and generates captured image data.

36. The image forming apparatus as defined in claim 34, wherein:

the plurality of recording elements eject droplets from nozzles and deposit the ejected droplets onto the recording medium so as to perform the image formation on the recording medium;

the image forming apparatus comprises a landing-interference-pattern-specific test chart forming device which performs an ejection disabling process of artificially disabling ejection in different recording elements corresponding to difference of a plurality of types of landing interference patterns on a basis of correspondence information indicating correspondence relationship between the plurality of types of landing interference patterns and the plurality of recording elements, the plurality of types of landing interference patterns being defined to correspond to landing interference inducing factors which include a deposition sequence of the droplets on the recording medium that is governed by an arrangement configuration of the plurality of recording elements of the recording head and the direction of the relative movement, and forms a plurality of types of test charts corresponding to the plurality of types of landing interference patterns respectively; and the defective recording element correction parameters for ejection failure correction are determined respectively for the plurality of types of landing interference patterns, according to output results of the plurality of types of test charts formed for the plurality of types of landing interference patterns respectively, and the defective recording element correction parameters for ejection failure correction determined respectively for the plurality of types of landing interference patterns are stored in the defective recording element correction parameter storage device.

* * * * *